US008167627B1

(12) United States Patent
Janos et al.

(10) Patent No.: US 8,167,627 B1
(45) Date of Patent: May 1, 2012

(54) POSITIONABLE LIGHTING SYSTEMS AND METHODS

(75) Inventors: Joseph John Janos, Wadsworth, OH (US); Christine Carlson, Medina, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 13/251,438

(22) Filed: Oct. 3, 2011

Related U.S. Application Data

(63) Continuation of application No. 12/891,129, filed on Sep. 27, 2010, now Pat. No. 8,029,293, which is a continuation of application No. 12/249,232, filed on Oct. 10, 2008, now Pat. No. 7,854,616.

(60) Provisional application No. 60/979,470, filed on Oct. 12, 2007, provisional application No. 61/021,471, filed on Jan. 16, 2008, provisional application No. 61/046,811, filed on Apr. 22, 2008.

(51) Int. Cl.
*H01R 12/00* (2006.01)

(52) U.S. Cl. ..... 439/76.1

(58) Field of Classification Search ..... 439/76.1, 439/236, 242–243, 502
See application file for complete search history.

(56) References Cited

U.S. PATENT DOCUMENTS

| | | | |
|---|---|---|---|
| 3,115,311 | A | 12/1963 | Miller |
| 3,830,445 | A | 8/1974 | Moore |
| D243,793 | S | 3/1977 | Nagel |
| 4,234,819 | A | 11/1980 | Maxey |
| 4,740,872 | A | 4/1988 | Chou |
| 4,870,548 | A | 9/1989 | Beachy et al. |
| 4,994,944 | A | 2/1991 | Vernondier |
| 5,086,379 | A | 2/1992 | Denison et al. |
| 5,107,408 | A | 4/1992 | Vernondier |
| D332,150 | S | 12/1992 | Diorio |
| 5,249,109 | A | 9/1993 | Denison et al. |
| 5,386,356 | A | 1/1995 | Davis, Jr. et al. |
| D371,857 | S | 7/1996 | Gismondi |
| 5,545,952 | A | 8/1996 | Mortensen |
| 5,561,346 | A | 10/1996 | Byrne |
| 5,649,760 | A | 7/1997 | Beadle |
| 5,655,829 | A | 8/1997 | Lin et al. |
| 5,661,374 | A | 8/1997 | Cassidy et al. |

(Continued)

FOREIGN PATENT DOCUMENTS

| | | |
|---|---|---|
| CA | 2434689 | 1/2005 |

(Continued)

OTHER PUBLICATIONS

Correspondence from Averill & Green firm dated Sep. 9, 2010.
First Office Action dated Nov. 23, 2011, for Chinese Patent Application No. 200810178548.

*Primary Examiner* — Jean F Duverne
(74) *Attorney, Agent, or Firm* — Calfee, Halter & Griswold LLP

(57) ABSTRACT

A lighting assembly includes a lighting unit having a housing defining an internal cavity and an opening. A light source is assembled within the internal cavity of the housing. An electrical wire is electrically connected to the light source at a first end and is configured to be contained at least in part within the housing. The opening is configured to permit withdrawal of a user selected amount of the electrical wire from within the internal cavity and/or to permit a user selected amount of the electrical wire to be inserted into the internal cavity.

22 Claims, 46 Drawing Sheets

U.S. PATENT DOCUMENTS 5,841,359 A 11/1998 Grilk
5,842,771 A 12/1998 Thrasher et al.
5,890,794 A 4/1999 Abtahi et al.
5,893,633 A 4/1999 Uchio et al.
5,909,955 A 6/1999 Roorda
5,967,649 A 10/1999 Schlesinger
6,016,038 A 1/2000 Mueller et al.
6,030,099 A 2/2000 McDermott
6,053,623 A 4/2000 Jones et al.
D424,721 S 5/2000 Garrity et al.
D425,225 S 5/2000 Holderfield
6,113,248 A 9/2000 Mistopoulos et al.
6,142,649 A 11/2000 Beghelli
6,158,882 A 12/2000 Bischoff, Jr.
6,184,628 B1 2/2001 Ruthenberg
6,203,170 B1 3/2001 Patrick et al.
6,283,612 B1 9/2001 Hunter
6,290,365 B1 9/2001 Schlesinger
6,361,186 B1 3/2002 Slayden
6,367,949 B1 4/2002 Pederson
6,390,261 B1 5/2002 Liao
6,435,691 B1 8/2002 Macey et al.
6,472,823 B2 10/2002 Yen
6,491,413 B1 12/2002 Benesohn
6,554,218 B2 4/2003 Buyce et al.
6,566,824 B2 5/2003 Panagotacos et al.
D476,105 S 6/2003 Alsobrook
6,582,100 B1 6/2003 Hochstein et al.
6,592,238 B2 7/2003 Cleaver et al.
6,609,804 B2 8/2003 Nolan et al.
6,616,291 B1 9/2003 Love
6,619,449 B2 9/2003 Liao
6,641,283 B1 11/2003 Bohler
6,648,498 B1 11/2003 Tsao
D484,270 S 12/2003 Yiu
6,659,622 B2 12/2003 Katogi et al.
6,660,935 B2 12/2003 Southard et al.
D486,940 S 2/2004 Yiu
6,736,525 B2 5/2004 Chin
6,776,504 B2 8/2004 Sloan et al.
6,781,329 B2 8/2004 Mueller et al.
6,793,369 B2 9/2004 Calzaretta et al.
6,798,154 B1 9/2004 Sullivan et al.
6,834,981 B2 12/2004 Nagai et al.
6,837,598 B2 1/2005 Marcus
6,851,832 B2 2/2005 Tieszen
6,869,204 B2 3/2005 Morgan et al.
6,874,910 B2 4/2005 Sugimoto et al.
6,882,111 B2 4/2005 Kan et al.
6,902,292 B2 6/2005 Lai
6,902,308 B2 6/2005 Love
6,929,382 B2 8/2005 Kuisma
6,942,354 B2 9/2005 Metayer et al.
6,953,262 B2 10/2005 Cleaver et al.
6,969,179 B2 11/2005 Sloan et al.
6,979,107 B1 12/2005 Benensohn
6,982,518 B2 1/2006 Chou et al.
7,011,421 B2 3/2006 Hulse et al.
7,018,079 B1 3/2006 Franco-Vila et al.
7,021,792 B2 4/2006 Lin
7,025,477 B2 4/2006 Blessing et al.
7,063,440 B2 6/2006 Mohacsi et al.
7,063,553 B1 6/2006 Mullen
7,152,999 B2 12/2006 Lin
7,159,700 B2 * 1/2007 Liao ..... 191/12.4
7,160,140 B1 1/2007 Mrakovich et al.
7,175,306 B2 2/2007 Pan
7,192,154 B2 3/2007 Becker
D540,969 S 4/2007 Ueda et al.
D543,297 S 5/2007 Osiecki et al.
7,210,957 B2 5/2007 Mrakovich et al.
7,213,961 B2 5/2007 Hyder
7,217,004 B2 5/2007 Park et al.
7,220,014 B2 5/2007 Lay et al.
D544,117 S 6/2007 Coushaine
D544,388 S 6/2007 Chisholm
D544,972 S 6/2007 Coushaine
7,273,299 B2 9/2007 Parkyn et al.
7,273,300 B2 9/2007 Mrakovich
7,296,913 B2 11/2007 Catalano et al.
7,303,310 B2 12/2007 You et al.
7,306,359 B2 12/2007 Harwood
7,307,391 B2 12/2007 Shan
7,318,661 B2 1/2008 Catalano
7,322,735 B1 1/2008 Caldani
7,329,024 B2 2/2008 Lynch et al.
7,331,689 B2 2/2008 Chen
7,334,918 B2 2/2008 Newton et al.
7,355,523 B2 4/2008 Sid
7,357,525 B2 4/2008 Doyle
7,364,322 B2 4/2008 Oppor et al.
7,397,462 B2 7/2008 Wu
7,549,784 B1 6/2009 Teeters
7,696,982 B2 * 4/2010 Chen et al. ..... 345/163
7,854,616 B2 12/2010 Janos et al.
8,029,293 B2 10/2011 Janos et al.
2003/0048632 A1 3/2003 Archer
2003/0063463 A1 4/2003 Sloan et al.
2003/0133287 A1 7/2003 Chen
2003/0151925 A1 8/2003 Crunk
2003/0193799 A1 10/2003 Bohler
2004/0017681 A1 1/2004 Lee
2004/0105264 A1 6/2004 Spero
2004/0113740 A1 6/2004 Sakai et al.
2005/0068777 A1 3/2005 Popovic
2005/0157495 A1 7/2005 Bruck
2005/0169015 A1 8/2005 Luk et al.
2005/0237746 A1 10/2005 Yiu
2005/0243549 A1 11/2005 Ruston
2006/0002104 A1 1/2006 Willis et al.
2006/0007151 A1 * 1/2006 Ram ..... 345/163
2006/0023454 A1 2/2006 Koren
2006/0056203 A1 3/2006 Lee et al.
2006/0067077 A1 3/2006 Kumthampinij et al.
2006/0232555 A1 10/2006 Wu
2006/0244622 A1 11/2006 Wray
2006/0250789 A1 11/2006 Coushaine
2007/0002020 A1 * 1/2007 Ranta et al. ..... 345/166
2007/0002558 A1 1/2007 Pryor
2007/0019409 A1 1/2007 Nawashiro et al.
2007/0041220 A1 2/2007 Lynch
2007/0070624 A1 3/2007 Sun
2007/0091592 A1 4/2007 Chu et al.
2007/0097670 A1 5/2007 Matthew et al.
2007/0124895 A1 6/2007 Brown
2007/0183151 A1 8/2007 Joseph
2007/0183156 A1 8/2007 Shan
2007/0190845 A1 8/2007 Mrakovich et al.
2007/0274067 A1 11/2007 Sloan et al.
2007/0285949 A1 12/2007 Lodhie et al.
2007/0290621 A1 12/2007 Clark et al.
2008/0030981 A1 2/2008 Mrakovich et al.
2008/0068830 A1 3/2008 Sharma
2008/0068834 A1 3/2008 Cunningham et al.
2008/0074879 A1 3/2008 Kuo et al.
2008/0074885 A1 3/2008 Brands et al.
2008/0084701 A1 4/2008 Van de Ven et al.
2008/0089053 A1 4/2008 Negley
2008/0094828 A1 4/2008 Shao
2008/0112161 A1 5/2008 Summers et al.
2008/0112170 A1 5/2008 Trott et al.
2008/0123331 A1 5/2008 Schroll et al.
2008/0123354 A1 5/2008 Caldani
2008/0130280 A1 6/2008 Rodstein et al.
2008/0130288 A1 6/2008 Catalano et al.
2008/0130309 A1 6/2008 Condon et al.
2008/0136313 A1 6/2008 Van de Ven et al.
2008/0137347 A1 6/2008 Trott et al.
2008/0151535 A1 6/2008 de Castris

FOREIGN PATENT DOCUMENTS

WO 2008/003725 1/2008
WO 2008/056308 5/2008

* cited by examiner

POSITIONABLE LIGHTING SYSTEMS AND METHODS

CROSS-REFERENCE TO RELATED APPLICATIONS

This application is a continuation of and claims priority to co-pending commonly assigned, U.S. patent application Ser. No. 12/891,129, filed Sep. 27, 2010, entitled Positionable Lighting Systems and Methods, which is a continuation of and claims priority to co-pending, commonly assigned, U.S. patent application Ser. No. 12/249,232, filed on Oct. 10, 2008, entitled Positionable Lighting Systems and Methods, which claims priority to, and any other benefit of, the following United States Provisional Patent Applications: Application Ser. No. 60/979,470, entitled POSITIONABLE LIGHTING SYSTEMS AND METHODS and filed Oct. 12, 2007; Application Ser. No. 61/021,471, entitled MODULAR LED LIGHTING SYSTEM and filed Jan. 16, 2008; and Application Ser. No. 61/046,811, entitled MODULAR LED LIGHTING SYSTEMS and filed Apr. 22, 2008. The entire disclosure of each of the above applications is fully incorporated herein by reference.

BACKGROUND

It is known to install lighting fixtures for indoor applications in various areas such as under cabinets. In these so-called "undercabinet" installations, lighting fixtures are mounted below a cabinet with wiring extending from light fixture to light fixture. An exemplary undercabinet lighting system is the KICHLER® KCL Undercabinet Series 1 family of undercabinet lighting products, which includes fluorescent and Xenon lighting fixtures of different sizes (e.g., one-light, two-light, and three-light) and wiring having connectors at each end for connection via cables of different lengths for facilitating undercabinet installations.

SUMMARY

The present application contemplates lighting assemblies for use in various installations, such as, for example, undercabinet and ceiling installations. The contemplated lighting assemblies may, for example, include features configured to facilitate easier and/or more rapid installation, a variety of lighting positions, orientations, and control features, and/or to provide a more aesthetically appealing lighting arrangement.

Accordingly, in one embodiment, a lighting assembly includes a lighting unit having a housing configured to define a gap around an outer perimeter of the housing, with a hub disposed radially inward of the gap. A light source is assembled with the housing. An electrical wire includes a first end electrically connected to the light source (directly or indirectly) and a second end configured to extend outward through the gap in the housing, the electrical wire being configured to be twisted about the hub. As used herein, "electrically connected" means either directly electrically connected or indirectly electrically connected or both directly and indirectly electrically connected, unless expressly modified by the words "directly" and/or "indirectly." As used herein, "twisting about" shall include both winding (or coiling or twisting in a winding direction) and unwinding (or uncoiling or twisting in an unwinding direction). The gap is configured to permit withdrawal of a user selected amount of a wound portion of the electrical wire from within the outer perimeter of the housing when the electrical wire is twisted about the hub in an unwinding direction, and/or to permit insertion of a user selected amount of an extended or unwound portion within the outer perimeter of the housing when the electrical wire is twisted about the hub in a winding direction.

According to another inventive aspect of the present application, a lighting assembly or system may be provided with multiple lighting units electrically connected in series or in parallel. In one embodiment, an exemplary lighting system includes at least first and second lighting units. The first lighting unit includes: a first housing configured to define a gap around an outer perimeter of the first housing, with a hub disposed radially inward of the gap; a first light source assembled with the first housing, the first light source being positioned to direct light outward of the first housing; and a first electrical wire having a first end electrically connected to the first light source and a second end configured to extend outward through the gap in the first housing, the first electrical wire being configured to be twisted about the hub. The second lighting unit includes a second housing and a second light source assembled with the second housing, the second light source being positioned to direct light outward of the second housing. An electrical connection is provided for electrically connecting one of the first and second lighting units with an external power source. The first electrical wire is electrically connected at the second end to the second light source for communicating electricity between the first and second light sources. The gap in the first housing is configured to permit withdrawal of a user selected amount of a wound portion of the first electrical wire from within the perimeter of the first housing when the first electrical wire is twisted about the hub in an unwinding direction.

According to yet another inventive aspect of the present application, a method for installing a lighting system is contemplated, in which first and second lighting units are provided. The first lighting unit includes: a first housing configured to define a gap around an outer perimeter of the first housing, with a first hub disposed radially inward of the gap; a first light source assembled with the first housing; and a first electrical wire having a first end electrically connected to the first light source and a second end configured to extend outward through the gap in the first housing. The second lighting unit includes a second housing and a second light source assembled with the second housing. The first lighting unit is affixed to a first desired position. A second desired position for the second lighting unit is identified. The first electrical wire is twisted about the first hub, such that a portion of the first electrical wire extending outward from the gap is sufficient to position the second lighting unit in the second desired position. The second lighting unit is affixed to the second desired position.

According to another aspect of the present application, one or more lighting components (including, for example, lighting fixtures, lighting switch controllers, and power supplies) may be configured to be directly or indirectly connected to each other as part of an adaptable, positionable lighting system.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention, wherein.

DETAILED DESCRIPTION

The present application is directed toward lighting products powered by an external electrical power source, either as individual lighting fixtures or portables ("lighting assemblies") or as lighting fixtures or portables electrically connected in series or in parallel ("lighting systems"). Exemplary embodiments include lighting assemblies and systems having light emitting diode (LED) light sources, and surface mountable lighting assemblies and systems. While the exemplary lighting assemblies and systems described herein include LED light sources in surface mountable housings, many different types of light sources (including, for example, incandescent, fluorescent, and halogen lighting) and many different types of positioning arrangements (including, for example, wall mounted, hanging, or free standing arrangements) may be utilized in the practice of the inventive aspects of the present application.

According to an inventive aspect of the present application, a lighting assembly may be configured to retain a portion of the electrical wire within a lighting assembly housing to limit exposed or dangling electrical wiring in the environment to be lighted. As an example, wire may be all or mostly or partially retained in the housing when the assembly is shipped, and a user withdraws from the housing a length of wire needed for the installation. As another example, wire may be all or mostly or partially outside the housing when the assembly is shipped, and a user inserts into the housing a length of wire not needed for the installation. In one embodiment, a portion of the electrical wiring may be twisted about a hub (which may be of any suitable size or shape) within an outer perimeter of the housing to retain this portion of the wire within the outer perimeter of the housing (for example, in an internal cavity). As an example, wire may be all or mostly or partially wound around the hub and retained in the housing when the assembly is shipped, and a user unwinds from (or twists in an unwinding direction with respect to) the housing a length of wire needed for the installation. As another example, wire may be all or mostly or partially outside the housing when the assembly is shipped, and a user winds around (or twists in a winding direction with respect to) the hub in the housing a length of wire not needed for the installation.

Figure 1A:
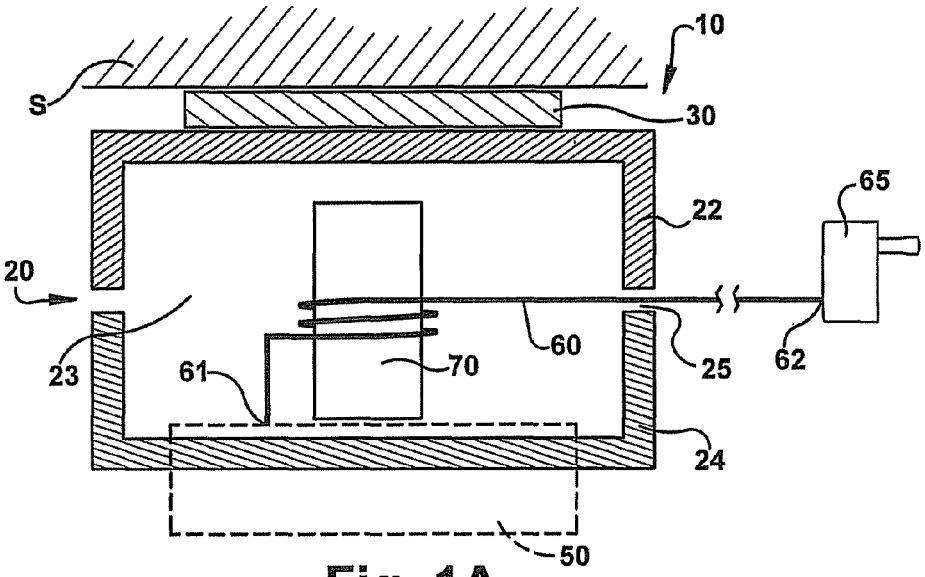
FIG. 1A is a side cross-sectional schematic view of an exemplary lighting assembly.

In the schematically illustrated embodiment of FIG. 1A, a lighting unit 10 includes a housing 20 having a base portion 22 and an outer portion 24. The base portion 22 and outer portion 24 may be assembled to define an internal cavity 23 and a gap 25 disposed between the base portion 22 and the outer portion 24 on an outer periphery of the housing 20. While the gap 25 may be a discrete opening in one location in the housing 20, in one embodiment, the gap 25 extends around the entire outer periphery of the housing 20. Also, while the base portion 22 and outer portion 24 may form integral portions of a single housing member, in another embodiment, the base portion and outer portions are formed from separate base and cover members, respectively. The lighting unit 10 may (i.e., might, but need not) include a mounting member 30 for affixing the lighting unit to a surface S.

In the exemplary embodiment, a light source 50 is assembled with the housing 20 to direct light outward of the outer portion 24 of the housing 20. The light source 50 may be disposed entirely within the internal cavity 23 of the housing 20, with the outer portion 24 being provided with a light transmitting portion (e.g., a window or opening) to direct light through and outward of the outer portion 24 of the housing 20. In other embodiments, the light source 50 may be disposed partially or entirely outside of the outer portion 24 to direct light outward of the outer portion 24.

In the exemplary embodiment, an electrical wire 60 is electrically connected (either directly or indirectly) at a first end 61 with the light source 50 to supply power to the light source. To allow a desired portion of the electrical wire 60 to be retained within the housing 20, the first end 61 of the electrical wire 60 may extend proximate to a hub 70 disposed axially between the base and outer portions 22, 24 of the housing 20 and radially inward of the gap 25, such that a portion of the electrical wire 60 (for example, a portion of the electrical wire 60 not needed to reach an electrical wall socket) may be wound around the hub 70. A second end 62 of the electrical wire 60 may extend through an opening in the housing 20. In one embodiment, the electrical wire 60 extends through a gap 25 disposed between the base portion 22 and the outer portion 24 on an outer periphery of the housing 20. Since the gap 25 extends around the entire outer periphery of the housing 20, the electrical wire 60 may be twisted about (wound onto and unwound from) the hub 70 like a spool. As an example, the wire 60 may be all or mostly or partially wound around the hub 70 and retained in the housing when the assembly is shipped, and a user unwinds from the housing a length of wire 60 needed for the installation. As another example, the wire 60 may be all or mostly or partially outside the housing when the assembly is shipped, and a user winds around the hub 70 in the housing a length of wire not needed for the installation. An electrical connector or plug 65 may be electrically connected to the second end 62 of the electrical wire 60 for connecting the lighting unit 10 to an external power source, such as, for example, a wall socket. In the alternative, the second end 62 of the wire may be free for connection to wiring (e.g., building wiring) or may be pre-connected to another lighting unit. Depending on the application (e.g., the type of light source) the wire 60, e.g., the electrical connector 65, may include a voltage adapter or LED driver to power the light source 50 appropriately.

Figure 1B:
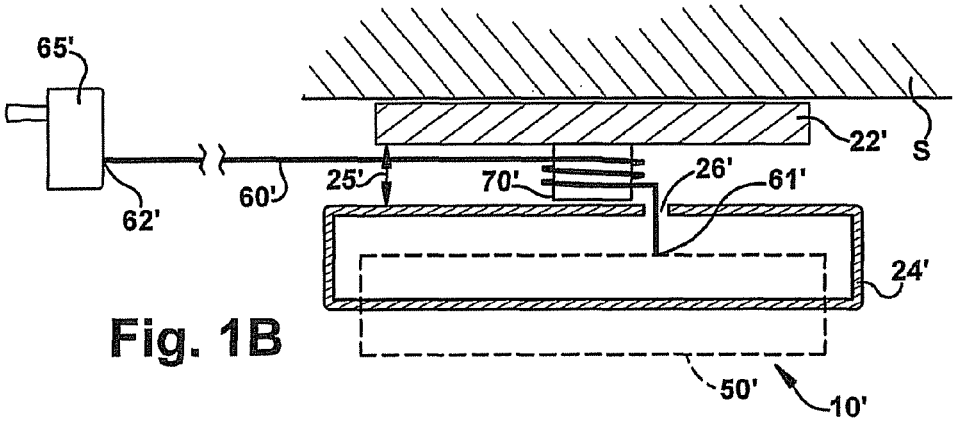
FIG. 1B is a side cross-sectional schematic view of another exemplary lighting assembly.
Figure 1C:
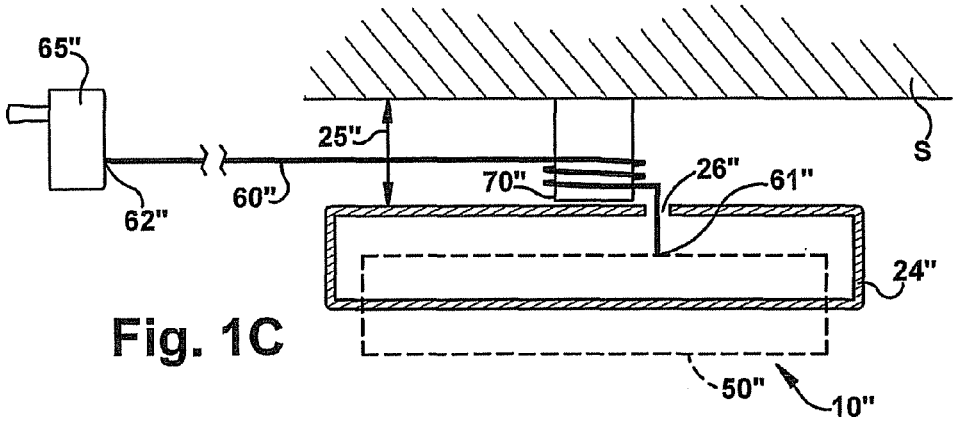
FIG. 1C is a side cross-sectional schematic view of yet another exemplary lighting assembly.

Other configurations may be utilized to allow a portion of an electrical wire to be twisted about a hub within a housing of a lighting unit, such that a user selected amount of the electrical wire may extend outward from the housing. For example, as illustrated in FIG. 1B, a lighting unit 10' includes a housing 20' having a mounting portion or base portion 22' (for example, for mounting to a surface S) and an outer portion 24' configured to carry or be assembled with a light source 50'. The base portion 22' and outer portion 24' may be spaced apart by and/or connected by a hub 70', such that a gap 25' extending around an outer perimeter of the housing 20' is defined. The hub 70' may (but need not) be integral with one or both of the base portion 22' and the outer portion 24'. While this gap 25' may be defined entirely by the base and outer portions 22', 24' of the housing 20' as shown in FIG. 1B, in another embodiment, shown in FIG. 1C, a gap 25" is partially defined by the surface S to which the lighting unit 10" is mounted.

Referring again to FIG. 1B, an electrical wire 60' electrically connected with the light source 50' at a first end 61' may extend through an opening 26' in the outer portion 24', such that the wire 60' may be twisted about the hub 70' to adjust the amount of wire retained within the outer perimeter of the housing 20'. A user may unwind or withdraw a desired portion of the wire 60' from the hub 70' through the gap 25', for example, to electrically connect the lighting unit 10' with an external power source, using, for example, an electrical connector or plug 65' connected to the second end 62' of the electrical wire 60'. Alternatively, a user may wind or wrap the wire 60' around the hub 70' and through the gap 25' until a desired amount of the wire 60' remains extended from the housing 20'.

Many different types of lighting assemblies may utilize the above inventive features. In one embodiment, a lighting unit includes one or more LEDs directly or indirectly carried by a circuit board disposed within the housing of the lighting unit. The lighting unit may further include a substrate to which the circuit board may be directly or indirectly thermally coupled, the substrate functioning as a heat sink to assist in dissipating heat generated by the LEDs, to prolong service life of the LEDs. A heat sink generally includes a component constructed of a thermally conductive material and thermally coupled to the LEDs to absorb heat generated by the LEDs. In one embodiment, a heat sink may be provided with one or more fins, prongs, tabs, flanges, or other projections configured to draw generated heat further away from the LED. These projections may be configured to extend through the housing, such that they are exposed to the external environment for further heat dissipation.

Figure 4:
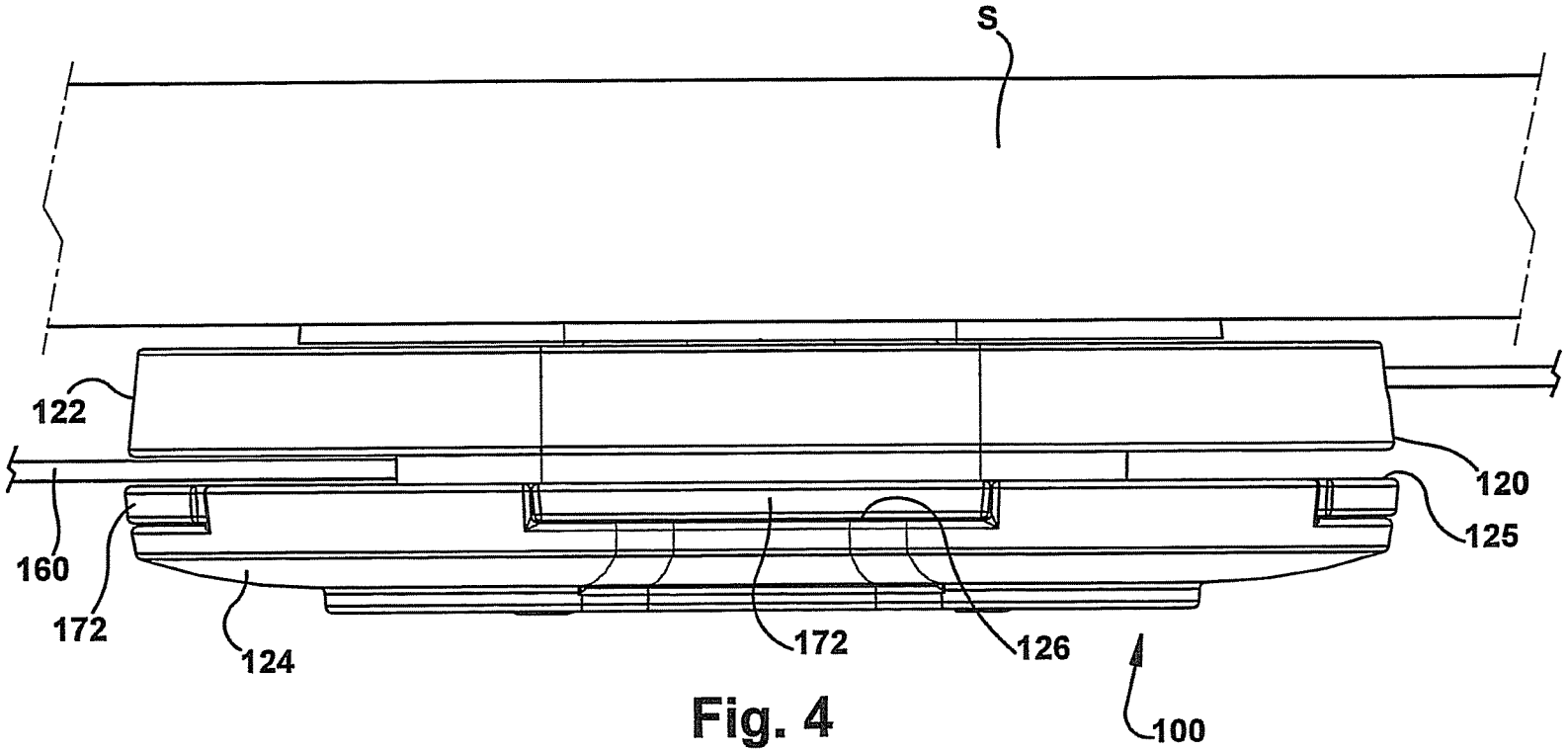
FIG. 4 is a side view of the lighting assembly of FIG. 2.
Figure 5A:
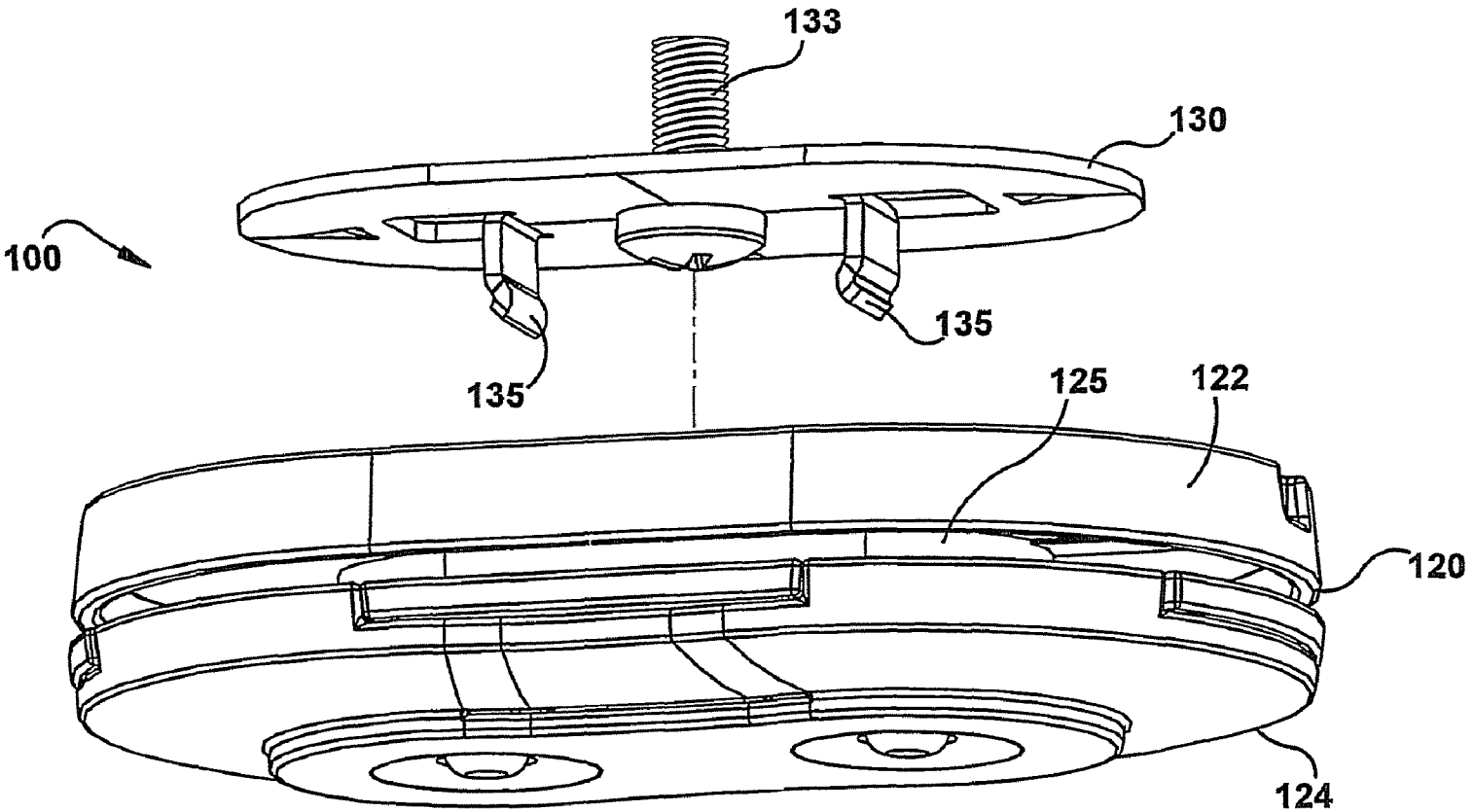
FIG. 5A is a partially exploded perspective view of the lighting assembly of FIG. 2, shown without the electrical wire, showing the mounting plate disassembled from the lighting assembly.
Figure 5B:
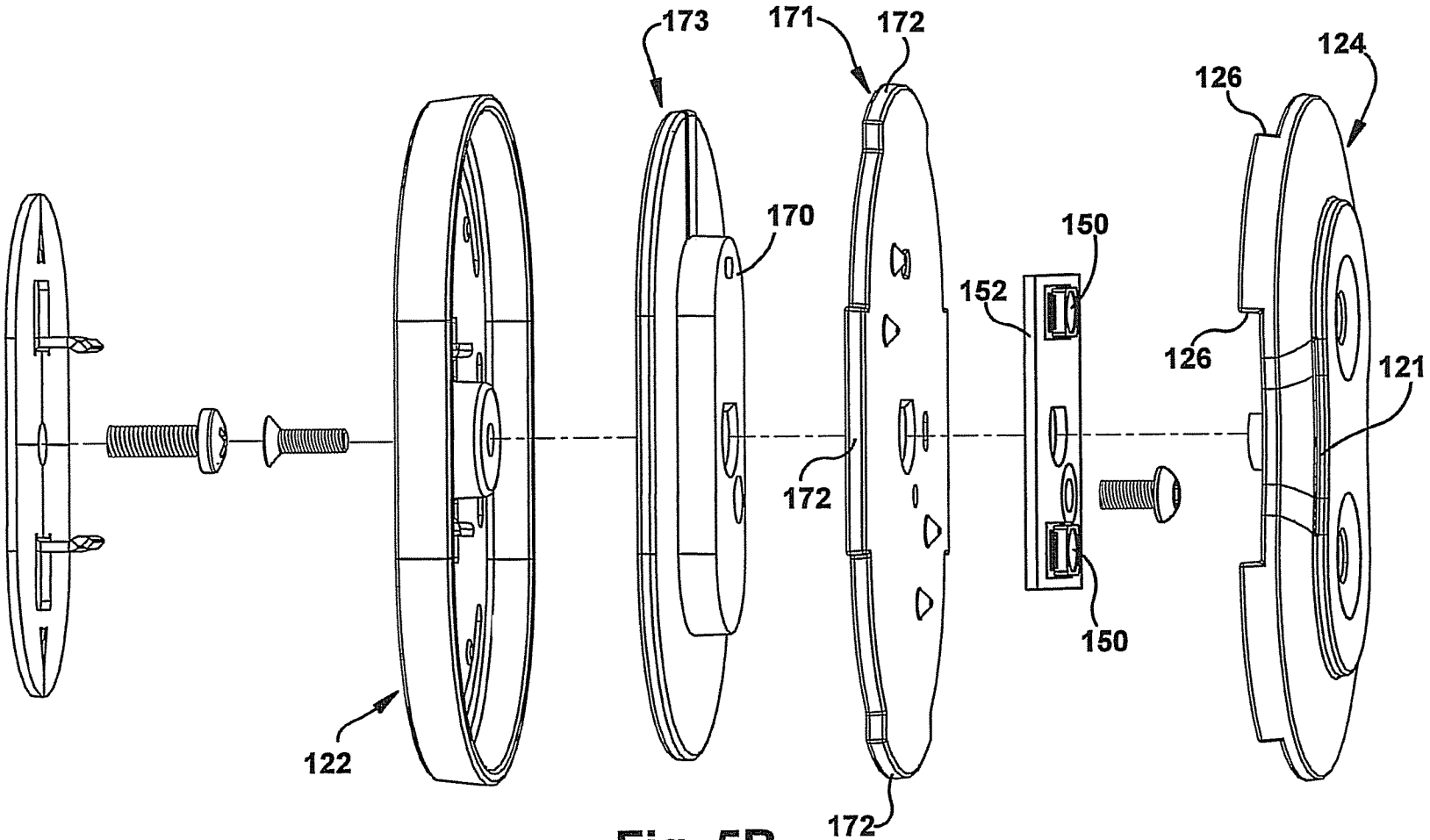
FIG. 5B is an exploded perspective view of the lighting assembly of FIG. 2, shown without the electrical wire.
Figure 5C:
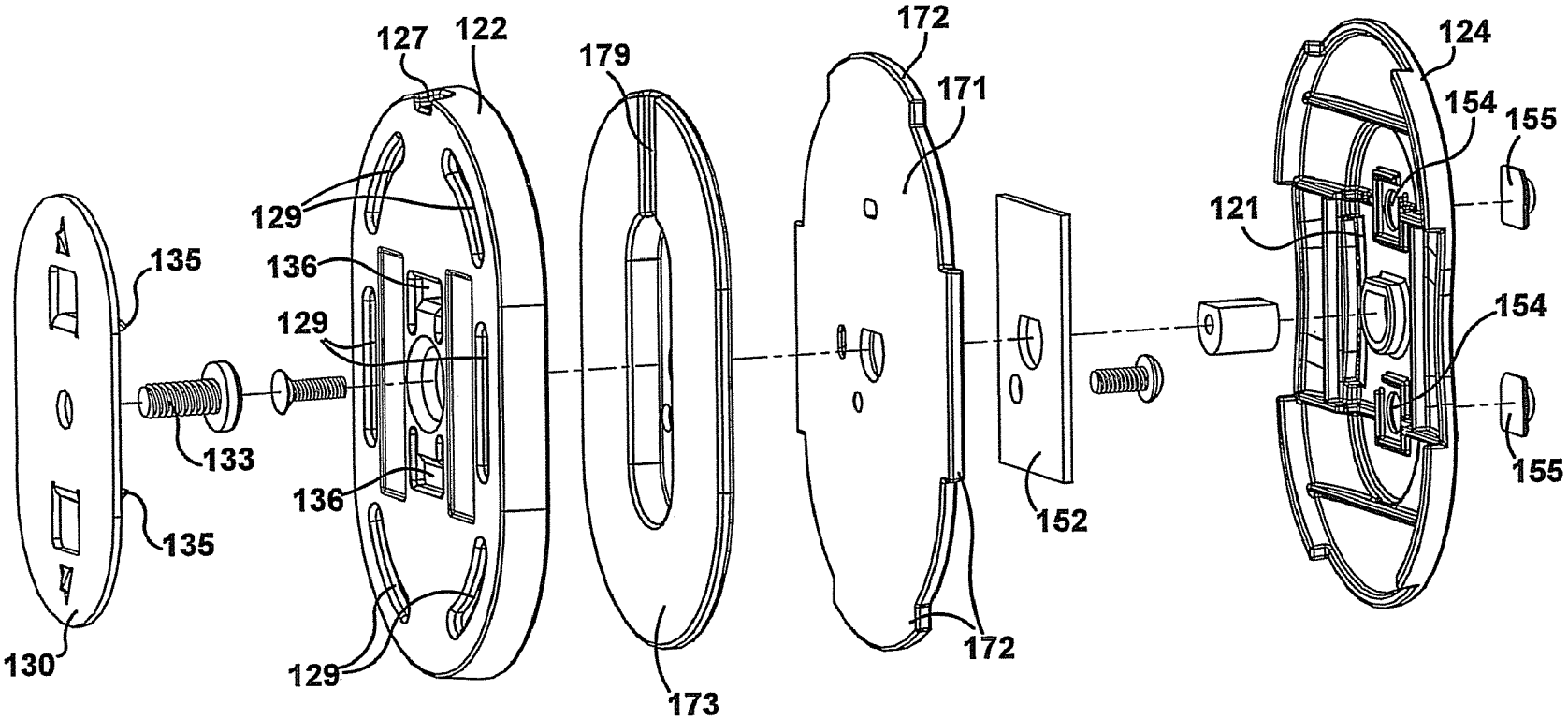
FIG. 5C is another exploded perspective view of the lighting assembly of FIG. 2, shown without the electrical wire.
Figure 6A:
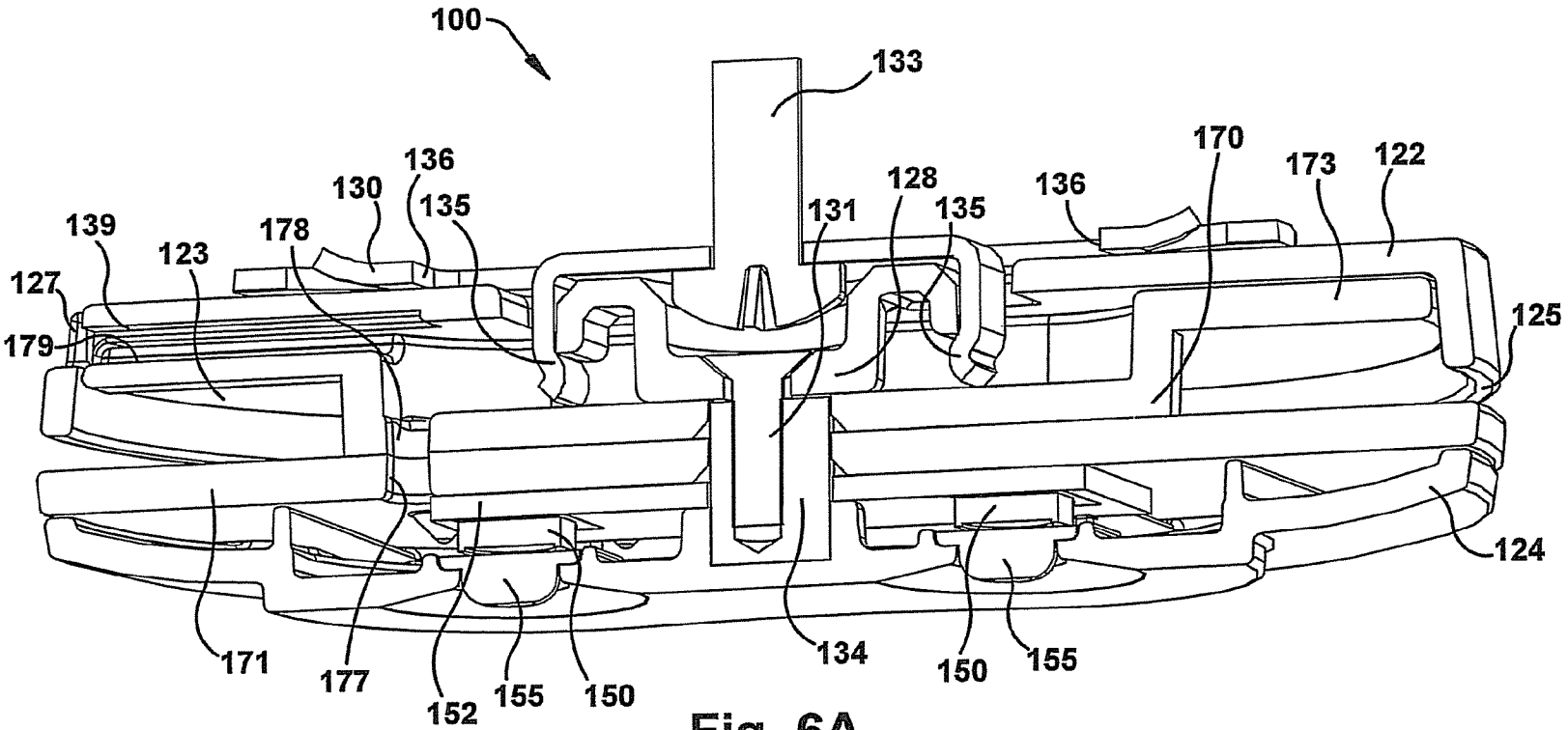
FIG. 6A is a cross-sectional perspective view of the lighting assembly of FIG. 2, shown without the electrical wire.
Figure 6B:
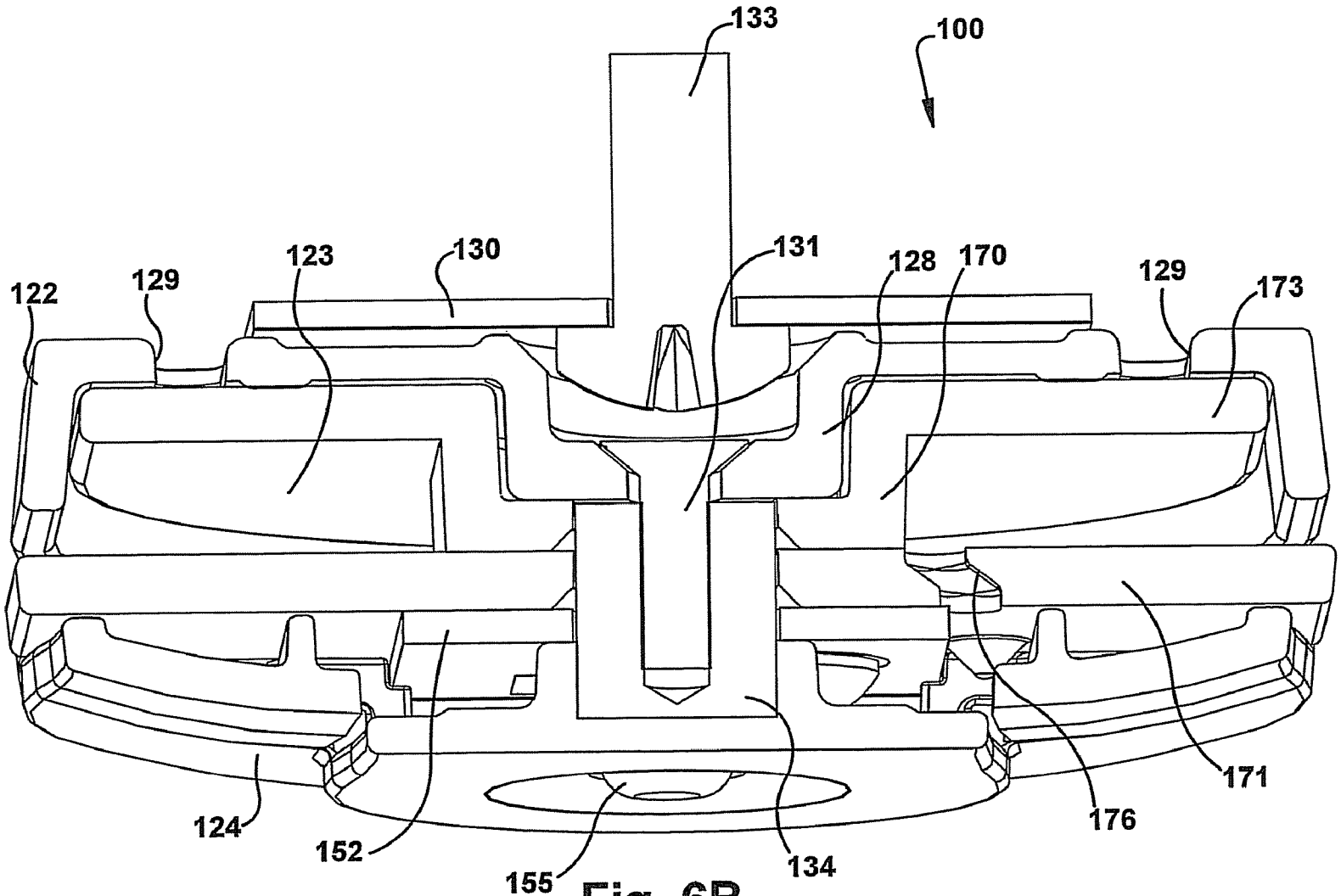
FIG. 6B is another cross-sectional perspective view of the lighting assembly of FIG. 2, shown without the electrical wire.
Figure 7:
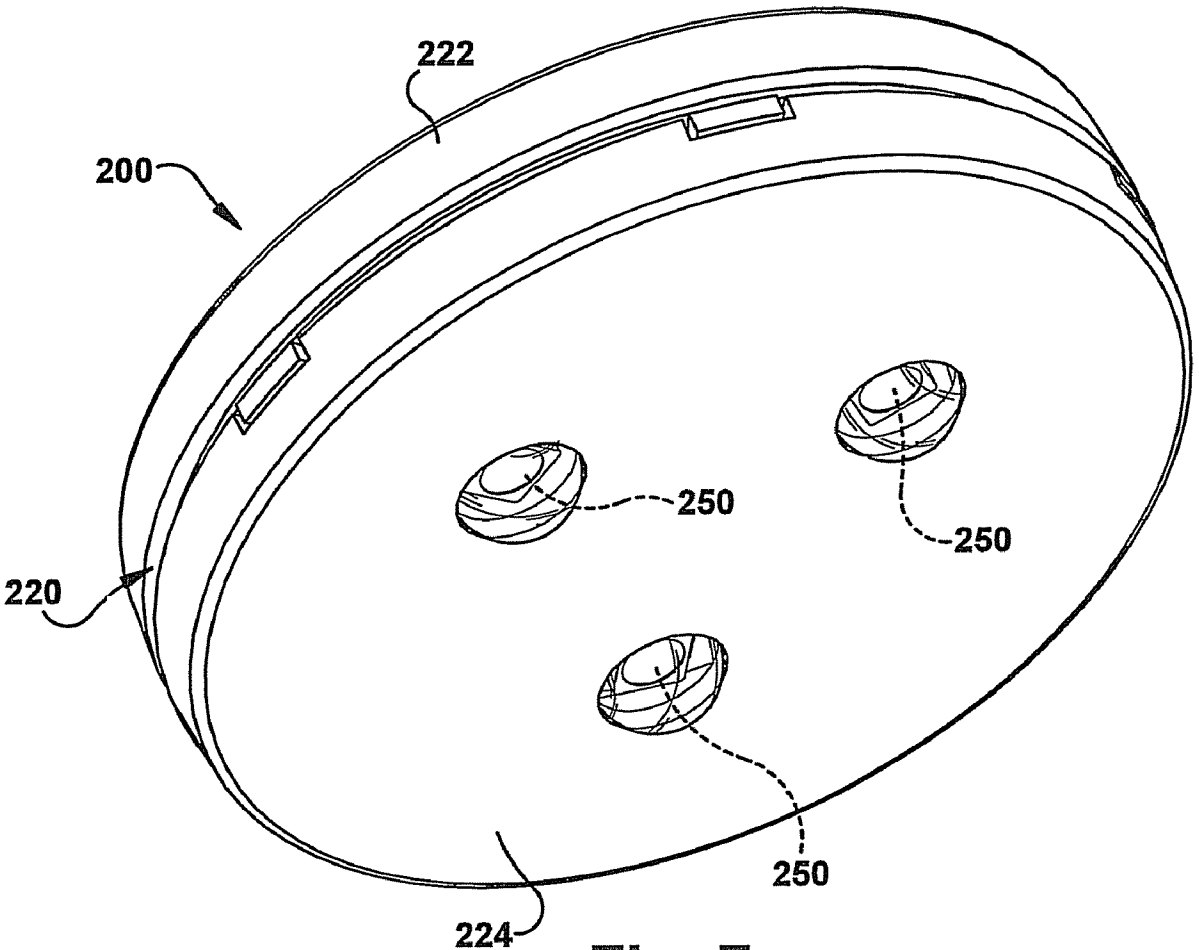
FIG. 7 is a side perspective view of yet another exemplary LED lighting assembly.

FIGS. 2-6B illustrate an exemplary lighting unit 100 having a substantially oval or elliptical disc-shaped housing 120 formed from a base member 122 and a cover member 124, which define an internal cavity 123 (see FIGS. 6A and 6B). A light source includes two LEDs 150, although any number of LEDs may be utilized. A light transmitting portion of the cover member 124 may include light transmitting members 155 (see FIG. 5C) assembled in openings 154 in the cover member 124. As described herein, light transmitting members for lighting products may serve one or more of many different functions, including, for example, protection of the light source from dirt, moisture, or impact, prevention of exposure of foreign objects to the (often high temperature) light source, improvement of aesthetic appearance of the lighting product, and alteration of the generated light, such as by filtering, directing, partial blocking, or changing color. The exemplary light-transmitting members 155 are provided in a transparent or translucent material, such that light generated by the LEDs 150 is emitted through the light-transmitting members 155 to provide illumination from the lighting unit 100. The light-transmitting members 155 may be provided from many different materials, such as, for example, glass and plastic.

In the illustrated embodiment, an electrical wire 160 extends from a gap 125 between the base member 122 and the cover member 124 of the housing 120 for connecting the lighting unit 100 with another lighting unit or with a power supply (not shown), such as a voltage adapter, or LED driver, or wiring (e.g., building wiring), or another lighting unit. A second electrical wire 167 extends from an opening 127 (see FIG. 3) in the base member 122 (but may alternatively extend from other portions of the housing 120) for connecting the lighting unit 100 with another lighting unit or with a power supply (not shown).

Referring now to the exploded perspective view of FIG. 5B, the LEDs 150 are mounted to or carried by a circuit board 152 for communicating electricity to each LED 150 (however, other electrical wiring arrangements may be utilized). The circuit board 152 is thermally coupled to a heat sink substrate 171, which, while shown as plate-shaped, may be of any suitable shape. The substrate 171 may be constructed from a thermally conductive material to facilitate dissipation of heat generated by the circuit board 152 and LEDs 150. To further dissipate this generation of heat, the substrate 171 may include radially extending tabs or other such protrusions 172 which extend through corresponding openings 126 in the housing 120 to expose surfaces of the substrate 171 to the external environment. Additional components and configurations may also be utilized to further dissipate heat generated by the LEDs. For example, a thermally conductive hub 170 may be thermally coupled to the substrate 171, and a thermally conductive end flange 173 may extend radially from the opposite end of the hub 170 to draw heat even further from the LEDs 150. Additionally or alternatively, one or more vents 121, 129 (see FIG. 5C) may be provided in the base and cover members 122, 124 to allow heat to dissipate into the environment.

Referring now to the cross-sectional views of FIGS. 6A and 6B, the integral hub 170 and end flange 173 may be joined with the substrate 171 (for example, by the fastener 131 and insert 134, assembled through aligned openings in the hub/end flange 170/173, substrate 171, and circuit board 152). As such, the hub 170, end flange 173, and substrate 171 may form a spool member configured to retain a wound portion of the electrical wire (not shown, but see, for example, the alternate embodiment of FIG. 8) connecting the circuit board 152 (and LEDs 150) with a power supply (not shown). The electrical wire may extend from the edge of the circuit board 152 through a cutout 176 in the substrate 171 (see FIG. 6B). While the cutout 176 may be provided in any shape or orientation, in the illustrated embodiment, the cutout is angled or S-shaped to position the portion of electrical wire 160 extending through the substrate 171 to be proximate to the outer surface of the hub 170, to facilitate winding of the electrical wire 160 around the hub 170. Further, an end portion of the electrical wire 160 may be pinched between the circuit board 152 and the substrate 171 to provide a strain relief in the event that excessive pulling forces are applied to the electrical wire 160 by the user.

The second electrical wire 167 (FIG. 3) may extend from an end of the circuit board 152 through aligned openings 177, 178 in the substrate 171 and hub 170/end flange 173, along a channel formed by aligned grooves 179, 139 in the upper surface of the end flange 173 and the lower surface of the base member 122, and through an opening 127 in the base member 122 (see FIG. 6A). A strain relief may be provided for the portion of the second electrical wire 167 inward of the opening 127 by providing a slight interference fit between the wire 167 and the aligned grooves 179, 139.

To allow for winding and unwinding of the electrical wire within the internal cavity of the lighting unit housing, a gap between a base member and a cover member of the lighting unit housing may extend around an entire outer perimeter of the housing. In the illustrated embodiment of FIGS. 2-6B, the base member 122 and cover member 124 are assembled to each other such that the gap 125 extends around the entire outer periphery of the housing 120. While many different configurations may be utilized to provide this peripheral gap 125, in the illustrated embodiment, a boss portion 128 of the base member 122 and an insert 134 assembled with the cover member 124 provide for sufficient space between the base and cover members 122, 124 to define both the internal cavity 123 and the peripheral gap 125. While many different assembly methods may be utilized, in the illustrated embodiment, the hollow boss portion 128 is assembled to the insert 134 using a fastener, such as a machine screw 131. In one example, the wire 160 may be all or mostly or partially wound around the hub 170 and retained in the housing when the assembly is shipped, and a user unwinds from the housing a length of wire 160 needed for the installation. As another example, the wire 160 may be all or mostly or partially outside the housing when the assembly is shipped, and a user winds around the hub 170 in the housing a length of wire not needed for the installation.

A lighting assembly incorporating one or more of the inventive features of the present application may be mounted, secured, or otherwise positioned at a desired location using many different configurations. In one embodiment, a lighting assembly includes a mounting member configured to facilitate mounting to, and removal from, a desired surface, such as a ceiling or a cabinet base. In the embodiment of FIGS. 2-6B, a mounting plate 130 may be fastened to a surface S (FIG. 4), for example, using a wood screw 133. The mounting plate may include flexible tabs 135 (FIGS. 5B and 6A) that snap into corresponding openings 136 in the base member 122 to secure the lighting unit 100 to the surface S.

Many different materials and construction methods may be utilized for the various components of the exemplary lighting assemblies described in the present application, including, for example, various metal and plastic materials. In an exemplary embodiment, a lighting assembly consistent with the lighting unit 100 of FIGS. 2-6B includes, for example, a base member 122 and cover member 124 manufactured from polycarbonate, a substrate 171 and hub 170/end flange 173 manufactured from aluminum, an insert 134 manufactured from aluminum, and light transmitting members 155 manufactured from polycarbonate.

FIGS. 7-9B illustrate another exemplary embodiment of a lighting unit 200 having many components similar to those of the lighting unit 100 of FIGS. 2-6B. The lighting unit 200 includes three LEDs 250 centered on a cylindrical or circular disc-shaped housing 220 formed from a base member 222 and a cover member 224. The exemplary lighting unit includes a circuit board 252, substrate 271, hub 270 and flange 273 similar to those of the lighting unit 100 of FIGS. 2-6B, arranged to provide a similar internal cavity 223 and peripheral gap 225. An electrical wire 260 is configured to extend from the gap 225 between the base member 222 and the cover member 224 of the housing 220 for connecting the lighting unit 200 with a power supply or another lighting unit (not shown).

According to another inventive aspect of the present application, a lighting assembly configured to retain a wound portion of electrical wire may be further configured to prevent unraveling or unwinding of the wound portion of electrical wire until a user is prepared to withdraw a desired amount of this wound portion, for example, during installation of the lighting assembly. This may, for example, prevent tangling of unraveled electrical wires, and help maintain an uninstalled lighting assembly as a compact unit to facilitate storage, transportation, and use. Many different configurations may be utilized to retain a wound portion of electrical wire in an internal cavity of a lighting assembly. Examples include clamps or fasteners assembled with the housing, internal walls (e.g., flexible walls) or prongs that squeeze against (or otherwise resist winding or unwinding of) the wire, removable or adjustable sleeves or covers that may be positioned over an opening from which the electrical wire is withdrawn, or a spring-loaded or user-rotatable (for example, by an attached knob) spool that inhibits the electrical wire from slipping out of an associated opening. In one embodiment, a gap around an outer circumference of a lighting assembly housing is sized to provide a slight interference fit with the electrical wire. When a pulling force is applied (in an unwinding direction) to the electrical wire, compression of the electrical wire and/or flexing of the lighting assembly housing permits withdrawal of a desired amount of the wound portion of the electrical wire. Similar pulling forces in a winding direction permit a desired amount of electrical wire outside the housing to be wound within the internal cavity of the lighting assembly housing. In one example, the wire may be all or mostly or partially wound around the hub and retained in the housing when the assembly is shipped, and a user unwinds from the housing a length of wire needed for the installation. As another example, the wire may be all or mostly or partially outside the housing when the assembly is shipped, and a user winds around the hub in the housing a length of wire not needed for the installation.

Figure 2:
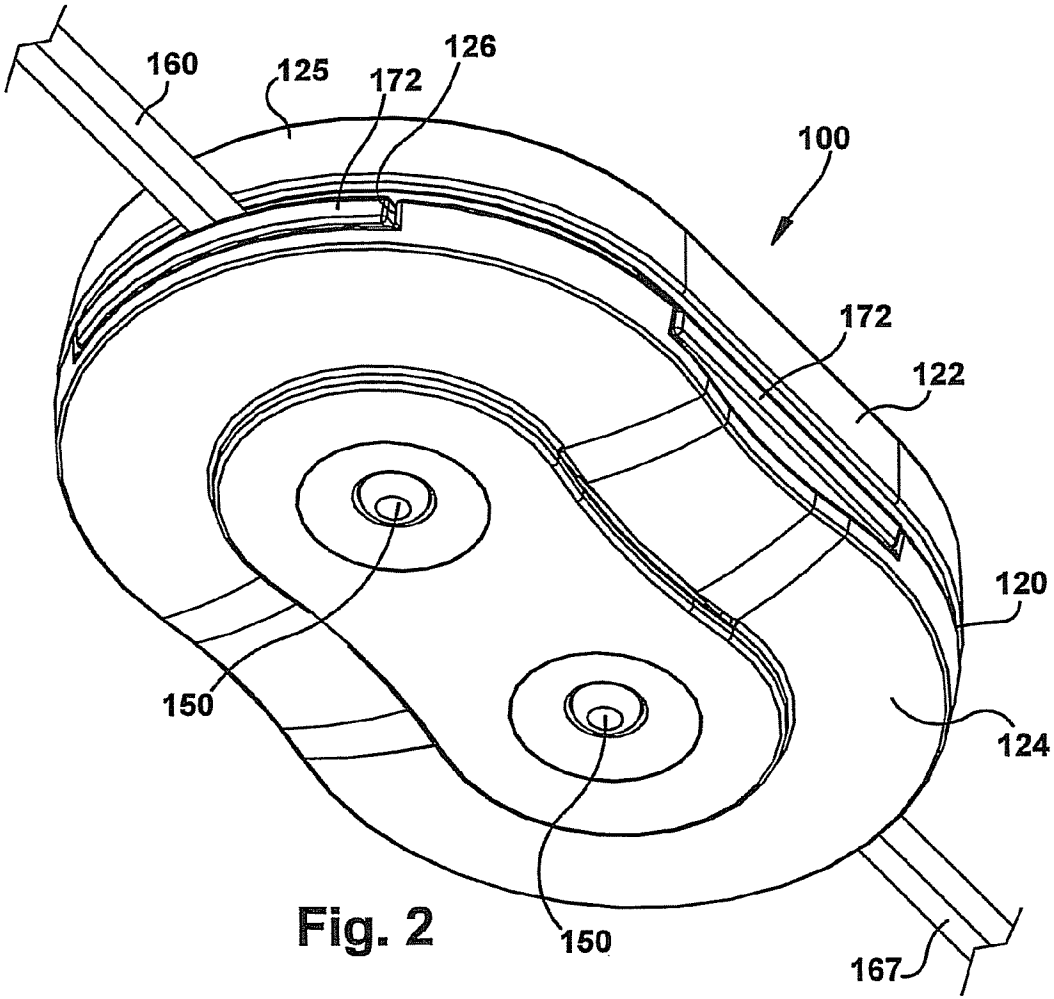
FIG. 2 is a perspective view of another exemplary LED lighting assembly.
Figure 3:
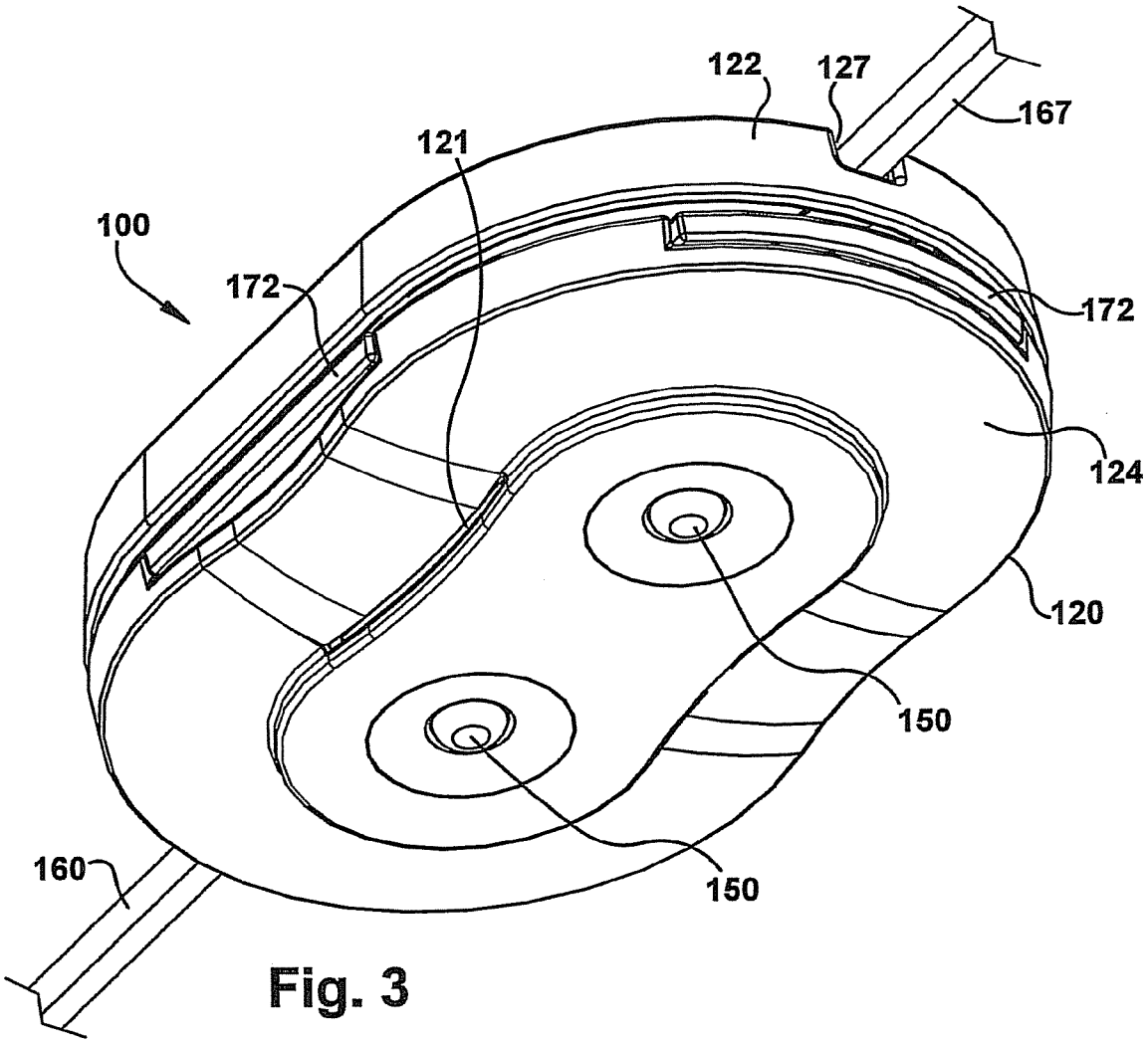
FIG. 3 is another perspective view of the lighting assembly of FIG. 2.
Figure 8:
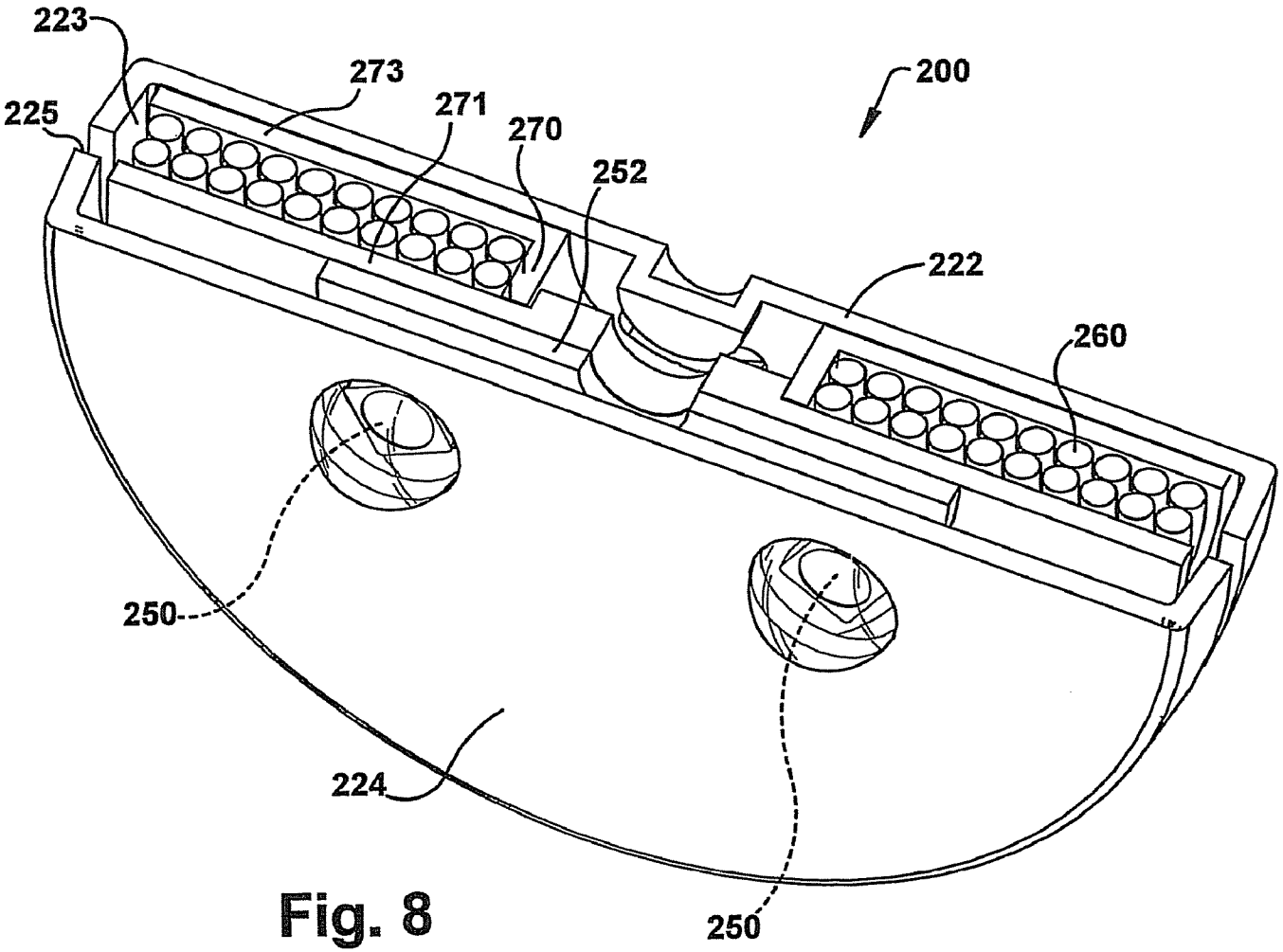
FIG. 8 is a perspective cross-sectional view of the lighting assembly of FIG. 7.
Figure 9A:
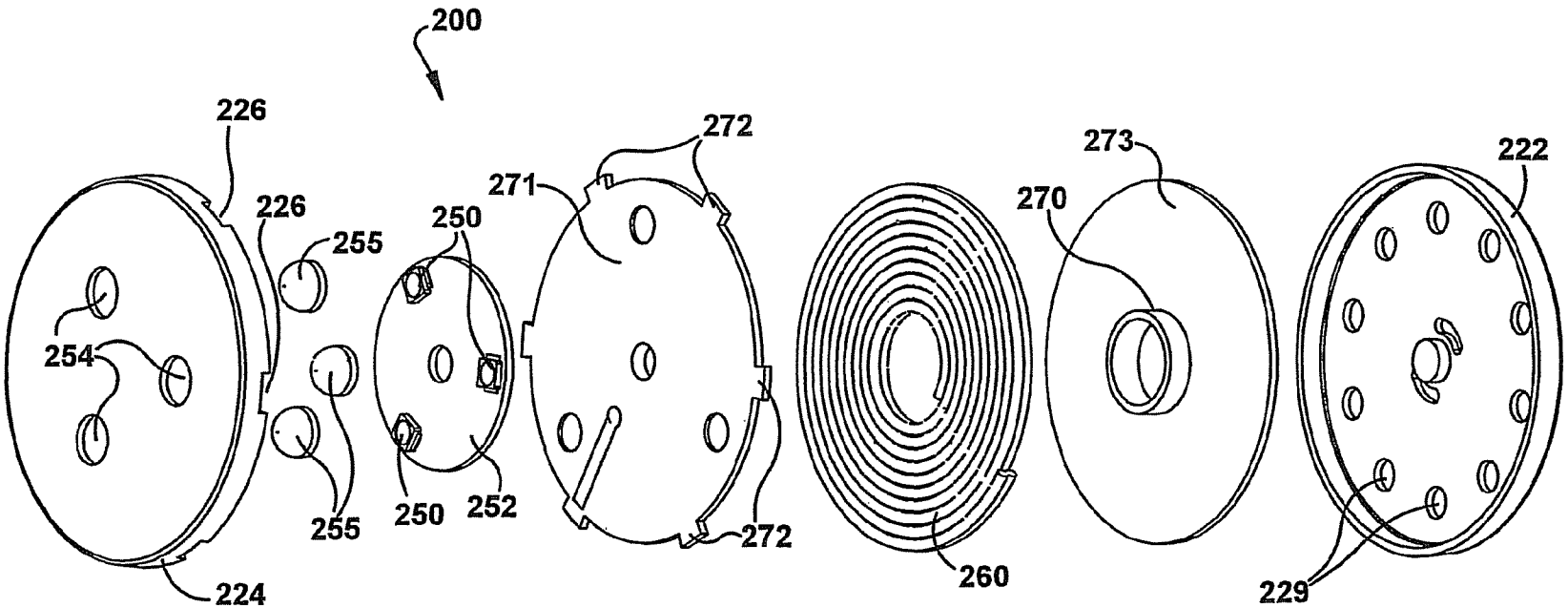
FIG. 9A is an exploded perspective view of the lighting assembly of FIG. 7.
Figure 9B:
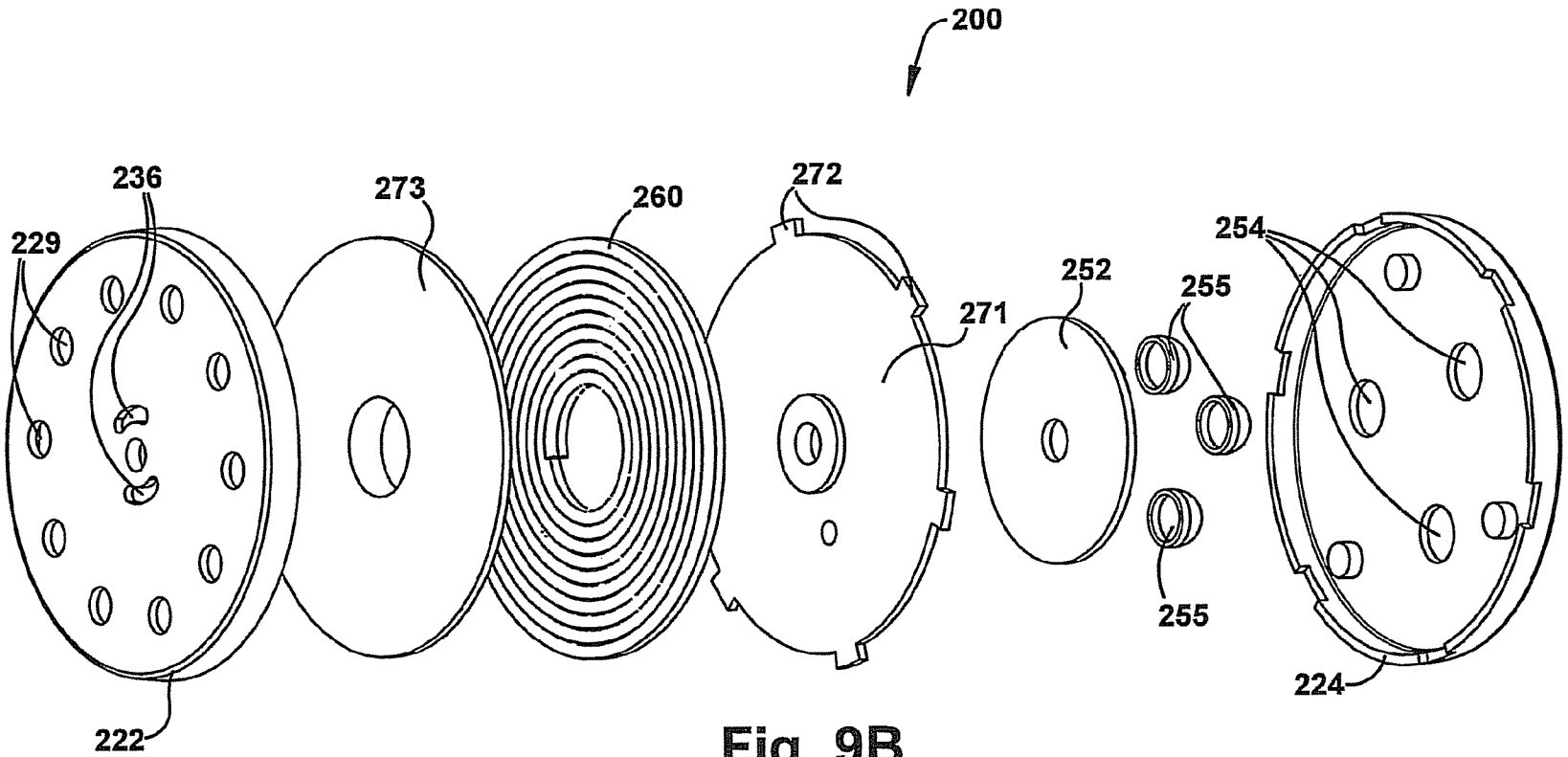
FIG. 9B is another exploded perspective view of the lighting assembly of FIG. 7.

In the illustrated embodiments of FIGS. 2-6B and 7-9B, the gaps 125, 225 are sized to be slightly smaller than a thickness of the electrical wires 160, 260, thereby providing a slight interference fit between the gaps 125, 225 and the wires 160, 260, such that, in the absence of a pulling force applied to the wires 160, 260, a wound portion of each wire is retained in the internal cavity 123, 223 of the lighting unit housing 120, 220. When a pulling force is applied to each wire 160, 260, retention forces provided by slight compression of the wire and/or flexing of the housing 120, 220 are overcome to permit the wire 160, 260 to be withdrawn from or inserted into the housing 120, 220 through the gap 125, 225. Additionally, as more clearly shown in the embodiment of FIG. 8, a lighting unit 100, 200 may (but need not) be configured such that the electrical wire 160, 260 may be wound around the hub 170, 270 in a vertical orientation (i.e., with a wide portion of the wire 160, 260 facing the hub 170, 270), for example, to conserve or minimize space within the internal cavity 123, 223. The end flange 173, 273 and substrate 171, 271 may also be axially spaced to closely receive the coiled wire 160, 260, thereby holding the wire in place. As shown in FIGS. 2, 4, and 8, the gap 125, 225 may be sized to only receive the wire 160, 260 in a horizontal orientation (i.e., with the wide portion of the wire facing the end flange 173, 273 and substrate 171, 271). The resulting ninety degree rotation (or twist) in the wire 160, 260 between the coiled portion of the wire and the outward extending portion of the wire may further assist in retaining the coiled portion within the cavity 123, 223 until user intended withdrawal.

Figure 10A:
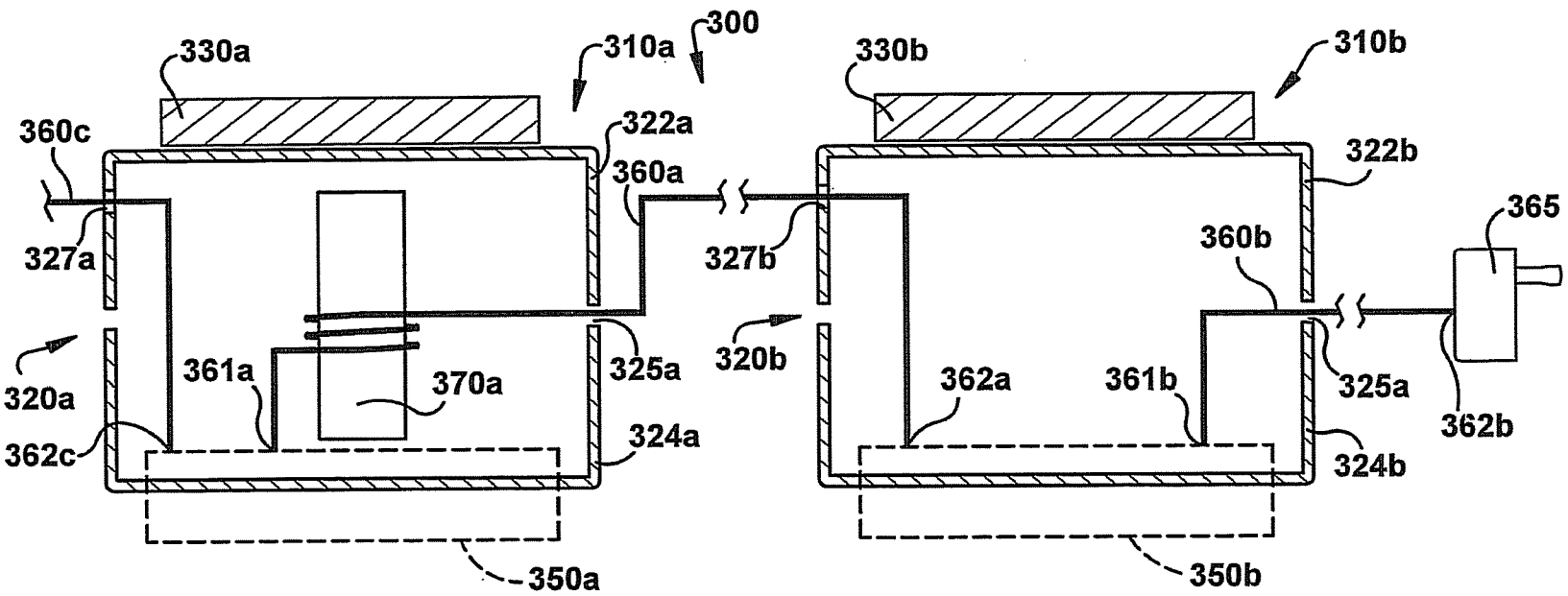
FIG. 10A is a partial side cross-sectional schematic view of an exemplary lighting system.

While lighting assemblies as contemplated herein may be utilized as a single or stand alone lighting fixture, according to another inventive aspect of the present application, such lighting assemblies may be electrically connected in series to provide a lighting system including two or more lighting assemblies. A partial cross-sectional schematic view of a lighting system 300 is illustrated in FIG. 10A. The system 300 includes at least first and second lighting assemblies 310*a*, 310*b*. The first lighting assemblies 310*a* may be similar to the lighting unit 10 of FIG. 1A. To electrically connect the first and second lighting assemblies 310*a*, 310*b*, the electrical wire 360*a* of the first lighting unit may extend out of the opening or gap 325*a* in the housing 320*a* and into the second lighting unit housing 320*b* (for example, through an opening 327*b* in the base portion 322*b*) with the second end 362*a* of the electrical wire 360*a* being electrically connected with the light source 350*b*. To add another lighting unit to the system 300, an electrical wire 360*c* of a third lighting unit (not shown) may extend into the first lighting unit housing 320*a* (for example, through an opening 327*a* in the base portion 322*a*), with the end 362*c* of the electrical wire 360*c* being electrically connected with the light source 350*a* of the first lighting unit 310*a*.

To connect the lighting system 300 with an external power source, an electrical connection may be provided between one of the lighting assemblies and an external power source.

This electrical connection may include, for example, an electrical plug or other such connector disposed on the housing of one of the lighting assemblies or an electrical wire extending from one of the lighting assemblies for connection with the external power source. In one embodiment, an electrical wire may be electrically connected with the light source of one of the lighting assemblies, the electrical wire also being directly or indirectly electrically connected with an external power source, for example, by using any one or more of an electrical plug or connector, a voltage adapter, LED driver, building wiring, battery, solar cell, or another electrically powered device to which power is being supplied. In the illustrated embodiment of FIG. 10A, an electrical wire 360*b* extends through an opening 325*b* in the housing 320*b* of the second lighting unit 310*b* for connection to an external power source. As shown, a first end 361*b* of the electrical wire 360*b* is connected with the light source 350*b* and a second end 362*b* of the electrical wire 360*b* is connected with an electrical connector or plug 365. In the alternative, the second end 362*b* of the wire 360*b* may be free for connection to wiring (e.g., building wiring) or may be pre-connected to another external power source. Also, the electrical wire for supplying power may be electrically connected to another device in the lighting system 300 (such as, for example, the first lighting unit 310*a*, another lighting unit, or some other electrical device connected with the lighting assemblies).

Figure 10B:
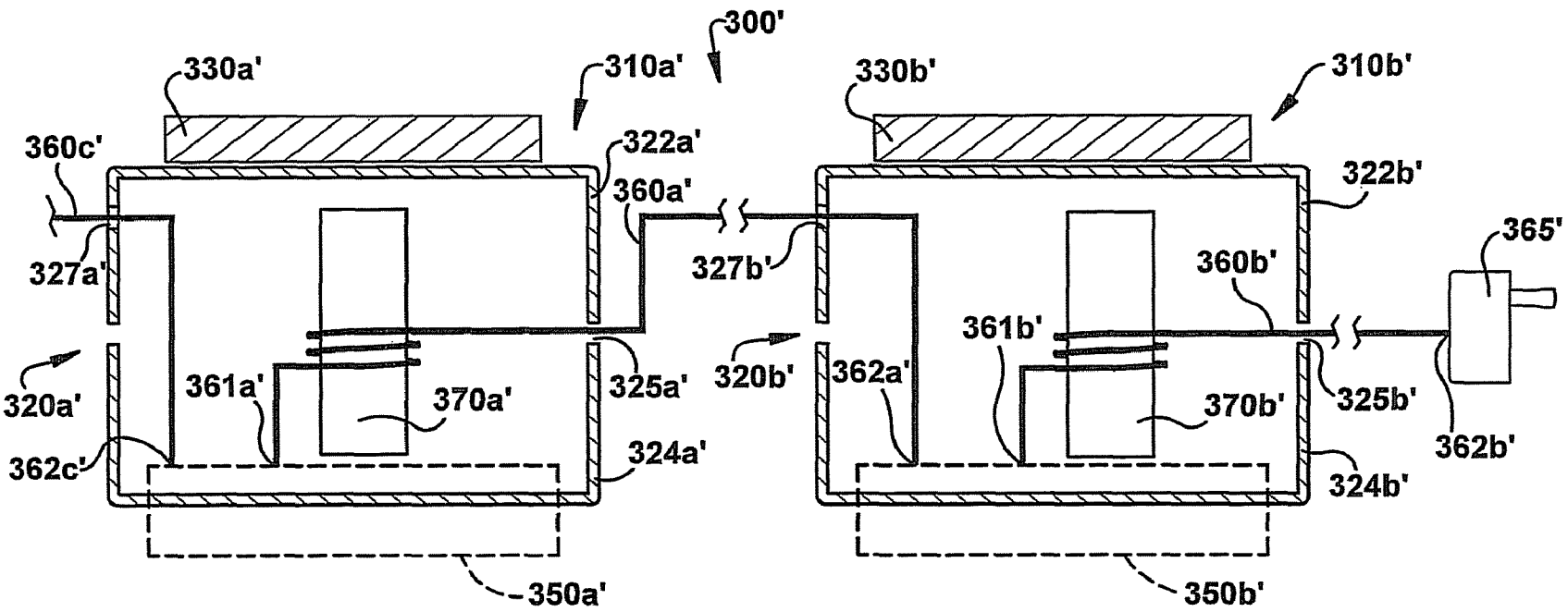
FIG. 10B is a partial side cross-sectional schematic view of another exemplary lighting system.

In another embodiment, as shown in FIG. 10B, a lighting assembly or system 300' may include a second lighting unit having a wire 360*b*' configured to be wound around a hub 370*b*' within the second housing 320*b*', with a second end 362*b*' of the wire extending out of the housing through a gap 325*b*' between a base portion 322*b*' and an outer portion 324W, the second end 362*b*' being connected with an electrical connector or plug 365', similar to the lighting unit 10 shown and described above in the embodiment of FIG. 1A. As shown, the first lighting assemble 310*a*' in the lighting system 300' may (i.e., might, but need not) be consistent with the first lighting unit 310*a* in the lighting system 300 of FIG. 10A.

Figure 11:
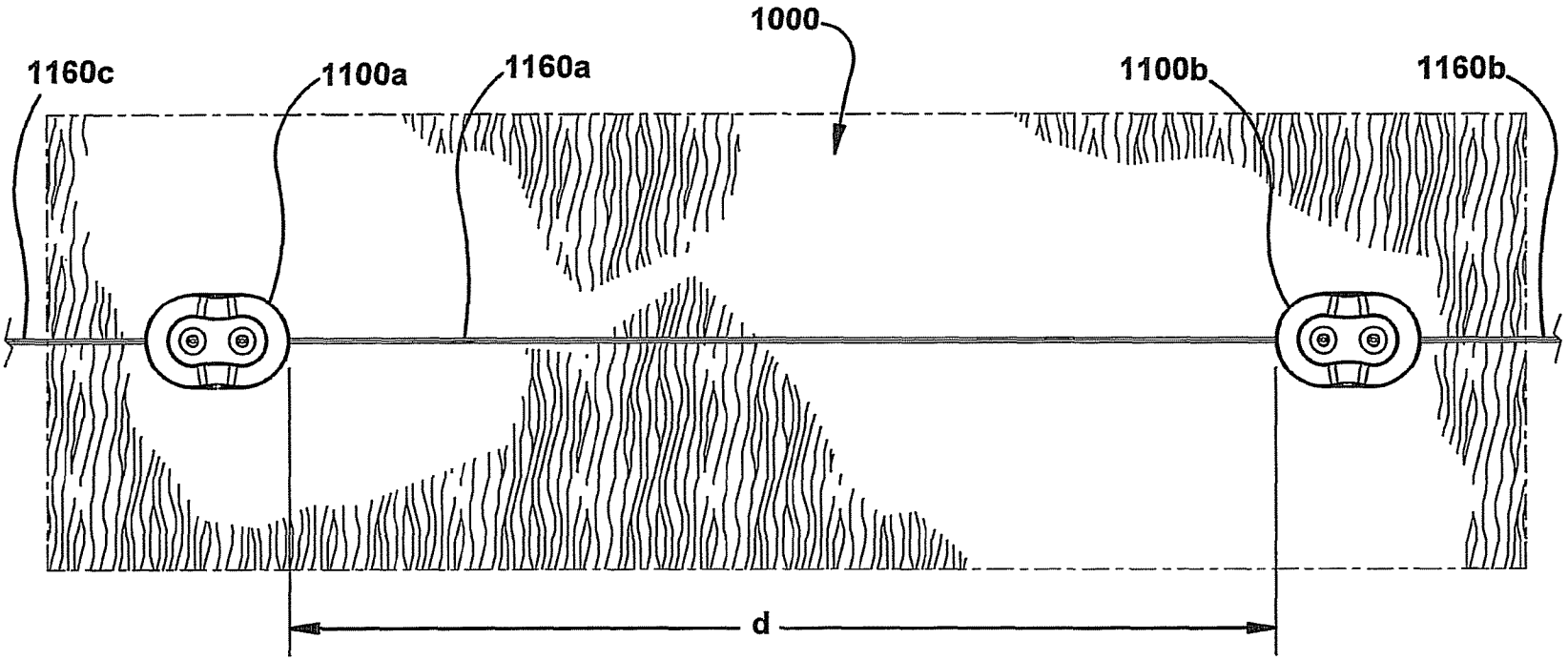
FIG. 11 is a partial front view of an exemplary lighting system including at least two lighting assemblies.

FIG. 11 illustrates a front view of a lighting system 1000 having two lighting assemblies 1100*a*, 1100*b* (consistent with the lighting unit 100 of FIGS. 2-6B) electrically connected in series by electrical wire 1160*a*, with another electrical wire 1160*b* extending from the second lighting unit 1100*b* for connecting the lighting system 1000 to a power source (not shown), and still another electrical wire 1160*c* extending from the first lighting unit 1100*a* to connect to another electrical device, such as, for example, a third lighting unit (not shown). By retaining a portion of electrical wire 1160*a* in an internal cavity of one of the lighting assemblies 1100*a*, 1100*b*, the amount of exposed electrical wire 1160*a* between the lighting assemblies may be reduced. In an exemplary application, a user may choose a distance d between the lighting assemblies 1100*a*, 1100*b* that minimizes the amount of excess (or "loose") electrical wire 1160*a*, by having the exposed portion of the electrical wire 1160*a* pulled tight. In another exemplary application, a user may rotate or orient one or both of the lighting assemblies 1100*a*, 1100*b* to tighten the exposed portion of the electrical wire 1160*a*, to minimize the amount of excess or loose electrical wire.

Figure 12A:
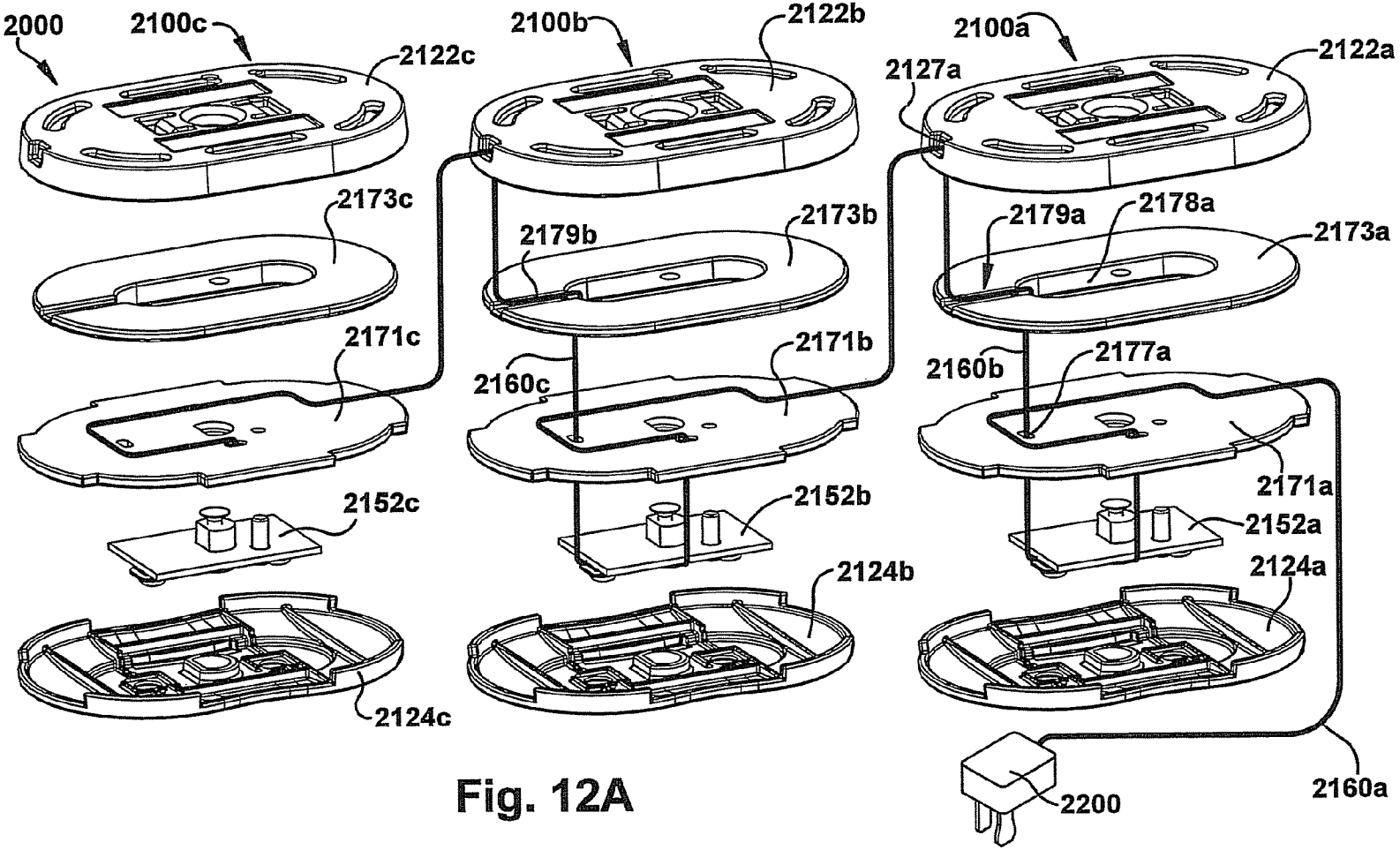
FIG. 12A is an exploded perspective view of an exemplary lighting system including three lighting assemblies.
Figure 12B:
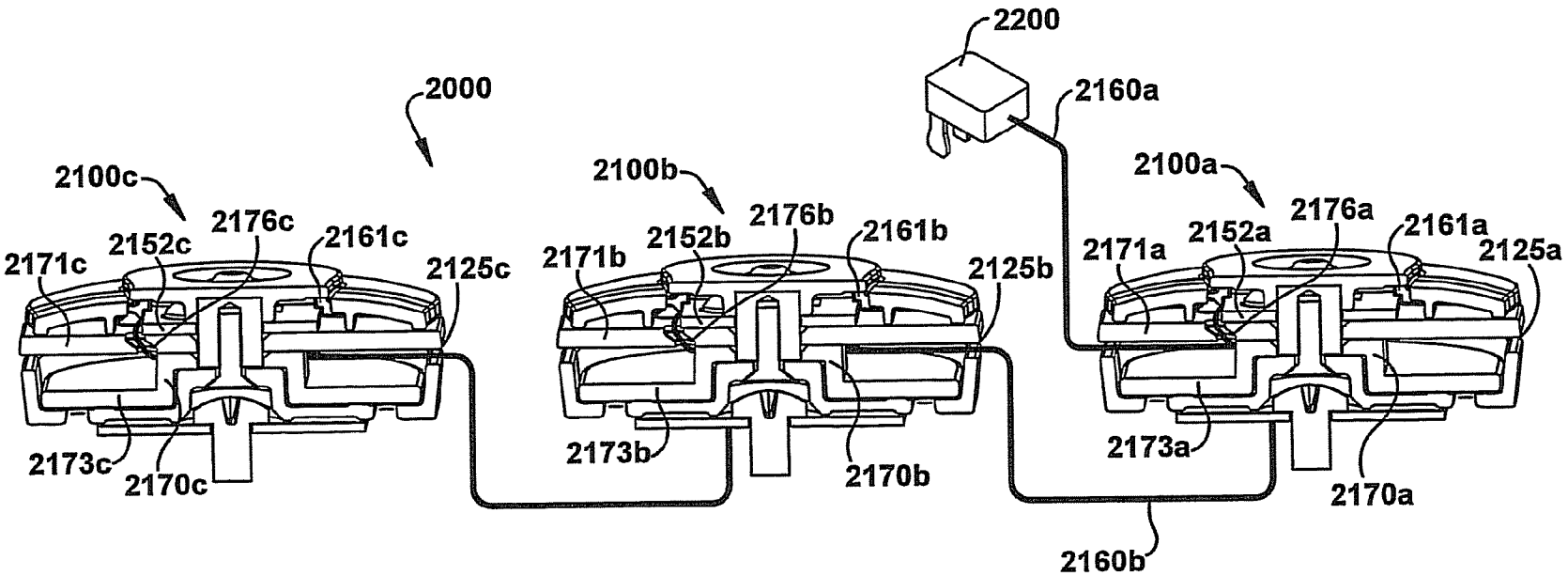
FIG. 12B is a cross-sectional view of the exemplary lighting system of FIG. 12A.
Figure 12C:
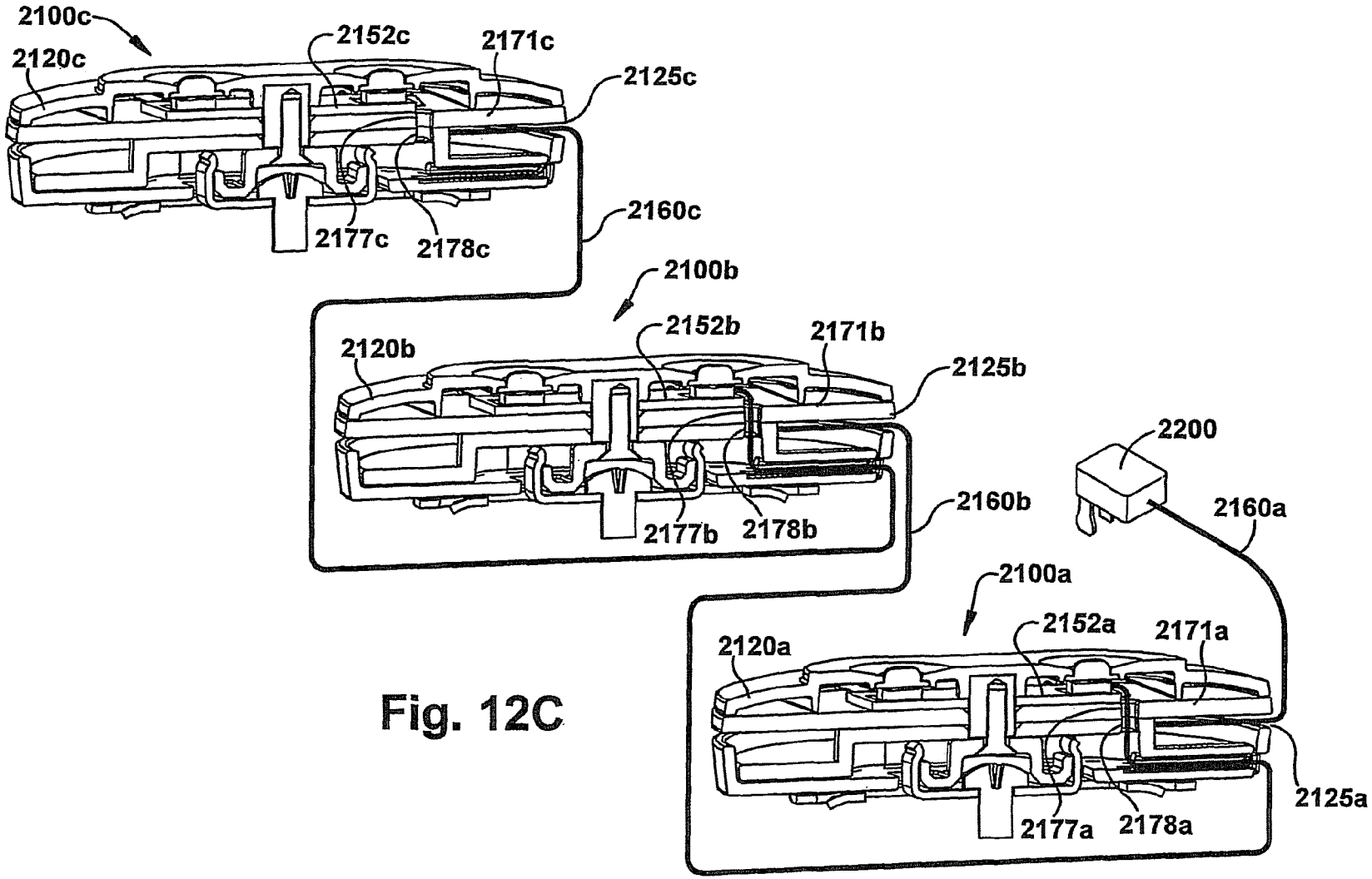
FIG. 12C is another cross-sectional view of the exemplary lighting system of FIG. 12A.

Many different wiring arrangements may be utilized to connect a plurality of lighting assemblies having inventive features of the present application. FIGS. 12A, 12B, and 12C illustrate a lighting system 2000 including first, second, and third lighting assemblies 2100*a*, 2100*b*, 2100*c*. Other quantities of lighting assemblies (e.g., two, or four or more) may also be used to form the lighting system. A driver (with electrical plug) 2200 is electrically connected with electrical wire 2160*a*, which extends through a gap 2125*a* in the housing 2120*a* of the first lighting unit 2100*a* and is wound around hub 2170*a*. An end 2161*a* of the electrical wire 2160*a* extends through an angled or S-shaped cutout 2176*a* in substrate 2171*a* and is electrically connected to a circuit board 2152*a*. A second electrical wire 2160*b* is electrically connected to the circuit board 2152*a* of the first lighting unit 2100*a* and extends through aligned openings 2177*a*, 2178*a* in the substrate 2171*a* and hub/end flange 2170*a*/2173*a* (see FIG. 12A), and along a groove or trough 2179*a* in the inner face of the end flange 2173*a* to exit through an opening 2127*a* in the base member 2122*a*. The second electrical wire 2160*b* extends through a gap 2125*b* in the housing 2120*b* of the second lighting unit 2100*b* and is wound around hub 2170*b*. An end 2161*b* of the electrical wire 2160*b* extends through an angled or S-shaped cutout 2176*b* in substrate 2171*b* and is electrically connected to a circuit board 2152*b*. A third electrical wire 2160*c* is electrically connected to the circuit board 2152*c* of the second lighting unit 2100*b* and extends through aligned openings 2177*b*, 2178*b* in the substrate 2171*b* and hub/end flange 2170*b*, and along a groove or trough 2179*b* in the inner face of the end flange 2173*b* to exit through an opening 2127*b* in the base member 2122*b*. The third electrical wire 2160*c* extends through a gap 2125*c* in the housing 2120*c* of the third lighting unit 2100*c* and is wound around hub 2170*c*. An end 2161*c* of the electrical wire 2160*c* extends through an angled or S-shaped cutout 2176*c* in substrate 2171*c* and is electrically connected to a circuit board 2152*c*. As such, the first, second, and third lighting assemblies 2100*a*, 2100*b*, 2100*c* are electrically connected with a power source when the driver 2200 is electrically connected with an outlet (not shown).

Figure 13A:
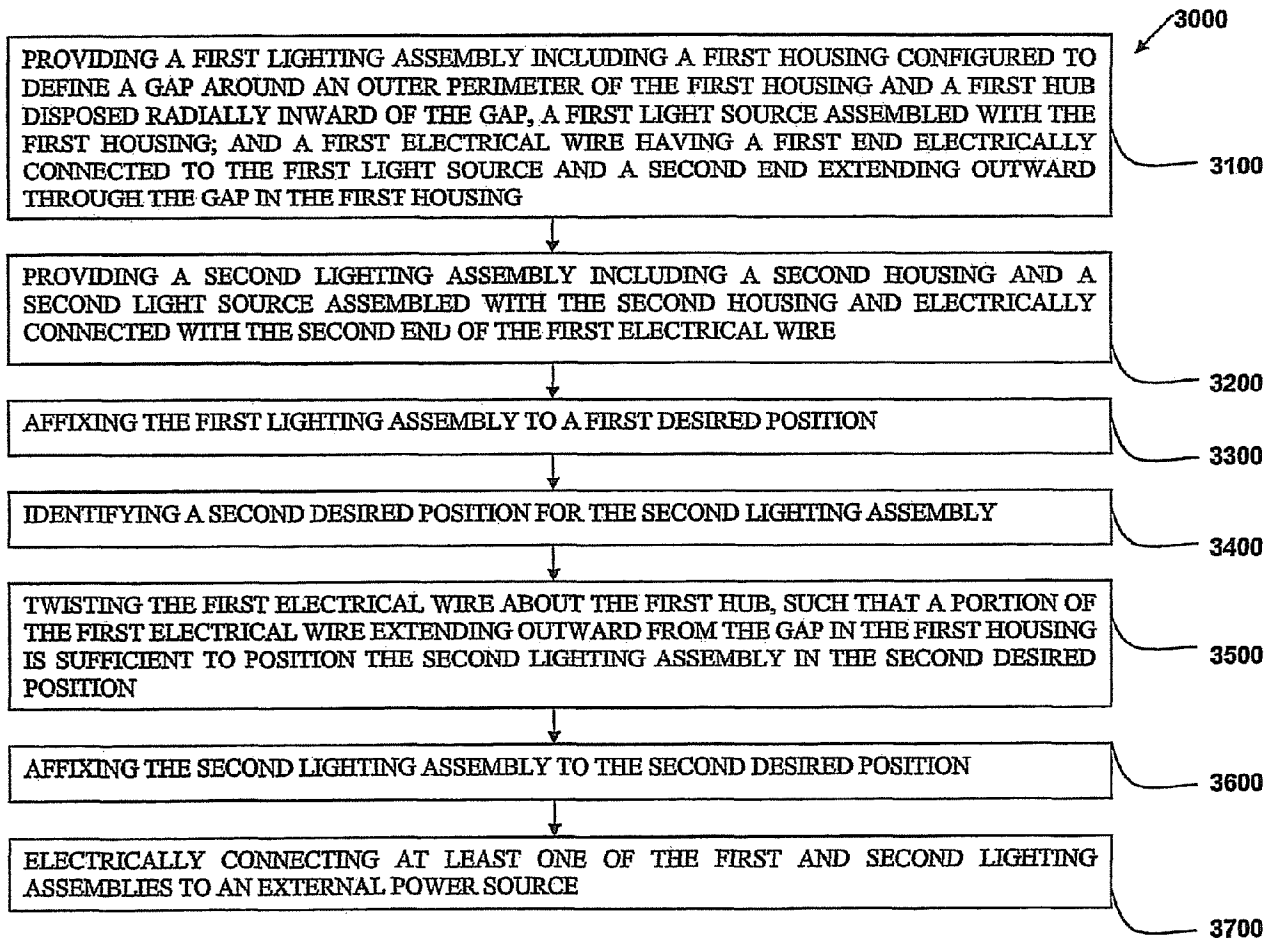
FIG. 13A illustrates an exemplary method of installing a lighting system.

In an exemplary method of installing an exemplary lighting system according to inventive aspects of the present application, as shown in FIG. 13A, a first lighting unit is provided, the first lighting unit including a first housing configured to define a gap around an outer perimeter of the first housing, with a first hub disposed radially inward of the gap; a first light source assembled with the first housing; and a first electrical wire having a first end electrically connected to the first light source and a second end extending outward through the gap in the first housing (block 3100). A second lighting unit is provided, the second lighting unit including a second housing and a second light source assembled with the second housing and electrically connected with a second end of the first electrical wire (block 3200). The first lighting unit is affixed to a first desired position (block 3300). A second desired position for the second lighting unit is identified (block 3400). The first electrical wire is twisted about the first hub, such that a portion of the first electrical wire extending outward from the gap in the housing is sufficient to position the second lighting unit in the second desired position (block 3500). For example, the first electrical wire may be unwound from (or twisted in an unwinding direction with respect to) the hub until the portion of the first electrical wire extending outward from the gap is sufficient. As another example, the first electrical wire may be wound onto (or twisted in a winding direction with respect to) the hub until the portion of the first electrical wire extending outward from the gap is sufficient. The second lighting unit is affixed to the second desired position (block 3600). At least one of the first and second lighting assemblies is electrically connected with an external power source (block 3700).

Figure 13B:
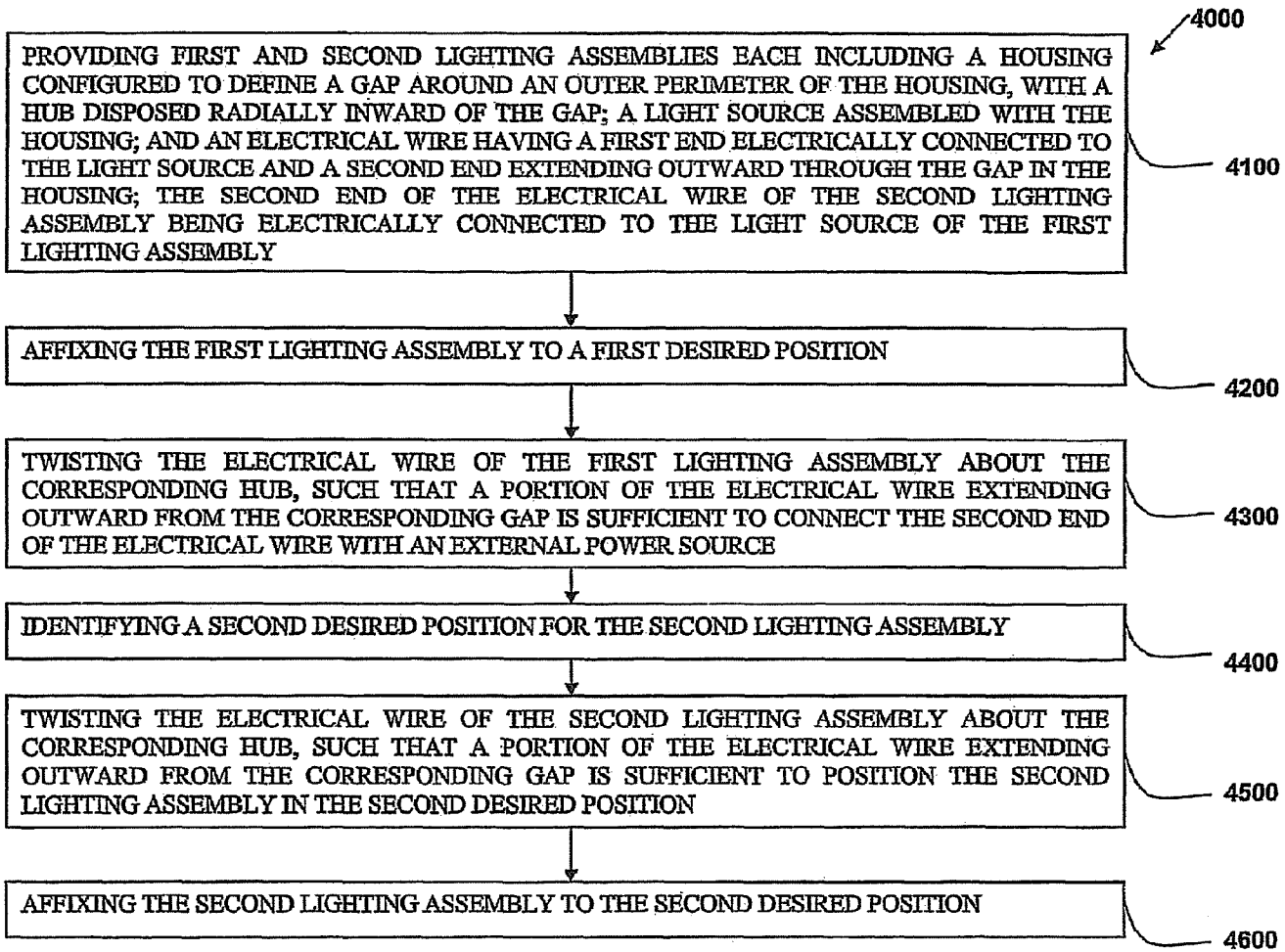
FIG. 13B illustrates another exemplary method of installing a lighting system.

In another exemplary method 4000 of installing an exemplary lighting system according to inventive aspects of the present application, as shown in FIG. 13B, first and second lighting assemblies are provided, each including a housing configured to define a gap around an outer perimeter of the housing, with a hub disposed radially inward of the gap; a light source assembled with the housing; and an electrical wire having a first end electrically connected to the light source and a second end extending outward through the gap in the housing; the second end of the electrical wire of the second lighting unit being electrically connected to the light source of the first lighting unit (block 4100). The first lighting unit is affixed to a first desired position (block 4200). The electrical wire of the first lighting unit is twisted about the corresponding hub, such that a portion of the electrical wire extending outward from the corresponding gap is sufficient to connect the second end of the electrical wire with an external power source (block 4300). For example, the electrical wire may be unwound from (or twisted in an unwinding direction with respect to) the corresponding hub until the portion of the electrical wire extending outward from the gap is sufficient. As another example, the electrical wire may be wound onto (or twisted in a winding direction with respect to) the corresponding hub until the portion of the first electrical wire extending outward from the gap is sufficient. A desired position is identified for the second lighting unit (block 4400). The electrical wire of the second lighting unit is twisted about the corresponding hub, such that a portion of the electrical wire extending outward from the corresponding gap is sufficient to position the second lighting unit in the second desired position (block 4500). For example, the electrical wire may be unwound from (or twisted in an unwinding direction with respect to) the corresponding hub until the portion of the electrical wire extending outward from the gap is sufficient. As another example, the electrical wire may be wound onto (or twisted in a winding direction with respect to) the corresponding hub until the portion of the first electrical wire extending outward from the gap is sufficient. The second lighting unit is affixed to the second desired position (block 4600).

While the above described exemplary lighting units are shown connected in series with an electrical connector or plug for direct connection to an external power source, such as, for example, a wall socket, other embodiments may be configured for connection to a lighting arrangement, which may include, for example, a junction box, dimmer module, or additional lighting assemblies. In one such system, one or more lighting units may be selectively connected and positioned to provide a desired lighting configuration. For example, the lighting units may be connected to a base module, with the individual lighting units being positionable with respect to each other and the base unit. The base unit may be connected to other modular units to form a larger modular lighting system.

As described herein, an LED lighting assembly may integrally include an LED driver circuit within the housing of the lighting unit (as shown for example, in the schematic embodiment of FIG. 18A) for connecting with an external power source. In another embodiment, a modular LED junction box may be configured for connection with a modular LED lighting system to supply the appropriate voltage to one or more remote LED lighting units connected with the junction box. The junction box may include one or more LED driver circuits for supplying a desired voltage to one or more remote LED lighting units selectively connectable to the junction box. This may allow for reduced size of the individual LED lighting units, and/or more flexibility in positioning and orienting the LED lighting units.

Figure 14A:
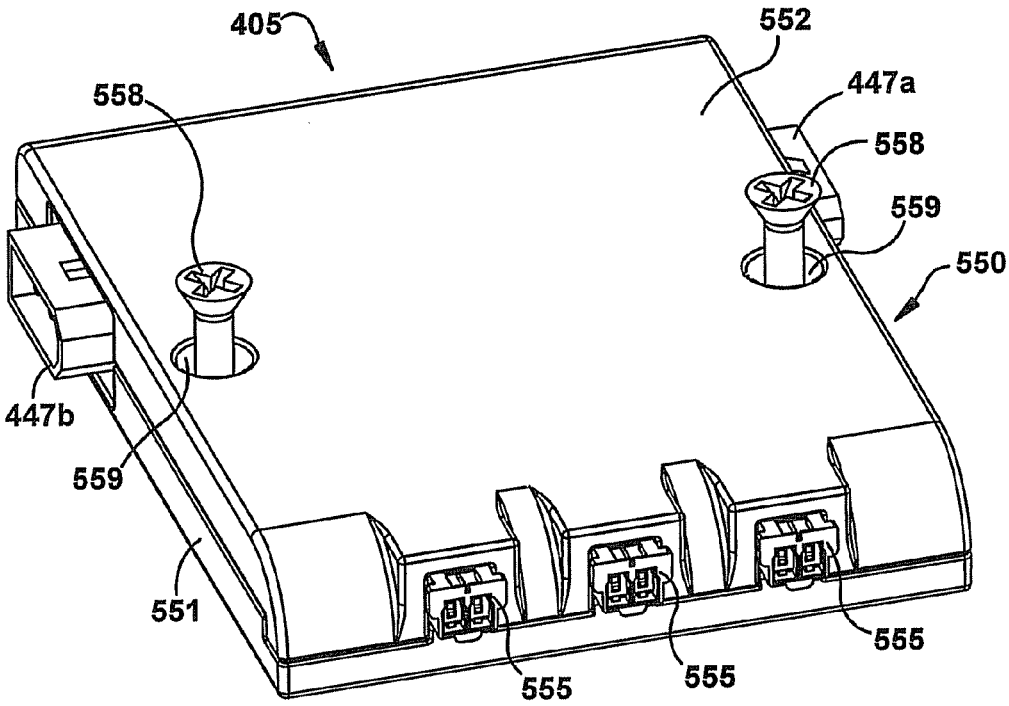
FIG. 14A is a perspective view of an exemplary junction box module that may be used with a modular LED lighting system.

FIG. 14A is a perspective view of an exemplary junction box 405 for use with a modular lighting system and one or more individual LED lighting units (as described in greater detail below). As shown, the junction box 405 may be provided with connectors 447*a*, 447*b* corresponding with connectors of other modules in a modular lighting system (such as, for example, the LED light module 402 of FIG. 2) for electrically connecting the junction box 405 with one or more modules of the modular lighting system. The junction box 405 includes a housing 550 having a base portion 551 and an outer portion 552 that enclose at least one LED driver circuit board 554 (see FIG. 14B) in circuit communication with a plurality of lighting unit output connectors 555 for connecting with mating connectors of one or more LED lighting units. The LED driver 554 may be configured to supply a desired voltage to a varying number of LED lighting units connected with the junction box 405. For example, in an exemplary junction box 400 having three lighting unit output connectors 555, the LED driver 554 is configured to supply voltage to one, two, or three lighting units connected with the junction box 405. Any suitable electrical connectors 555 may be assembled with the junction box housing 550 for connecting with mating connectors of LED lighting units. In one embodiment, a wire-to-board header (e.g., a Molex® Mini-Lock™ two-circuit wire-to-board header, p/n 53426-0210), may be assembled with the junction box housing 550 and electrically connected with the LED driver circuit for connecting with a mating wire-to-board housing (e.g., a Molex® Mini-Lock™ two-circuit wire-to-board housing, p/n 51102-0200) electrically connected with an LED lighting unit.

Figure 14B:
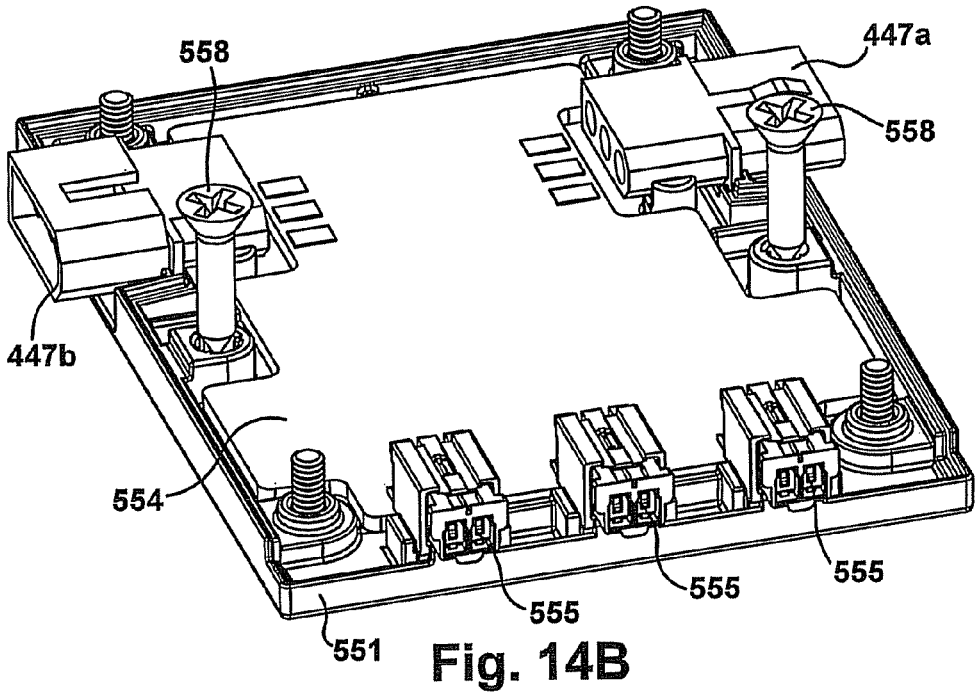
FIG. 14B is a perspective view of the junction box module of FIG. 14A (shown without internal electrical wiring), with the outer portion removed to illustrate additional features of the junction box module.

FIG. 14B illustrates internal components of the exemplary junction box 405, shown without internal electrical wiring. One of ordinary skill in the art would appreciate that electrical wiring may be used, for example, to connect the circuit board 554 with the electrical connectors 447*a*, 447*b* and output connectors 555.

The junction box module 405 may be configured to be connectable end-to-end with another module of a modular lighting system (such as, for example, the LED lighting module 402 of FIG. 2). In one embodiment, the junction box 405 may have the same or substantially the same cross section as an adjacent module, and the connectors may be positioned so that the transverse cross-sectional shapes of the modules are congruent or substantially align with each other when the modules are connected via the connectors 447*a*, 447*b*, making the connected system components appear to be a continuous sequence of adjacent pieces with the same or substantially the same cross section. Alternatively, the junction box 405 may be electrically connected to another module in the lighting system by a connecting cable or wiring harness, for example, to position the junction box separate or remote from other modules in the modular lighting system.

While any suitable mounting arrangement may be used to secure the junction box to an external surface (e.g., an underside of a cabinet), the junction box 405 may be configured to be mounted to an external surface using mounting fasteners 558 inserted through mounting holes 559 in the junction box housing 550.

Figure 15A:
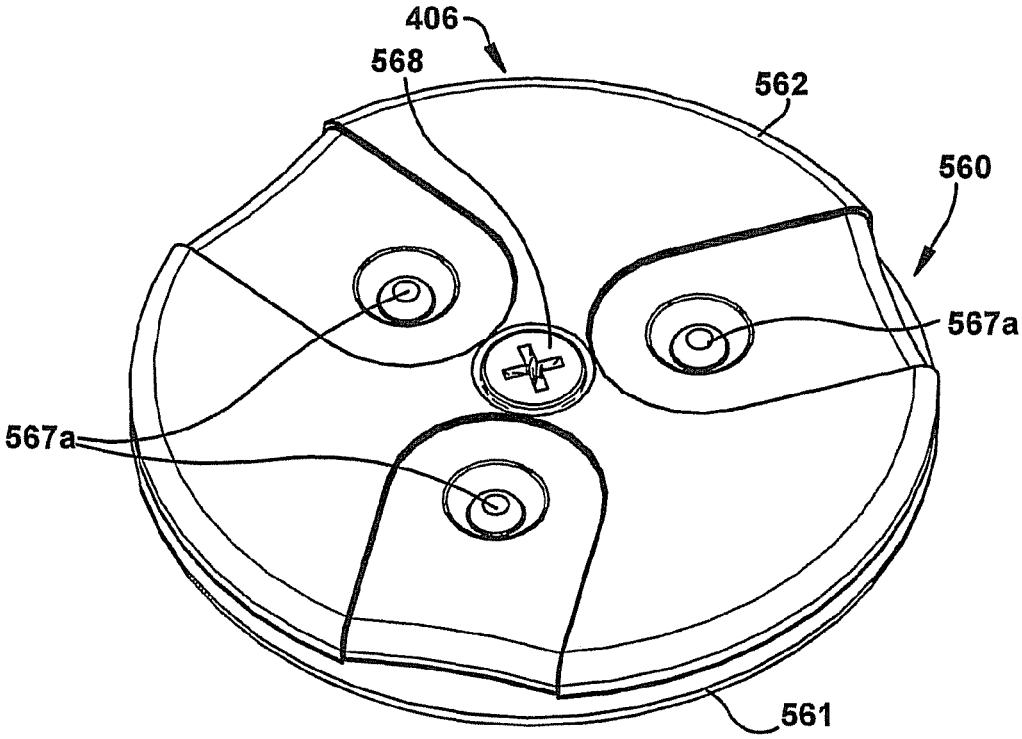
FIG. 15A is a perspective view of an exemplary lighting unit (shown without the electrical wire) that may be used with a modular LED lighting system.
Figure 15B:
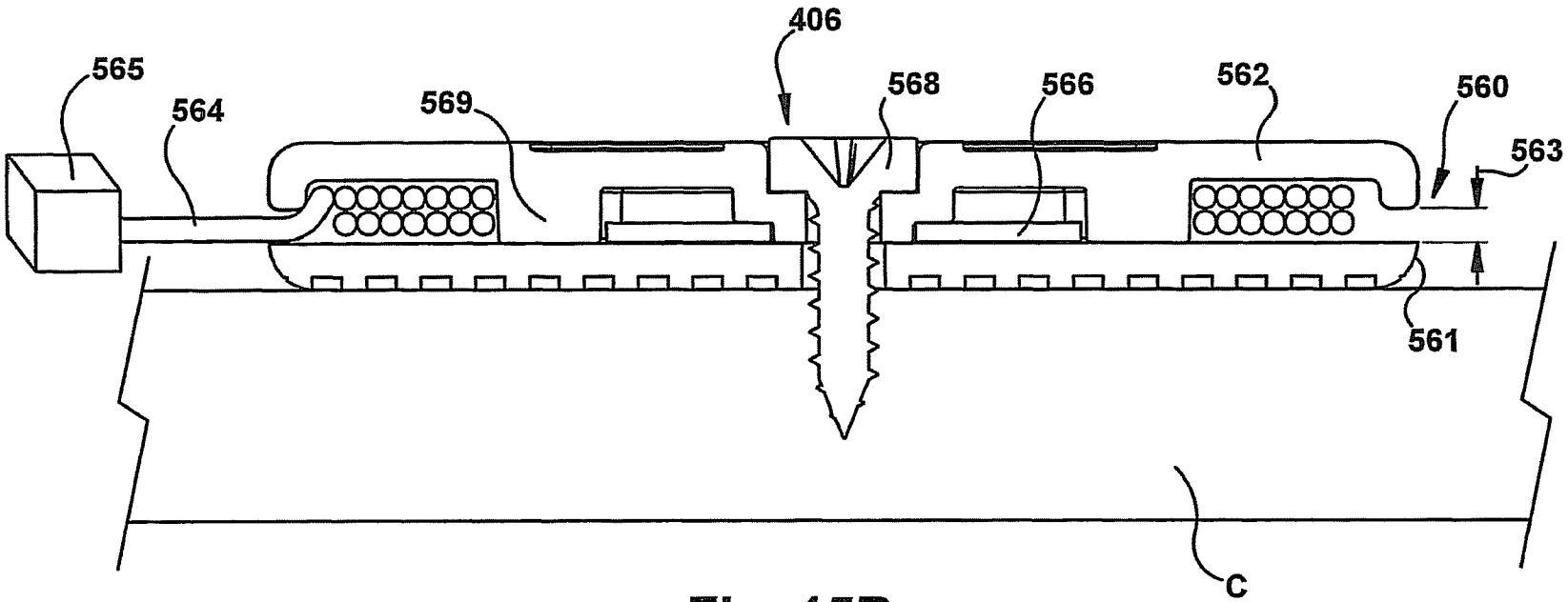
FIG. 15B is a cross-sectional view of the lighting unit of FIG. 15A.
Figure 15C:
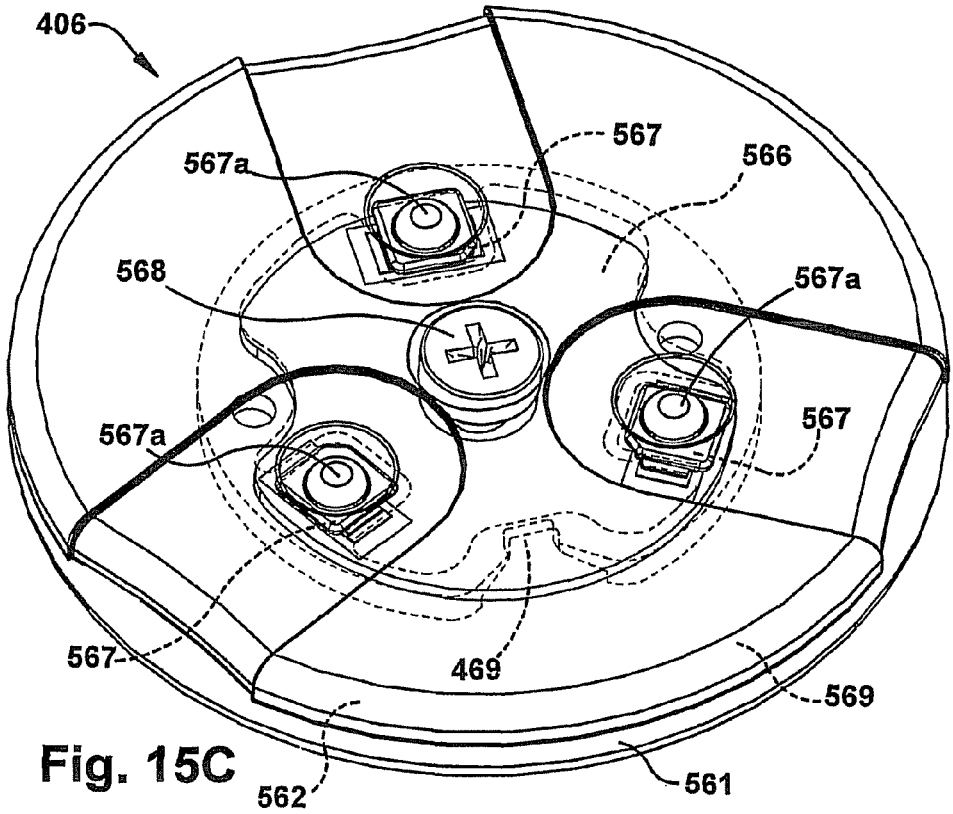
FIG. 15C is a perspective view of the lighting unit of FIG. 15A (shown without the electrical wire), with the outer portion shown in phantom to illustrate additional features of the lighting unit.
Figure 15D:
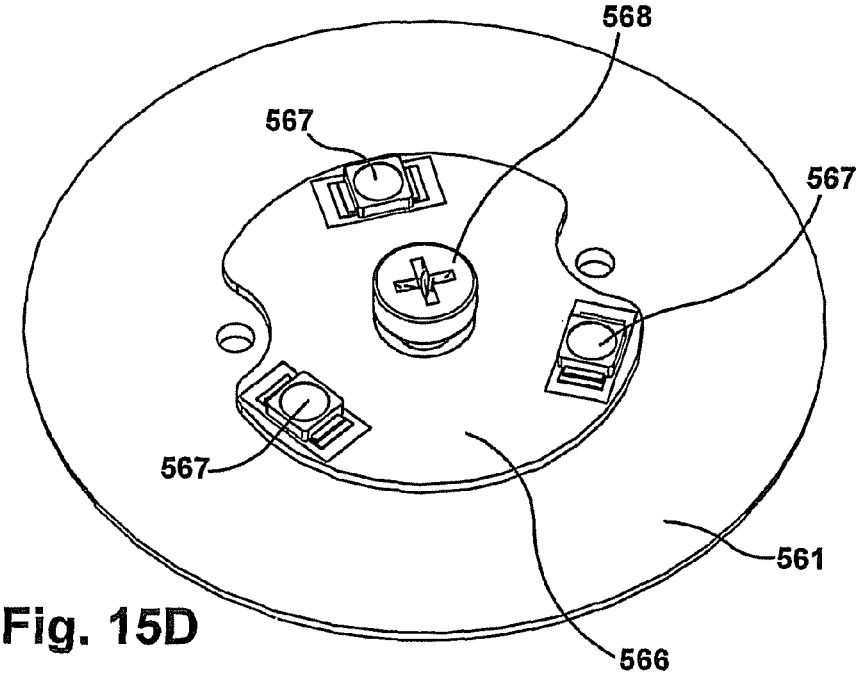
FIG. 15D is a perspective view of the lighting unit of FIG. 15A, with the outer portion removed to illustrate additional features of the lighting unit.
Figure 15E:
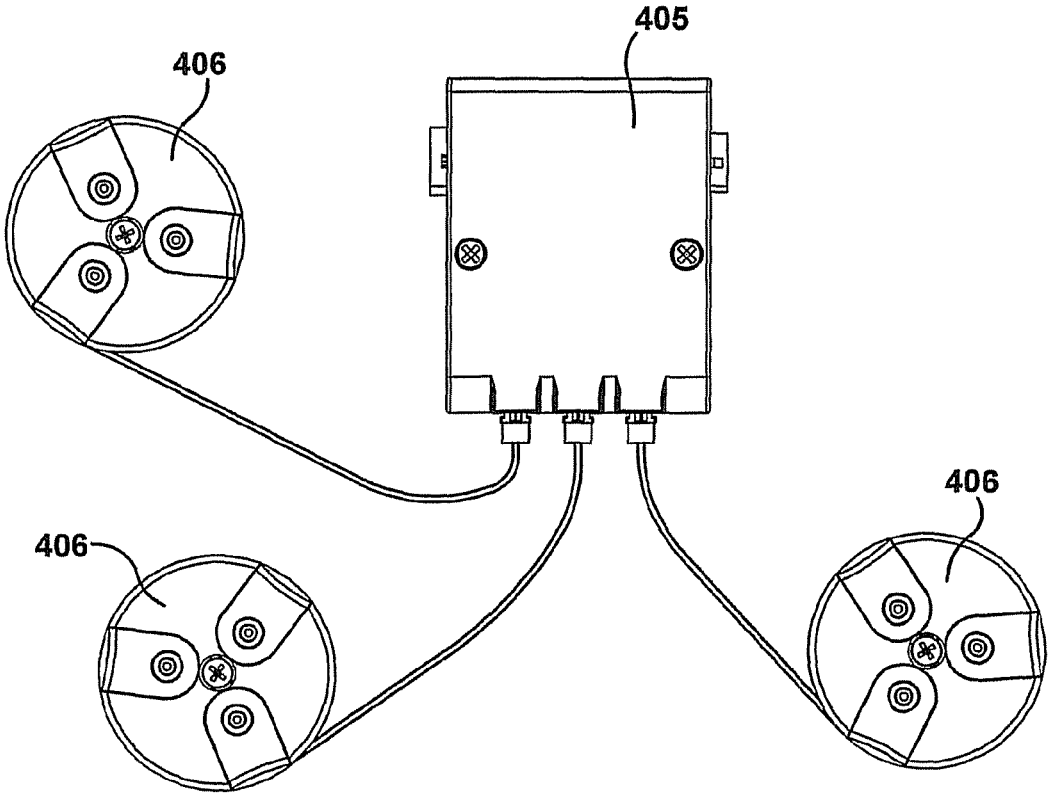
FIG. 15E is a plan view of an exemplary junction box module assembled with three lighting units.

Many different types of lighting units may be connected with a junction box to provide a desired lighting configuration. In one embodiment, one or more positionable LED lighting units may be connected to the junction box. FIGS. 15A-15E are various views of an exemplary lighting unit 406 which may be used, for example, with a modular LED lighting system by connecting one or more of the lighting unit 406 with a junction box 405, as shown in FIG. 15E. While LED lighting units of various sizes, shapes, and functionalities may be connected with a junction box for illumination in a modular lighting system, the exemplary lighting unit 406 includes a compact, low profile "puck" shaped housing 560 configured to be mounted to an external structure (e.g., the underside of a cabinet C, see FIG. 15B) proximate to the junction box 405. While any suitable quantity of LEDs may be provided with the lighting unit, the exemplary lighting unit 406 includes three LEDs 567 mounted to or carried by a circuit board 566 (FIG. 15D) disposed within the housing 560 for transmitting an electrical signal to each LED 567. Each LED 567 may be covered by a lens 567*a* (FIGS. 15A and 15C), to protect the LED 167 and to allow light to be transmitted through the housing 560. The exemplary lighting unit also includes an electrical wire 564 connected with the circuit board 566 for connecting the lighting unit 500 with a voltage source, such as, for example, a junction box 405 (which may be consistent with the junction box of FIGS. 14A and 14B), as shown in FIG. 15E. As discussed above, the electrical wire 564 may be provided with an electrical connector 565 (e.g., a two-circuit wire-to-board housing) configured to mate with an associated output connector 555 of the junction box 405.

While the lighting unit 406 may be provided with an electrical wire extending from the housing by a fixed length, in one embodiment, the housing 560 and electrical wire 564 may be configured to vary the portion or length of electrical wire 564 extending from the housing, to accommodate placement of the lighting unit 406 at varying distances from the power source (i.e., without exposure of excessive electrical wire). For example, as shown in the cross-sectional view of FIG. 15B, the lighting unit housing 560 may include a base portion 561 and an outer portion 562 that define a peripheral gap 563 in the housing 560 from which a stored portion of the electrical wire 564 may be withdrawn. As shown, the stored portion of the electrical wire 564 may be wound around a hub portion 569 radially inward of the gap 563. In the exemplary embodiment, the hub portion 569 is formed by a cylindrical wall extending inward from the outer portion 562 of the housing 560. As shown in FIG. 15C, the cylindrical wall may include an opening 569' sized and positioned to permit the electrical wire 564 to extend from the circuit board 566 to the outer surface of the hub portion 569 for winding the electrical wire 564 around the hub portion, as shown in FIG. 15B. The opening 569' may be shaped to ensure that the wire 564 extends through the hub 569 (and winds around the hub) with a wider portion of the wire facing the hub 569 for more uniform and efficient storage of the wire. The base portion 561, outer portion 562, and hub portion 569 may together form a spool shaped member configured to retain a wound portion of the electrical wire. The gap 563 may, but need not, extend around the entire outer perimeter of the housing 560. Additionally, the gap 563 may be sized to be slightly smaller than the width of the electrical wire 564, thereby providing a slight interference fit between the gap 563 and the wire 564, such that, in the absence of a pulling force applied to the wire 564, a wound portion of the wire is retained in the internal cavity of the housing 560.

In one embodiment, the lighting unit 406 may be provided with a mounting arrangement configured to allow for adjustment of a rotational position of the lighting unit 406 on an external structure, for example, to minimize the amount of exposed electrical wire 564 extending between the housing 560 and the voltage source (e.g., junction box 405). In the illustrated example, a central pan screw fastener 568 permits rotation of the housing 560 about the fastener 568 until the fastener is fully tightened into the external structure.

In one example, the wire 564 may be all or mostly or partially wound around the hub and retained in the housing when the assembly is shipped, and a user unwinds from the housing a length of wire 564 needed for the installation. As another example, the wire 564 may be all or mostly or partially outside the housing when the assembly is shipped, and a user winds around the hub 569 in the housing a length of wire not needed for the installation.

To install an exemplary junction box 405 and remote LED lighting units 406 in a modular LED lighting system, according to one exemplary installation procedure, a junction box 405 is electrically connected (for example, using a wiring cable or harness) with a power supply (such as, for example, one of the power supplies 407, 409 described below and shown in FIGS. 16A-E and 17A-E). The junction box 405 is mounted to an external structure or surface, such as, for example, the underside of a cabinet C (FIG. 15B), using fasteners 558 installed through mounting holes 559. Where the junction box 405 is electrically connected directly to another modular component of the lighting system (using one or both of the electrical connectors 447*a*, 447*b*), it may be desirable to electrically connect the junction box 405 before mounting, to make sure that the junction box 405 is mounted in the correct location. Where the junction box 405 is electrically connected to another modular component of the lighting system by a cable or wire harness, the junction box may be mounted to a predetermined location before electrically connecting the junction box to the lighting system. Locations for the remote lighting units 406 are identified, and the lighting units are mounted to the external structure or surface in the desired locations by partially tightening the pan screws 568 of each lighting unit 406. The electrical wires 564 of each lighting unit 406 are wound within or unwound from the housings 560 to limit the amount of wire extending from each housing 560 to an amount sufficient to connect the corresponding electrical connector 565 to an output connector of the junction box 405. While the pan screw 568 is partially tightened, the lighting unit housing 560 may be rotated to minimize any excess electrical wire 564 extending from the housing 560. Once the desired orientation and length of exposed electrical wire 164 is obtained, the pan screws 568 of each lighting unit 406 may be fully tightened.

According to another aspect of the present application, a modular LED lighting system may be constructed from any one or more of an LED lighting module, a junction box module with one or more connected LED lighting units, a power supply module, a dimmer module, and a nightlight module. For example, LED modules with varying numbers of LEDs may be provided that can be interchangeably used with the other modules. The modules may have compatible electrical connectors so that the modules can be connected directly to one another or linked by the same or similar external cables regardless of the combination of modules that is used. The modules may have the same or substantially the same cross section and the connectors may be positioned so that the cross-sectional shapes of the modules all align when the modules are connected via the connectors, making the connected system components appear to be a continuous sequence of adjacent pieces with the same or substantially the same cross section.

Figure 16:
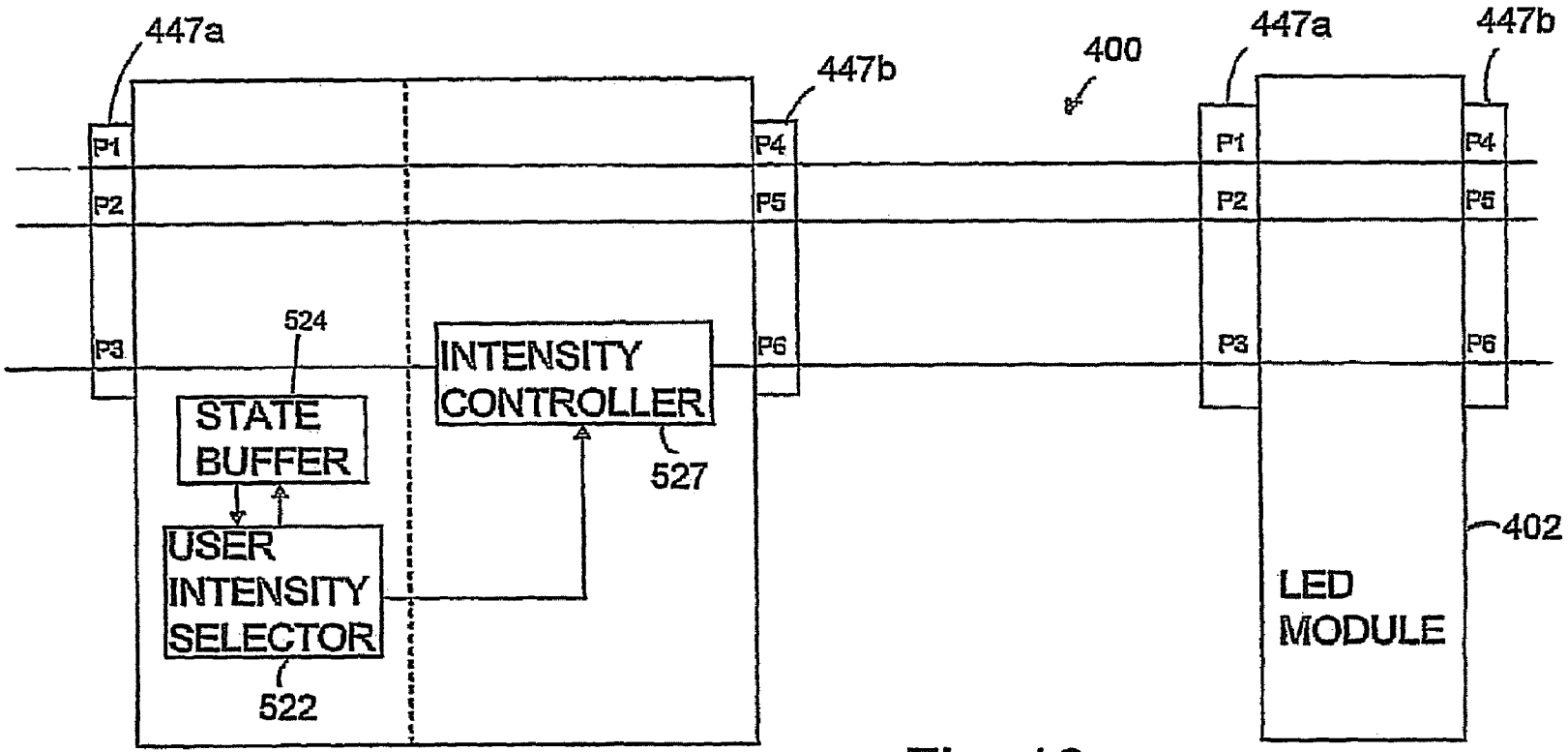
FIG. 16 is a functional block diagram of an exemplary modular LED lighting system that includes an exemplary LED module and an exemplary dimmer module according to an embodiment of the present invention.

FIG. 16 is a functional block diagram of an exemplary modular LED lighting system 400 that can be used, for example, in an under-cabinet application. The modular LED lighting system 400 includes an LED module 402 and a dimmer module 403. The various modules of the modular LED lighting system are electrically connected by three continuous buses, a power bus on which, e.g., 24 V DC is present, a ground bus that provides a common ground for the modules, and an intensity signal bus that conducts an intensity signal that communicates a selected intensity level for the LEDs in connected LED modules. The power, e.g., 24 V DC, is provided, for example, by an AC to DC converter or power supply (an example of which is described in greater detail below) that converts 120 V AC from a line voltage source (not shown) to a suitable power signal, e.g., 24 V DC. In the described exemplary embodiment, the intensity level signal is a PWM signal between about 5 volts and ground that pulls about 0.7 mA per LED module in the modular LED lighting system. The square wave frequency of the intensity signal is about 30 kHz. As can also be seen in FIGS. 17, 19, and 21, each exemplary module includes two (2) compatible connectors 447*a* and 447*b*, here three-pin connectors.

The pins provide the connection between the buses amongst the modules in the modular LED lighting system. For the purposes of this description, the pins are labeled P1-P3 on a first connector 447*a* that is placed on the leading side, electrically speaking, of the module and P4-P6 on a second connector 447*b* of an opposite configuration (male vs. female) to that of the first connector. The first connector 447*a* can be connected directly to the second connector 447*b*, or through a connecting cable or wire harness. In the exemplary embodiment, pins P1 and P4 provide access through the module to the power bus, pins P2 and P5 provide access through the module to the ground bus, and pins P3 and P6 provide access through the module to the intensity signal bus. As shown best in FIGS. 25A-25C, the exemplary connector 447*a* includes notched corners 448 at one side of the connector that mate with features in the module to insure the proper polarity of the connection.

Figure 17:
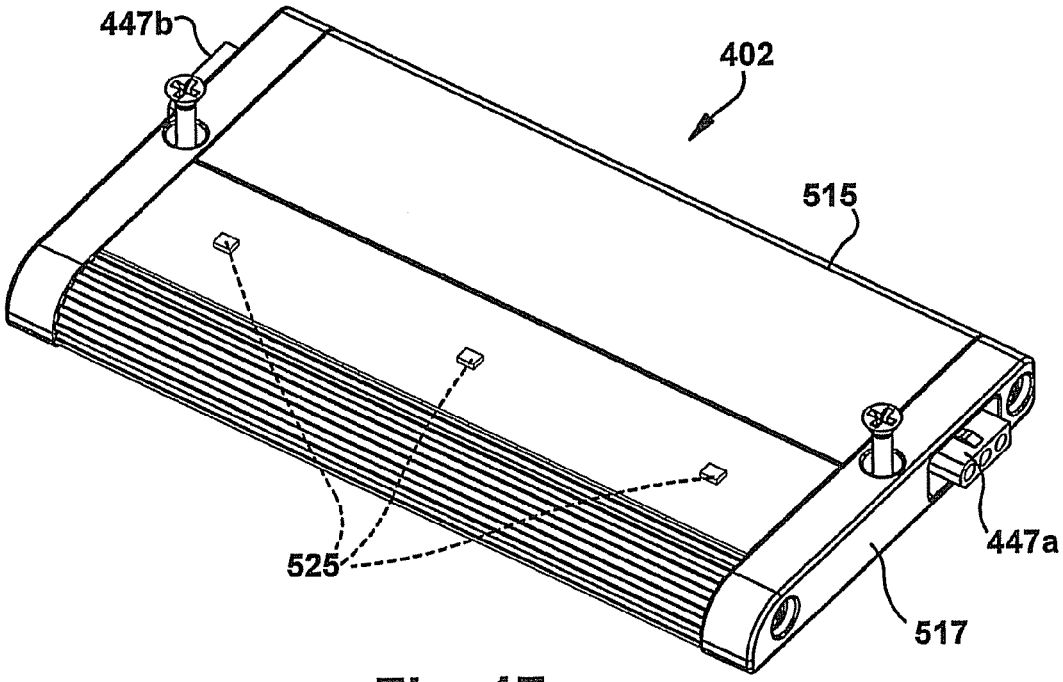
FIG. 17 is a perspective view of an exemplary LED module that may be used in the configuration of FIG. 16.

The exemplary LED module connects to the three buses and illuminates LEDs in the module to an intensity level that is selected by the dimmer module 403. FIG. 17 illustrates an exemplary LED module 402 adapted for use in under-cabinet lighting. The exemplary LED module 402 includes a housing 515 that houses a number of LEDs 525. In the described embodiment, there are three LEDs in the LED module, however, in other embodiments, other numbers of LEDs may be provided. For example, six or nine LEDs may be present in the housing. A diffuser 517 covers the LEDs to provide a desired lighting effect from the light provided by the LEDs 525. The LED module includes two connectors 447*a*, 447*b* each with three pins that provide access to the internal buses as described above.

Figure 18A:
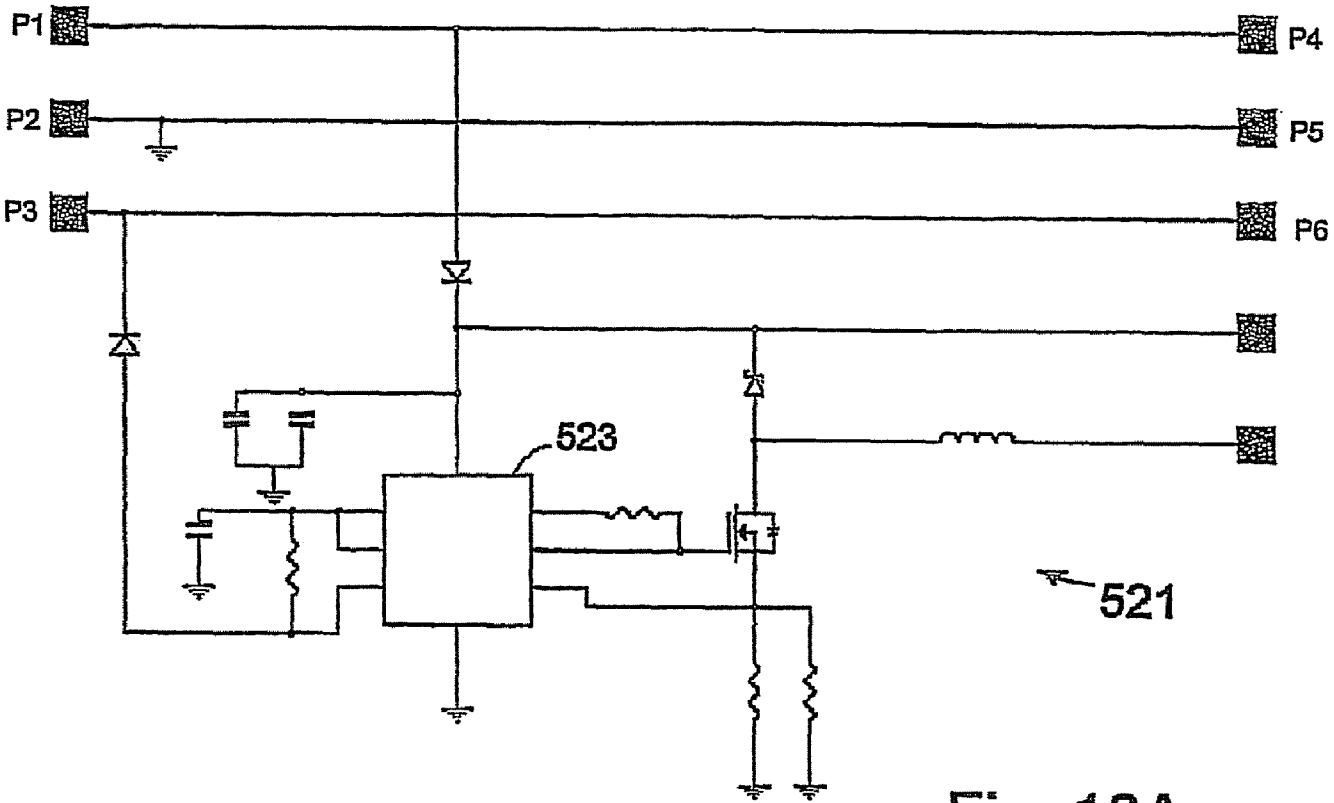
FIG. 18A is a schematic circuit diagram of a driver portion of the exemplary LED module of FIG. 17.
Figure 18B:
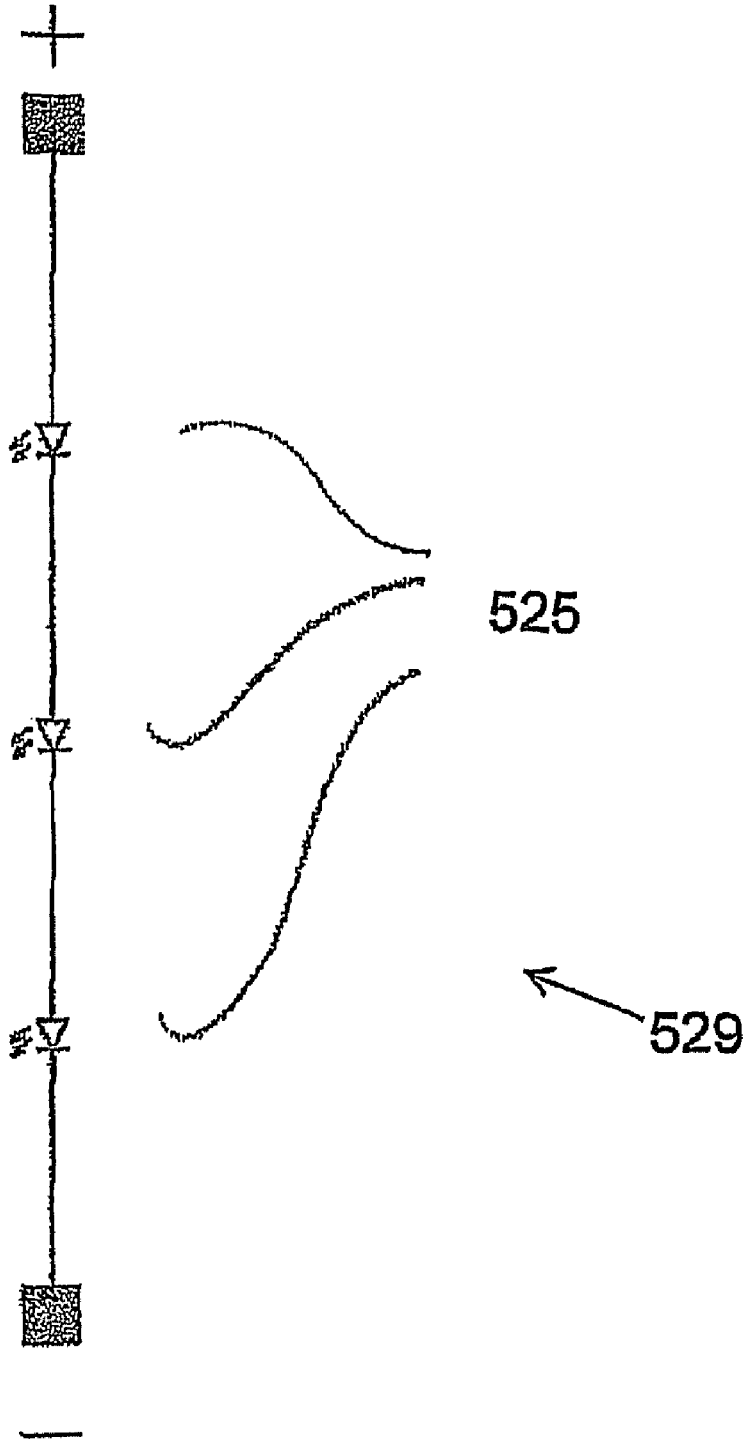
FIG. 18B is a schematic circuit diagram of an LED portion of the exemplary LED module of FIG. 17.

FIG. 18A is a schematic circuit diagram of an exemplary implementation of exemplary LED driver portion 521 of the LED module 402. The exemplary LED driver portion includes an LED driver integrated circuit 523 that is powered and grounded by the power and ground buses, respectively. One exemplary LED driver integrated circuit is the HV9910B Universal High Brightness LED Driver sold by Supertex Inc. in Sunnyvale Calif. The LED driver integrated circuit 523 receives the intensity signal in a Pulse Width Modulation Dimming input on pin 5 of the integrated circuit. The LED driver integrated circuit translates the input intensity signal into a pulse width modulated signal that is provided to a bank of LEDs in the LED portion 529 of the LED module. The LED portion is shown schematically in FIG. 18B with three LEDs 525. In the exemplary embodiment the LEDs 525 are configured to produce a single color of light, for example white light. However, the LED module 402 may be configured to provide illumination in a variety of colors, patterns, and intensities.

According to another inventive aspect of the present application, a modular LED lighting system may include a power supply or converter module configured to connect with an LED lighting module (e.g., the lighting module 402 of FIG. 17) or junction box driven lighting units (e.g., the junction box 405 of FIGS. 14A and 14B and the lighting unit 406 of FIGS. 15A-15E) to convert an alternating current source voltage (such as from a residential or commercial power line) to a direct current supply voltage for powering the modular LED lighting system. For example, the power supply may convert a 120 V AC source voltage to a 24 V DC supply voltage to transmit through the internal power bus of the modular LED lighting system.

FIGS. 19A-19E illustrate various views of an exemplary power supply module 407 configured to be assembled with a modular LED lighting system. The power supply module 407 may be provided with connectors 447*a*, 447*b* corresponding with the connectors 447*a*, 447*b* of other modules in the modular lighting system (such as, for example, the LED light module 402 of FIG. 17) for electrically connecting the power supply 407 with one or more of the power supply bus, ground bus, and intensity signal bus of the other modules of the modular lighting system. The power supply 407 includes a housing 570 having a base portion 571 and an outer portion 572 that define a board cavity 575 to enclose a AC-to-DC converter circuit board 574 (see FIG. 19B) in circuit communication with one or more electrical connectors 577*a-c* (e.g., push-wire connectors) disposed within the housing 570 for connecting with electrical wiring (not shown) carrying a source voltage. The circuit board 574 (which may include, for example, a transformer or rectifier) may be configured, for example, to convert 120 V AC to 24 V DC to provide a desired supply voltage to other modules of the LED lighting system over an internal power bus. To that end, the exemplary circuit board 574 connects with the internal power bus of the modular LED lighting system to transmit a supply voltage through connectors 447*a*, 447*b* to other modules of the LED lighting system. In the exemplary embodiment shown, the power supply module 407 operates independently of the intensity signal and thus the intensity signal bus passes through the power supply module 407 without interaction with the circuit board 574. In the alternative, the intensity signal bus may connect with the circuit board 574 for monitoring or alteration of the intensity signal.

Figure 19A:
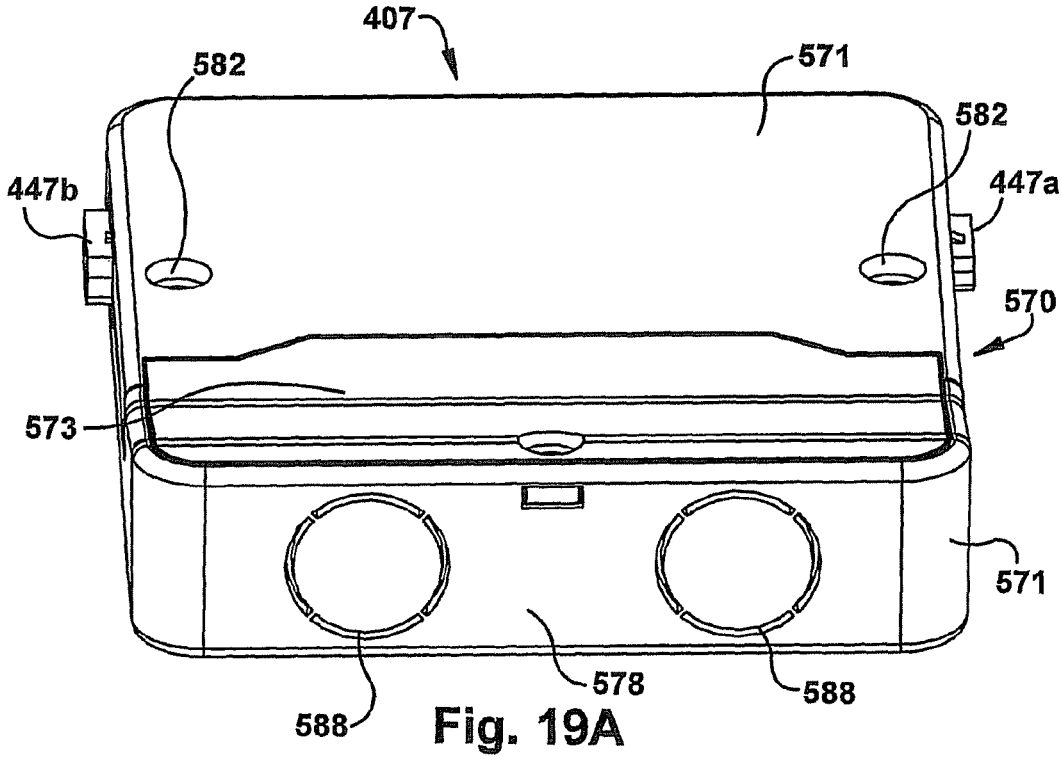
FIG. 19A is a perspective view of an exemplary power supply module that may be used with a modular LED lighting system.
Figure 19B:
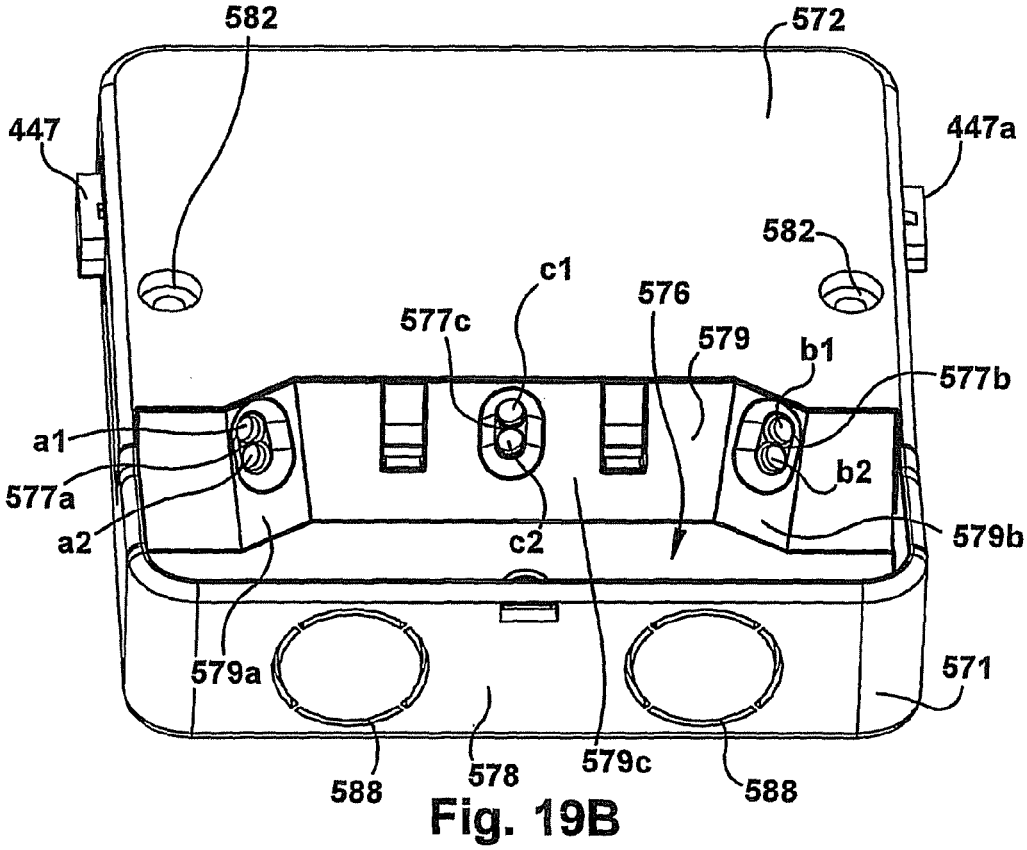
FIG. 19B is a perspective view of the power supply module of FIG. 19A, with the cover panel removed to illustrate additional features of the power supply module.
Figure 19C:
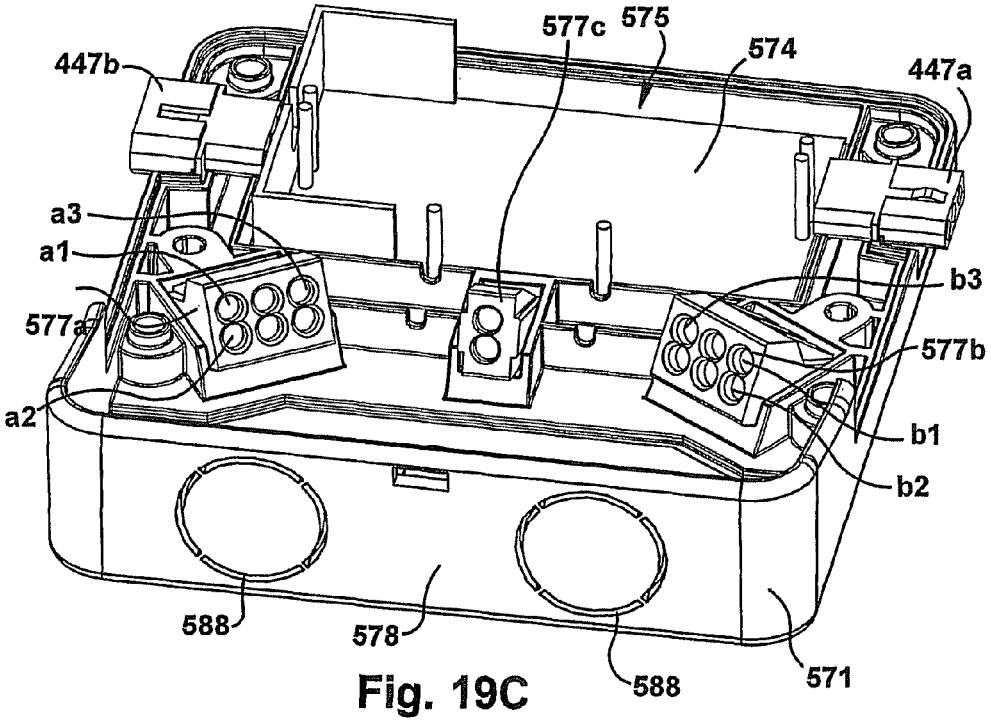
FIG. 19C is a perspective view of the power supply module of FIG. 19A (shown without internal electrical wiring), with the cover panel and outer portion removed to illustrate additional features of the power supply module.
Figure 19D:
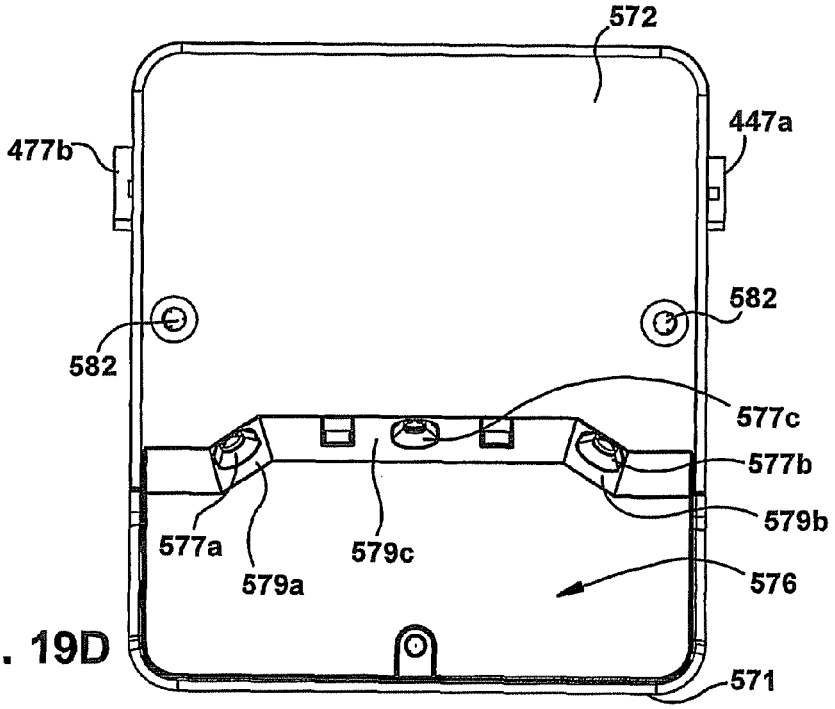
FIG. 19D is a plan view of the power supply module of FIG. 19A, with the cover panel removed to illustrate additional features of the power supply module.
Figure 19E:
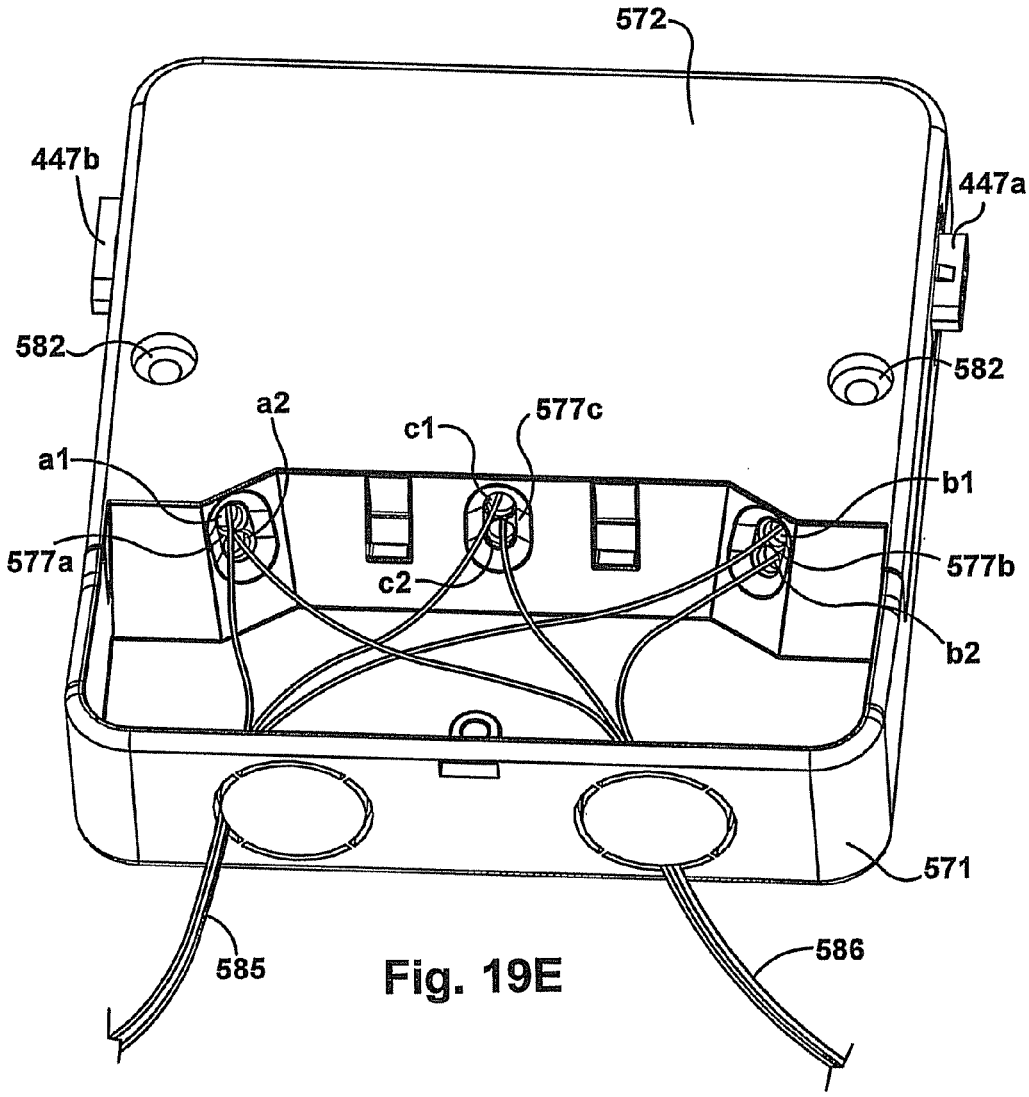
FIG. 19E is a perspective view of the power supply module of FIG. 19A, with the cover panel removed and electrical wiring from a power source connected with the electrical connectors.

FIG. 19C illustrates internal components of the exemplary power supply 570, shown without internal electrical wiring. One of ordinary skill in the art would appreciate that electrical wiring may be used, for example, to connect the circuit board 574 with the electrical connectors 447*a*, 447*b* and 577*a-c*.

While any suitable mounting arrangement may be used to secure the power supply module 407 to an external surface (e.g., an underside of a cabinet), the power supply module 407 may be configured to be mounted to an external surface using mounting fasteners (not shown) inserted through mounting holes 582 in the power supply housing 570.

The power supply module 407 further includes a cover panel 573 that is assembled with the housing 570 (for example, by an interlocking tab and slot arrangement) to enclose (i.e., substantially cover an opening in) an internal wiring compartment 576 partially defined both by an external wall 578 and an internal wall 579 of the outer portion 572 (although these walls 578, 579 may alternatively be formed by other components). The internal wall 579 separates the board cavity 575 from the wiring compartment 576. The external wall 578 includes at least one opening 588 for receiving the source wiring (not shown) therethrough for connecting with the electrical connectors 577*a-c*. As shown, the openings 588 may form narrow slots in the external wall 578, to function as a strain relief for the electrical wiring. While connections between the electrical wiring and the electrical connectors 577*a-c* may be made as loose connections within the internal wiring compartment 576, according to one inventive embodiment, one or more electrical connectors 577*a-c* may be captured behind, or receded from, inner wall surfaces 579*a-c* that may be proximate to the internal wall 579 and distal from the external wall 578. In one embodiment, as shown, the inner wall surfaces 579*a-c* may be disposed on the internal wall 579, such that the electrical connectors 577*a-c* are substantially disposed within the board cavity 575. By capturing one or more of the connectors 577*a-c* behind the internal wall 579, the size of the internal wiring compartment 576 (and therefore the overall size of the power supply module 407) may be reduced, since less manual manipulation of the wiring connections is required with these captive wire connectors or twist-on wire connectors. In one example, a power supply 407 including captured connectors, as described above, may not be subject to industry standard wiring compartment minimum volume requirements (e.g., 1 cubic inch per wire connection for 12 AWG wire under UL standard 2108 for low voltage lighting systems), as connections made with captive wire connectors or twist-in wire connectors are not considered "field splices." This may allow for a wiring compartment sized based on space requirements and ease of installation, without regard to minimum volume requirements. An exemplary power supply module 407 consistent with the embodiment of FIGS. 19A-E may be provided with a wiring compartment 576 having a total volume of approximately 5.6 cubic inches, or 0.93 cubic inches per wire connection.

While many different types of electrical connectors may be utilized to connect a line voltage source to the circuit board 574 for conversion to a suitable direct current signal, a push-wire connector 577*a-c* (e.g., a Wago® Series 773 Wall-nuts™ connector) may be used for efficient push-to-connect installation of the wiring. As shown, a first connector 577*a* includes first and second connection points a1, a2 to connect with input and output hot or positive source wires, to allow for a daisy-chain connection through the power supply. The first connector 577*a* further includes at least a third connection point a3 for connecting with the circuit board 574. Likewise, a second connector 577*b* includes first and second connection points b1, b2 to connect with input and output neutral or negative source wires, with at least a third connection point b3 for connecting with the circuit board 574. A third connector 677*c* includes first and second connection points c1, c2 to connect with input and output ground source wires. While a third connection point may allow for connection of the ground wires with the circuit board 574 (or some other power supply component), providing the power supply housing 570 in a polymer material may eliminate the need for additional grounding.

According to an inventive aspect of the present application, one or more of the captured connectors 577*a-c* may be positioned to facilitate installation of the source wiring, for example, in applications where the power supply module 407 is being installed against a wall (e.g., in a residential or commercial building) from which the source wiring extends. As shown in FIG. 19B, the first, second, and third connectors 577*a*, 577*b*, 577*c* may recede from first, second and third inner wall surfaces 579*a*, 579*b*, 579*c* that extend at an obtuse angle from an upper surface of the internal wiring compartment, facilitating visibility of the connectors (for example, when viewed from directly below the power supply 407, as shown in the plan view of FIG. 19D) and user insertion of the source wiring into the connectors 577*a*, 577*b*. While the inner wall surfaces 579*a*, 579*b*, 579*c* may be provided at a wide range of angles, in one embodiment, the wall surfaces extend at an angle of approximately 115° with respect to the upper surface of the wiring compartment. Further, the first and second inner wall surfaces 579*a*, 579*b* may be angled toward each other, for example, to more easily distinguish the connectors 577*a*, 577*b* when visibility of the connectors is impaired, and to provide space within the board cavity 575 to connect the third connection point a3, b3 of each connector 577*a*, 577*b* with the circuit board 574. While the first and second inner wall surfaces 579*a*, 579*b* may be angled toward each other at a wide range of angles, in one embodiment, the first and second wall surfaces are angled approximately 114° apart, with the third inner wall surface 577*c* between them and parallel to the rear edge of the housing.

To install an exemplary power supply module 570 for a modular LED lighting system, according to one exemplary installation procedure, the power supply module 570 is positioned on an external structure or surface (e.g., the underside of a cabinet) with the openings 588 of the external wall 578 facing and proximate to a wall (or other structure) from which the source wiring 585, 586 (see FIG. 19E) extends. The power supply 407 is mounted to the external structure using mounting fasteners (not shown) installed in mounting holes 582 in the power supply housing 570. The source wiring 585, 586 is inserted into the wiring compartment 576 through the external wall openings 588 (i.e., by reaching around the power supply housing 570). With the cover panel 573 disassembled from the housing 570, the user accesses the ends of the source wiring 585, 586 through the exposed wiring compartment opening and inserts the hot, neutral, and ground leads of each source wire 585, 586 into corresponding connection points a1, a2, b1, b2, c1, c2 of push-to-connect electrical connectors 577*a*, 577*b*, 577*c*. Because the connectors face away from the user during installation, the user may inspect the open wiring compartment from below the power supply 407 to identify the location of the angled connectors 577*a*, 577*b*, 577*c*. The user may also rely on the angle of the connectors 577*a*, 577*b*, 577*c* with respect to each other to know that he or she is installing the source wire leads with the correct connectors. Once the source wire leads are connected to the corresponding connection points, the cover panel 573 may be assembled with the housing 570 to enclose the wiring compartment 576 and electrical connections.

In another embodiment, electrical connectors of a power supply module may be positioned such that they face toward a front side of the power supply module (and the user connecting the wiring) and away from the opening in the external rear wall of the power supply module (through which the source wiring is inserted), thus allowing the installer to see the connectors while making the connections. FIGS. 20A-20E illustrate one such exemplary power supply module 409 configured to be assembled with a modular LED lighting system. The power supply module 409 may include side connectors 447*a*, 447*b*, electrical connectors 577*a-c*, and a circuit board 574 consistent with those of the power supply module 570 of FIGS. 19A-19E. The power supply module 409 includes a housing 590 having a base portion 591 and an outer portion 592 that define a board cavity 595 and first and second connector cavities 597, 598. The power supply module 409 further includes a cover panel 593 that is assembled with the housing 590 (for example, by interlocking tabs and slots and/or fasteners) to enclose (i.e., substantially cover an opening in) an internal wiring compartment 596 partially defined both by an external wall 594 of the base portion 591, and an internal perimeter wall 599, which may be formed by both the base portion 591 and the outer portion 592. A portion of the internal wall 599 separates the board cavity 595 from the wiring compartment 596. The external wall 594 includes strain relief openings 589 for receiving the source wiring therethrough for connecting with the electrical connectors 577*a-c*. As shown, the third (ground) electrical connector 577*c* may be provided as a loose (non-captured) connector within the wiring compartment 596. The first and second electrical connectors 577*a*, 577*b* are captured behind, or receded from, rear-most portions of the internal perimeter wall 599, proximate to the external wall 594 and distal from the portion of the internal wall separating the board cavity 595 from the wiring compartment 596, such that the electrical connectors 577*a*, 577*b* are substantially disposed within the first and second connector cavities 597, 598. By capturing the connectors 577*a*, 577*b* between the internal wall 599 and the external wall 594, the size of the internal wiring compartment 596 (and therefore the overall size of the power supply module 490) may be reduced, since less manual manipulation of the wiring connections may be necessary with these captive wire connectors or twist-on wire connectors. In one example, a power supply 409 including captured connectors, as described above, may not be subject to industry standard wiring compartment volume requirements (e.g., 1 cubic inch per wire connection for 12 AWG wire under UL standard 2108 for low voltage lighting systems), as connections made with captive wire connectors or twist-on wire connectors are not considered "field splices." This may allow for a wiring compartment sized based on space requirements and ease of installation, without regard to minimum volume requirements. An exemplary power supply module 409 consistent with the embodiment of FIGS. 20A-E may be provided with a wiring compartment 596 having a total volume of approximately 5.5 cubic inches, or 0.92 cubic inches per wire connection.

Figure 20A:
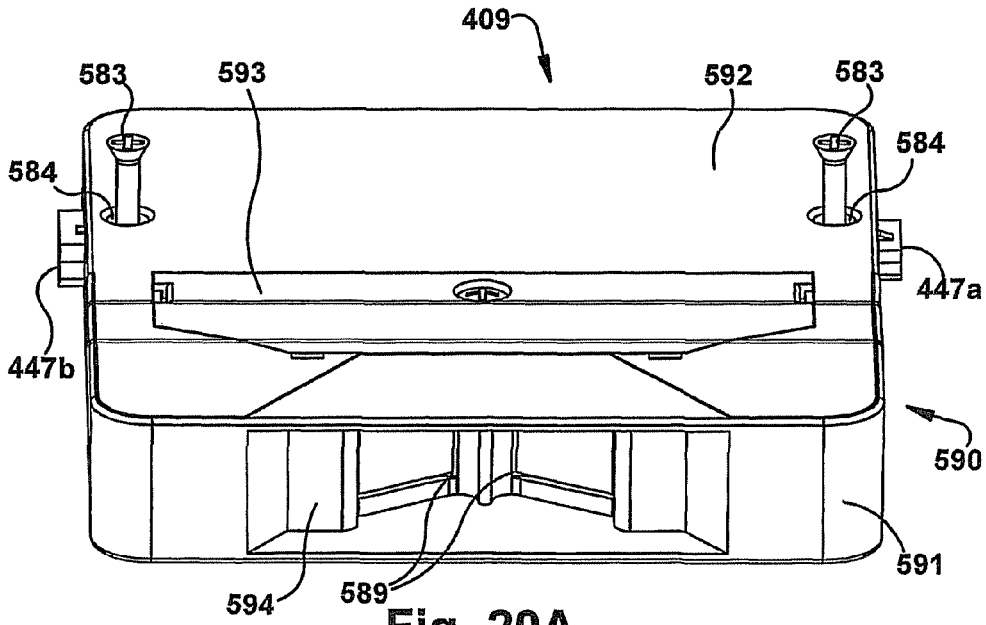
FIG. 20A is a perspective view of another exemplary power supply module that may be used with a modular LED lighting system.
Figure 20B:
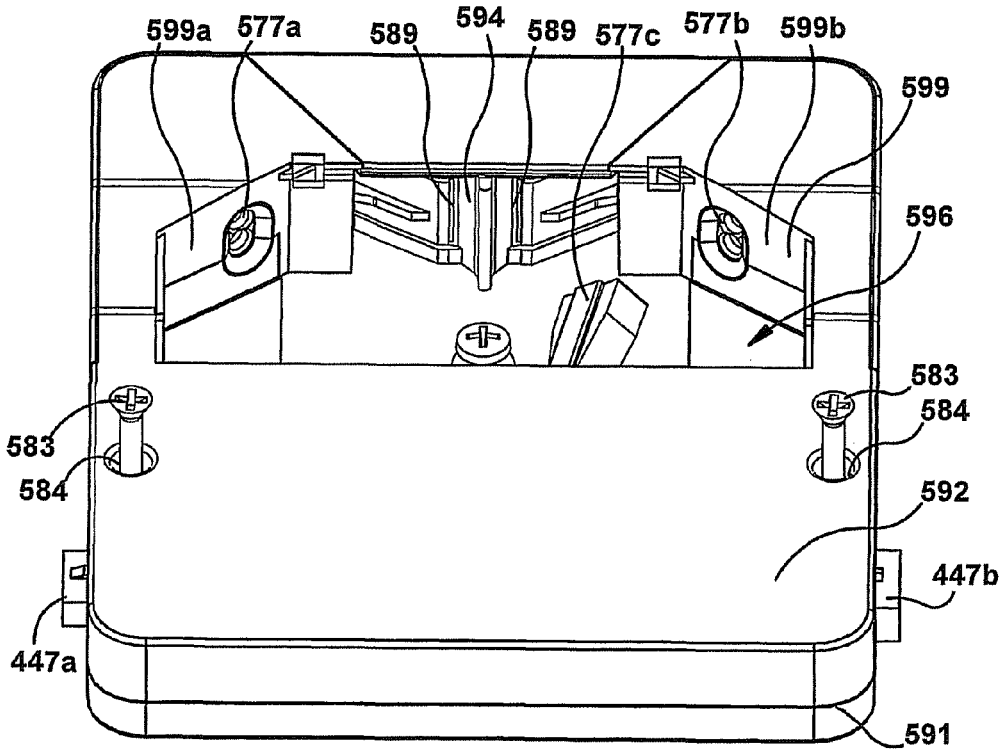
FIG. 20B is a perspective view of the power supply module of FIG. 20A, with the cover panel removed to illustrate additional features of the power supply module.
Figure 20C:
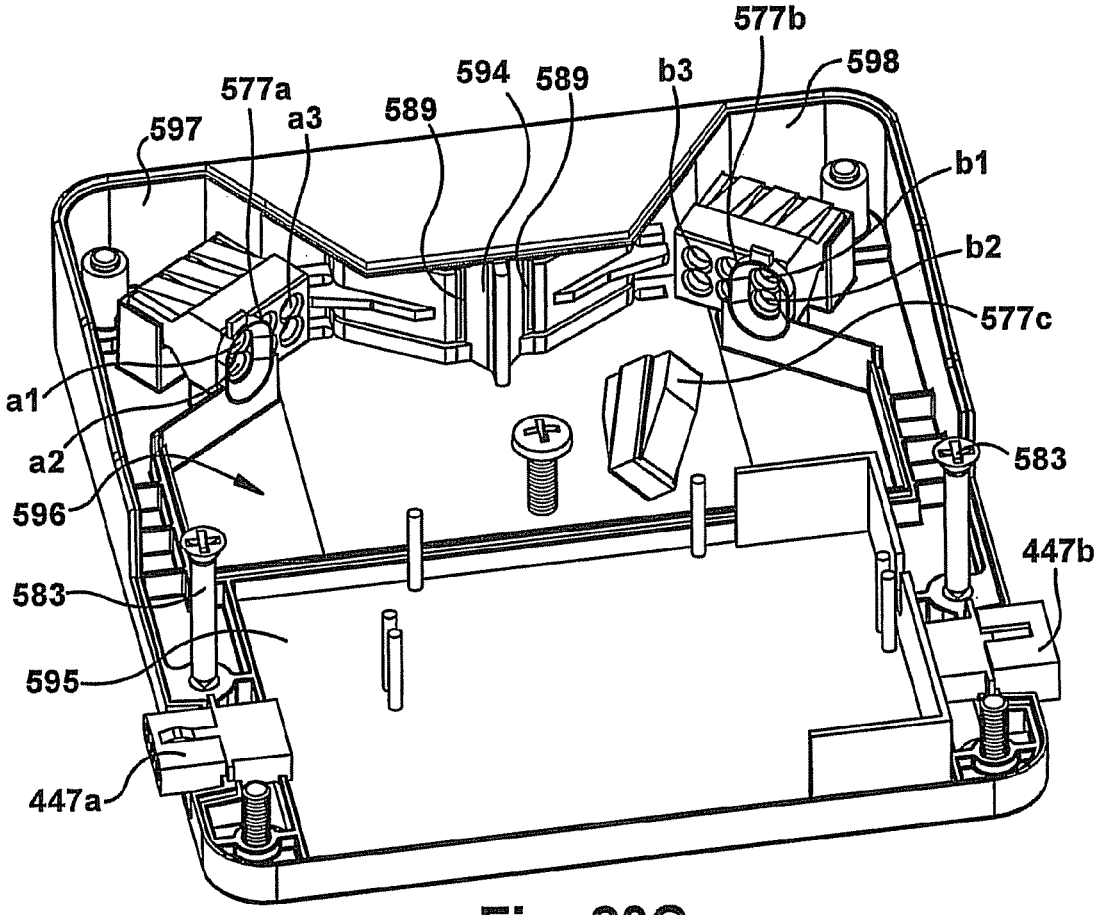
FIG. 20C is a perspective view of the power supply module of FIG. 20A (shown without internal electrical wiring), with the cover panel and outer portion removed to illustrate additional features of the power supply module.
Figure 20D:
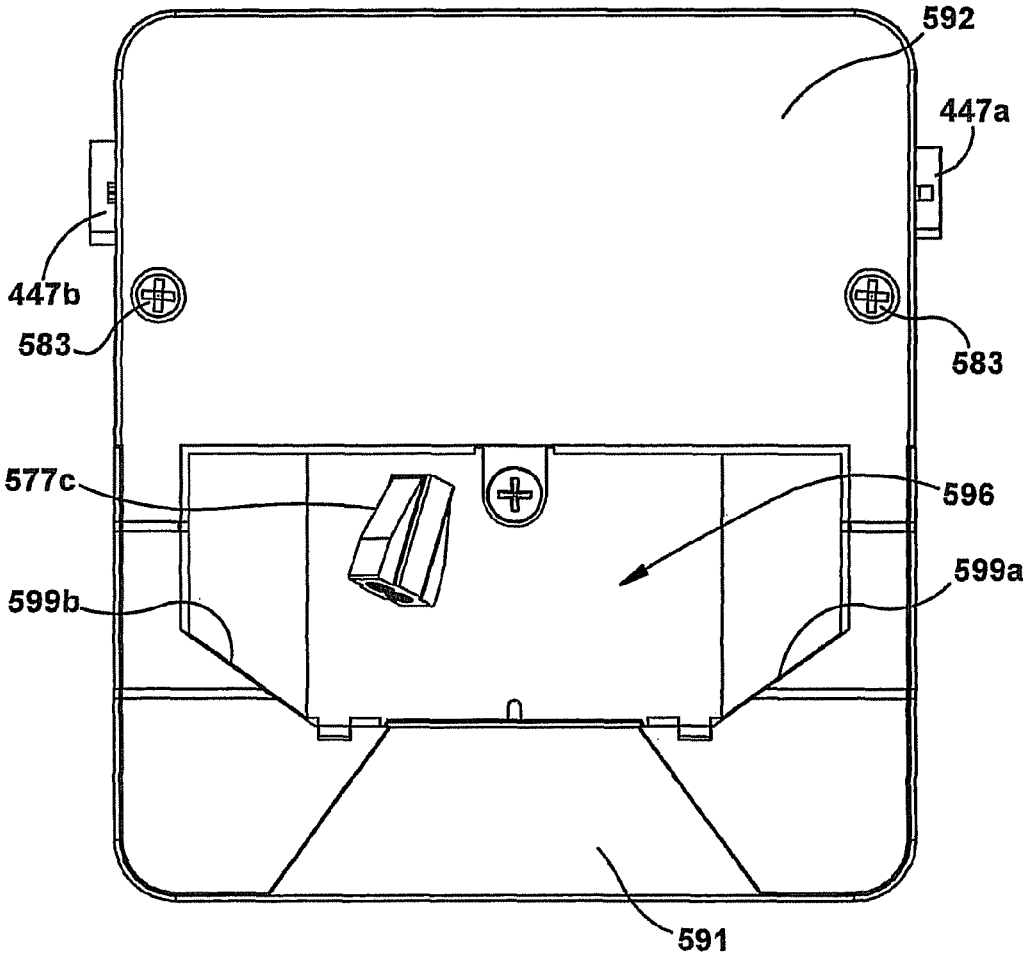
FIG. 20D is a plan view of the power supply module of FIG. 20A, with the cover panel removed to illustrate additional features of the power supply module.
Figure 20E:
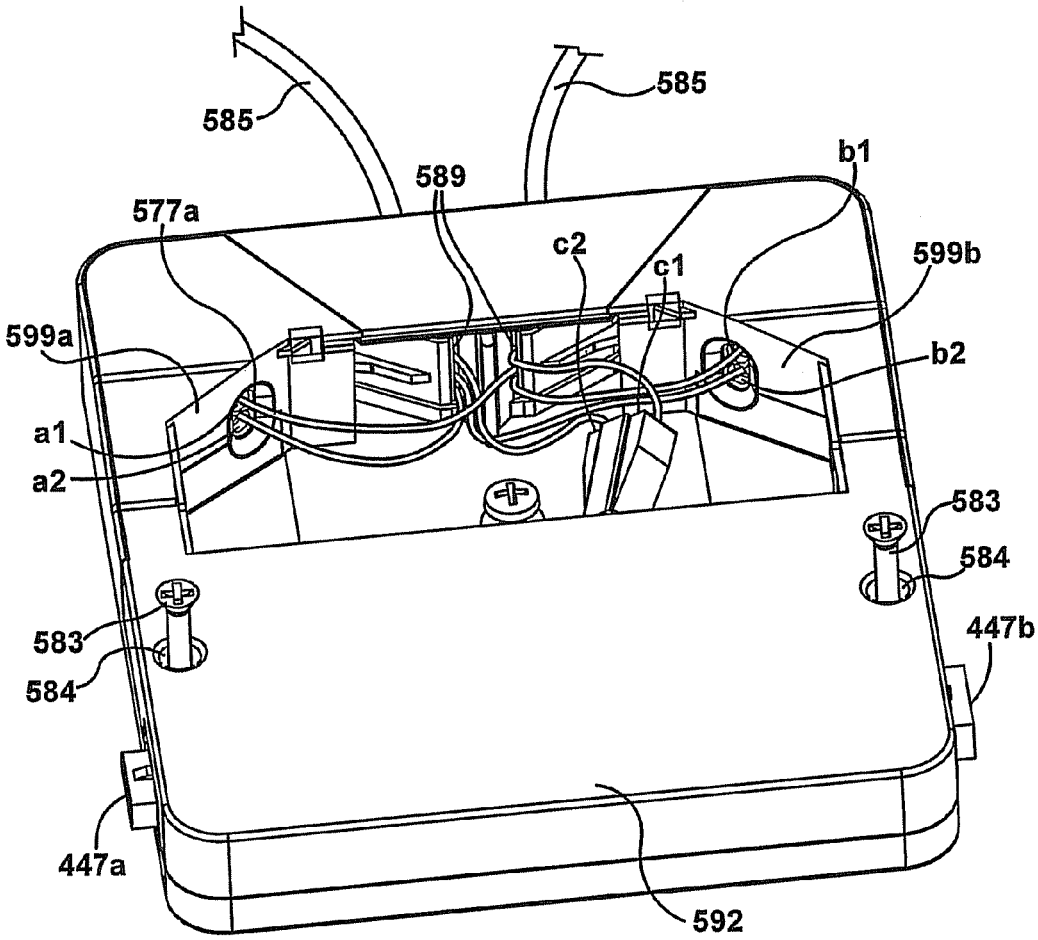
FIG. 20E is a perspective view of the power supply module of FIG. 20A, with the cover panel removed and electrical wiring from a power source connected with the electrical connectors.

FIG. 20C illustrates internal components of the exemplary power supply 409, shown without internal electrical wiring. One of ordinary skill in the art would appreciate that electrical wiring may be used, for example, to connect the circuit board 594 with the electrical connectors 447*a*, 447*b* and 577*a-c*.

As shown in FIG. 20B the first and second connectors 577*a*, 577*b* may recede from first and second inner wall surfaces 599*a*, 599*b* that are angled toward each other, for example, to provide space within the first and second connector cavities 597, 598 to connect the third connection point a3, b3 of each connector 577*a*, 577*b* with the circuit board 574, by extending electrical wiring (not shown) between the internal perimeter wall 599 and the external wall 594 and into the board cavity 595. While the first and second inner wall surfaces 599*a*, 599*b* may be angled toward each other at a wide range of angles, in one embodiment, the first and second wall surfaces are angled approximately 108° apart. Further, while the first and second inner wall surfaces 579*a*, 579*b*, 579*c* may extend at an obtuse angle from an upper surface of the internal wiring compartment (as shown in the power supply 407 of FIGS. 19A-19E), the first and second inner wall surfaces may instead be substantially perpendicular to the upper surface of the wiring compartment (as evident from the plan view of FIG. 20D), as visibility of the connectors 577*a*, 577*b* from in front of the power supply 409 may not be a concern (due to the front facing orientation of the connectors).

While any suitable mounting arrangement may be used to secure the power supply module 409 to an external surface (e.g., an underside of a cabinet), the power supply module 409 may be configured to be mounted to an external surface using mounting fasteners 583 inserted through mounting holes 584 in the power supply housing 590.

To install an exemplary power supply module 409 for a modular LED lighting system, according to one exemplary installation procedure, the power supply module 409 is positioned on an external structure or surface (e.g., the underside of a cabinet) with the openings 589 of the external wall 594 facing and proximate to a wall (or other structure) from which the source wiring 585, 586 (see FIG. 20E) extends. The power supply 409 is mounted to the external structure using mounting fasteners 583 installed in mounting holes 584 in the power supply housing 590. The source wiring 585, 586 is inserted into the wiring compartment 596 through the external wall openings 589 (i.e., by reaching around the power supply housing 590). With the cover panel 593 disassembled from the housing 590, the user accesses the ends of the source wiring 585, 586 through the exposed wiring compartment opening and inserts the hot, neutral, and ground leads of each source wire 585, 586 into corresponding connection points a1, a2, b1, b2, c1, c2 of push-to-connect electrical connectors 577*a*, 577*b*, 577*c*. Because the first and second connectors 577*a*, 577*b* face the user during installation, the user may visually identify the location of the connectors while facing the front of the power supply (i.e., without impaired visibility). Because the third connector 577*c* is a loose or non-captured connector, the ground leads from the source wiring 585, 586 may be connected to the third connector 577*c* outside of the wiring compartment 596. Once the source wire leads are connected to the corresponding connection points, the cover panel 593 may be assembled with the housing 590 to enclose the wiring compartment 596 and electrical connections.

Figure 21:
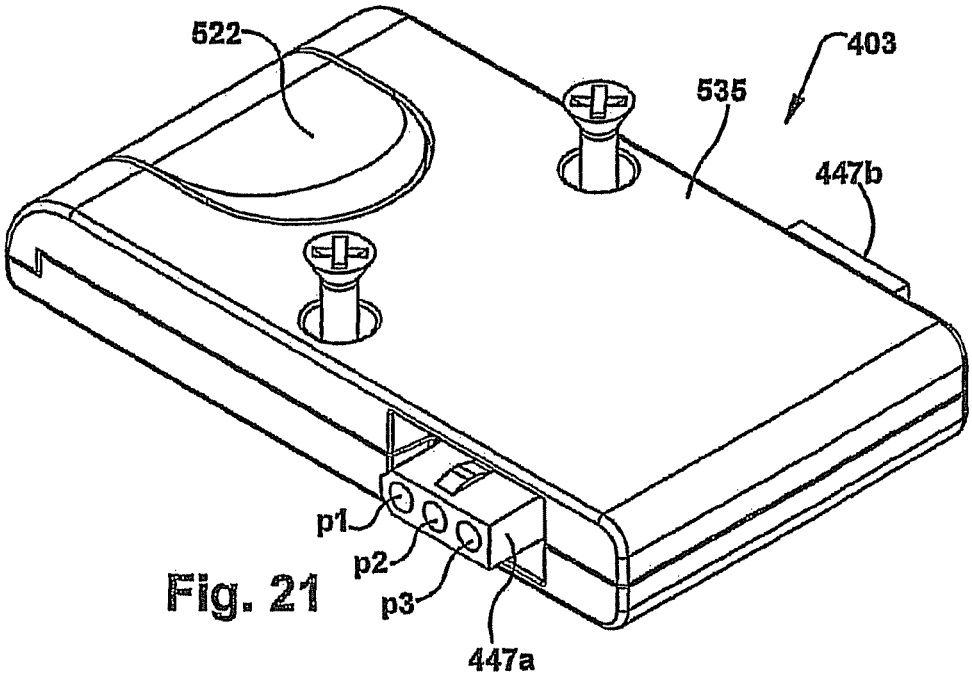
FIG. 21 is a perspective view of an exemplary dimmer module that may be used in the configuration of FIG. 16.

Referring back to FIG. 16, a dimmer module 403 may be provided to control the intensity of the light produced by a lighting module (e.g., the LED module 402 of FIG. 2). An exemplary dimmer module 403 generates an intensity signal based on a selected intensity that is input by a user of the modular LED lighting system. The exemplary dimmer module 403 includes three functional components, an intensity selector 522, a state buffer 524, and an intensity controller 527. The intensity selector 522 may be a user operable intensity control interface, such as, for example, a push button that selects an incremental change in intensity per actuation, or a knob or slide that allows an analog type adjustment of intensity. The intensity control interface may include a switch that is operable between multiple actuation modes to control the brightness or intensity level of the LEDs, for example, by mapping each actuation mode to a predetermined proportion of the full brightness level of the LEDs. In one embodiment, the intensity selector may include a positional switch that is manually adjustable between multiple positions (e.g., sliding or rotational positions) corresponding to multiple actuation modes, to provide varying levels of illumination intensity. In another embodiment, the intensity selector is a push button that can be actuated one or more times (to corresponding multiple actuation modes) to provide multiple, incremental levels of intensity, each corresponding to a selected proportion of a full LED brightness or intensity level. For example, a push button dimmer module may be configured to provide four brightness levels: 0% intensity (LEDs off), 18% intensity, 40% intensity, and 100% intensity. In other embodiments, a dimmer module may be configured to provide a different number of intensity levels (e.g., three intensity levels, or five or more intensity levels), or different predetermined levels of intensity. FIG. 21 shows an exemplary dimmer module 403 that is adapted for use in under-cabinet lighting. The dimmer module includes a housing 535 that houses an intensity selector 522. The dimmer module also includes two connectors 447*a*, 447*b* that include connections for pins P1, P2, P3 that provide access to the internal power, ground, and intensity control buses, respectively.

FIG. 5 is a schematic circuit diagram of an exemplary implementation of exemplary dimmer module 403. The dimmer module 403 includes a programmable integrated circuit 534 that includes an internal flash memory that saves a present state of the outputs of the integrated circuit. In the described embodiment, the flash memory stores a present selected intensity level when the power to the modular LED lighting system is switched off. This internal flash memory corresponds to the state buffer 524 of FIG. 16. The programmable integrated circuit 534 functions as an intensity signal generator by receiving an input from the intensity selector 522 and outputting the intensity signal corresponding to the selected intensity level onto the intensity signal bus. In the described embodiment, a fixed slice of time forms the basis for the intensity signal, for example, 36 microseconds. Within this slice of time a full PWM cycle occurs. The intensity signal is a digital signal that is on for a percentage of the 36 microsecond time slice and off for the remainder. The on and off times also refer to the time the LEDs in the LED module are on and off. The larger the percentage of the on time, the brighter the LED is. The intensity signal is present on the bus and can be received by LED modules upstream and downstream of the dimmer module.

Figure 23:
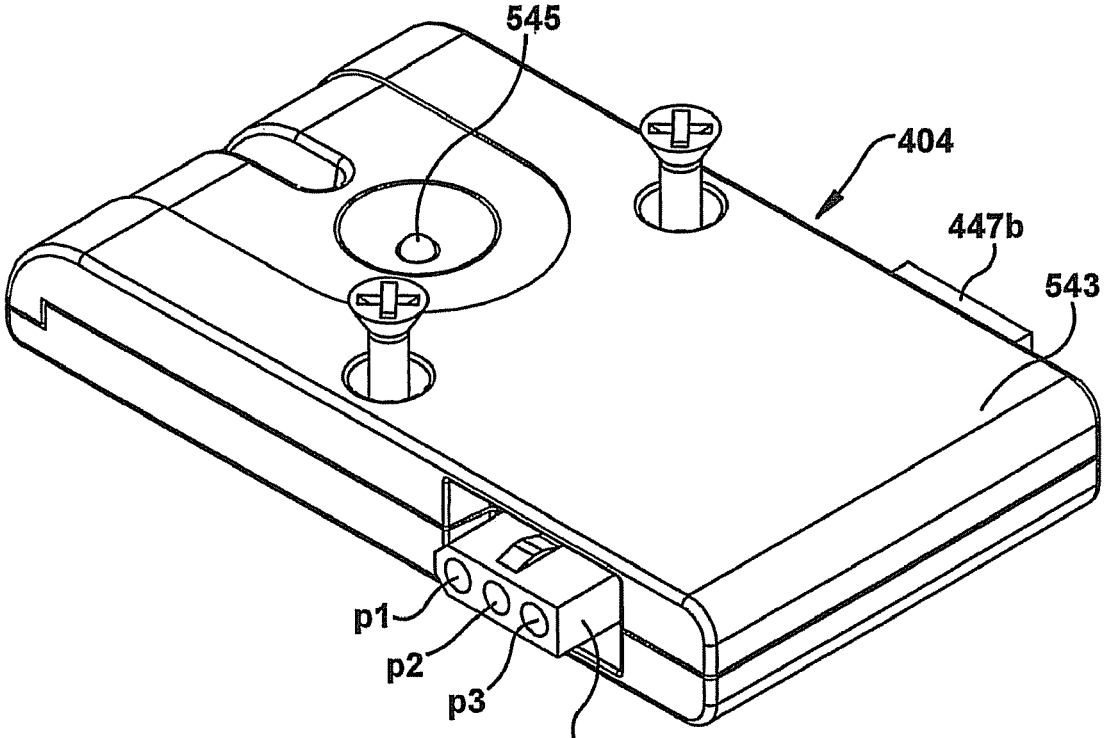
FIG. 23 is a perspective view of an exemplary nightlight module that can be used with the exemplary LED module of FIG. 16 according to an embodiment of the present invention.
Figure 24:
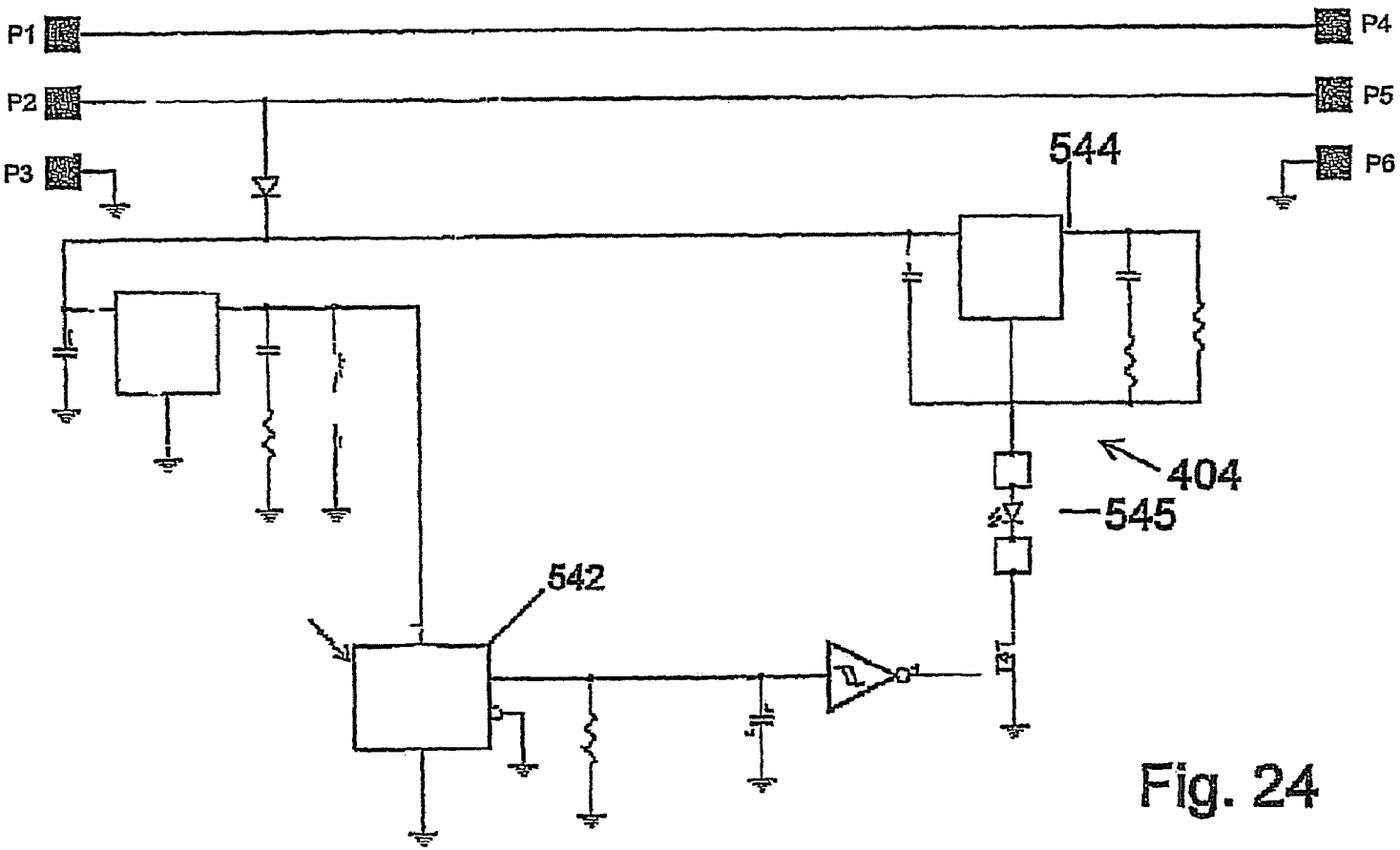
FIG. 24 is a schematic circuit diagram of the nightlight module of FIG. 23.

FIG. 23 is a perspective view of an exemplary nightlight module 404 that is configured to be used as part of a modular LED lighting system. The nightlight module includes a housing 543 that houses an LED 545. The LED 545 may have a lower intensity than the LEDs 525 (FIG. 17) in the LED module 402 (i.e., may be illuminated to a brightness level equivalent to a predetermined proportion of the full brightness level of the associated LED module 402), or may produce colored light for a decorative effect. The exemplary nightlight module also includes two connectors 447*a*, 447*b* that include connections for pins P1, P2, P3 that access the internal power, ground, and intensity control buses, respectively. Referring now to FIG. 24, a schematic circuit for an exemplary implementation of exemplary nightlight module 404 is shown. The nightlight module operates independently of the intensity signal and thus the intensity signal bus passes through the nightlight module without interaction with any components therein. The nightlight module may be provided with an actuation mechanism that controls illumination of the nightlight module LED. While the actuation mechanism may be a manually operable mechanism, such as, for example, a pushbutton or switch, in another embodiment, the actuation mechanism includes an automatic mechanism for illuminating the LED under certain conditions, such as time of day, the illumination state of associated lighting, or the level of ambient light. The exemplary nightlight module 404 includes an optical switch or photo sensor 542 that is triggered by the level of ambient light to provide an output when the ambient light falls below a preselected level. An LED driver or power signal generator 544 is coupled to the power bus and is configured to provide an input voltage to the LED 545. When the photo sensor 542 detects a low level of ambient light, it outputs a signal that switches a transistor, such as, for example, a metal-oxide-semiconductor field effect transistor (MOSFET) Q1 into a conducting state to provide a path to ground for the LED voltage. In this manner the LED 545 is illuminated when ambient light levels fall below a preselected level. If the LED modules 402 in the modular LED lighting system are illuminated, the nightlight module's LED 545 may be configured to be turned off by the illumination of the LEDs in the LED modules 402. In other embodiments, a similar photo sensor arrangement may be provided with other lighting modules, such as, for example, the LED lighting module 402 of FIG. 17 and the junction box module 405 (with connected LED lighting units) of FIGS. 14A and 14B.

Figure 22:
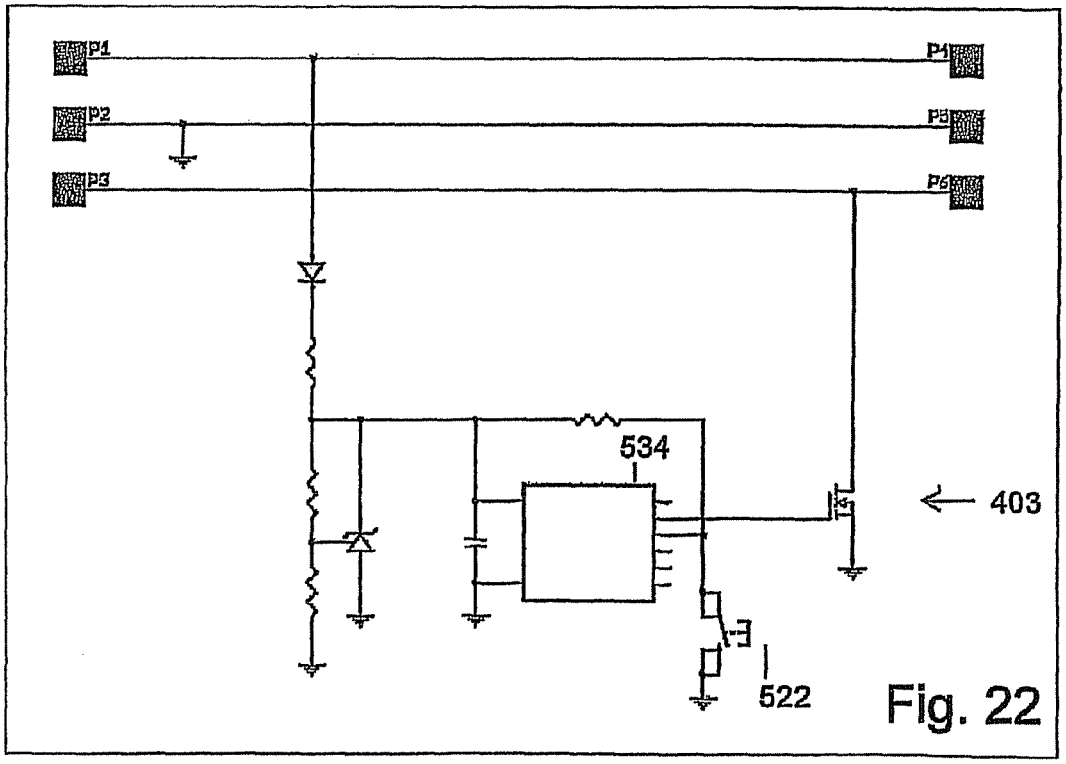
FIG. 22 is a schematic circuit diagram of the exemplary dimmer module of FIG. 21.

The circuits of FIGS. 18A, 22, and 24 may have module enclosures different than as shown in FIGS. 17, 21, and 23. Such modules may be configured to be connectable end-to-end in virtually any combination or permutation and may have the same or substantially the same cross section and the connectors may be positioned so that the transverse cross-sectional shapes of the modules are congruent or substantially align with each other when the modules are connected via the connectors, making the connected system components appear to be a continuous sequence of adjacent pieces with the same or substantially the same cross section. Alternatively, one or more of the modules may be connected to an adjacent module by a connecting cable or wiring harness, for example, to position a module separate from other modules in the modular lighting system. As one example, while a power supply module (e.g., the power supply modules 70, 90 of FIGS. 19A-19E and 20A-20E) may be connected directly to an adjacent module of the modular lighting system (and may be at least partially similar in cross section to provide a substantially congruent appearance), in another arrangement, it may be desirable to mount the power supply module directly against the wall carrying the power source lines, while mounting the lighting modules closer to a front edge of a cabinet.

Figure 25A:
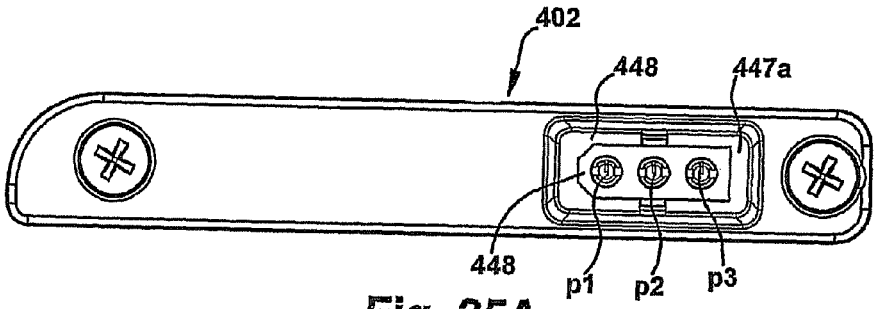
FIGS. 25A-25C are side elevational views of the exemplary LED module of FIG. 17, the exemplary dimmer module of FIG. 21, and the exemplary nightlight module of FIG. 23.
Figure 25B:
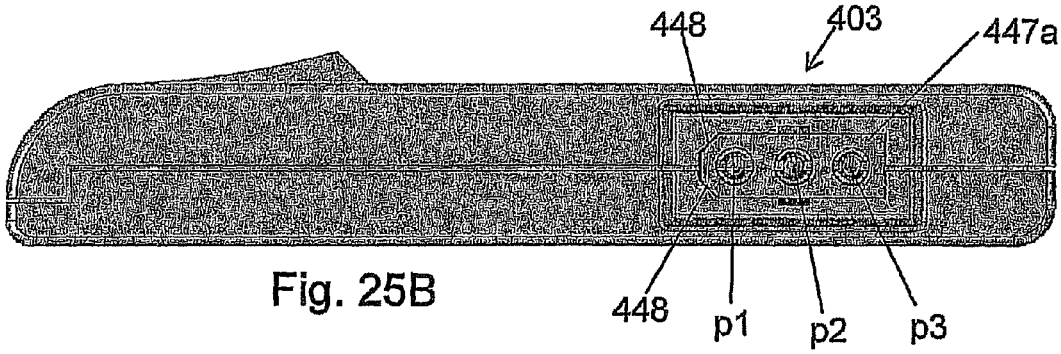
Figure 25C:
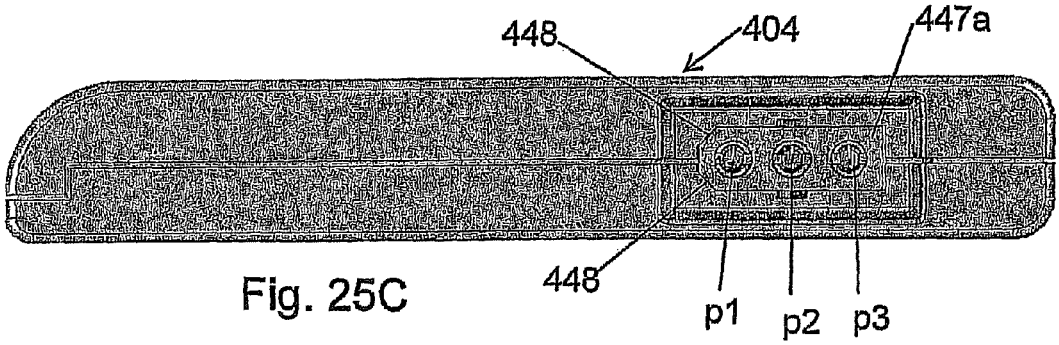
Figure 26:
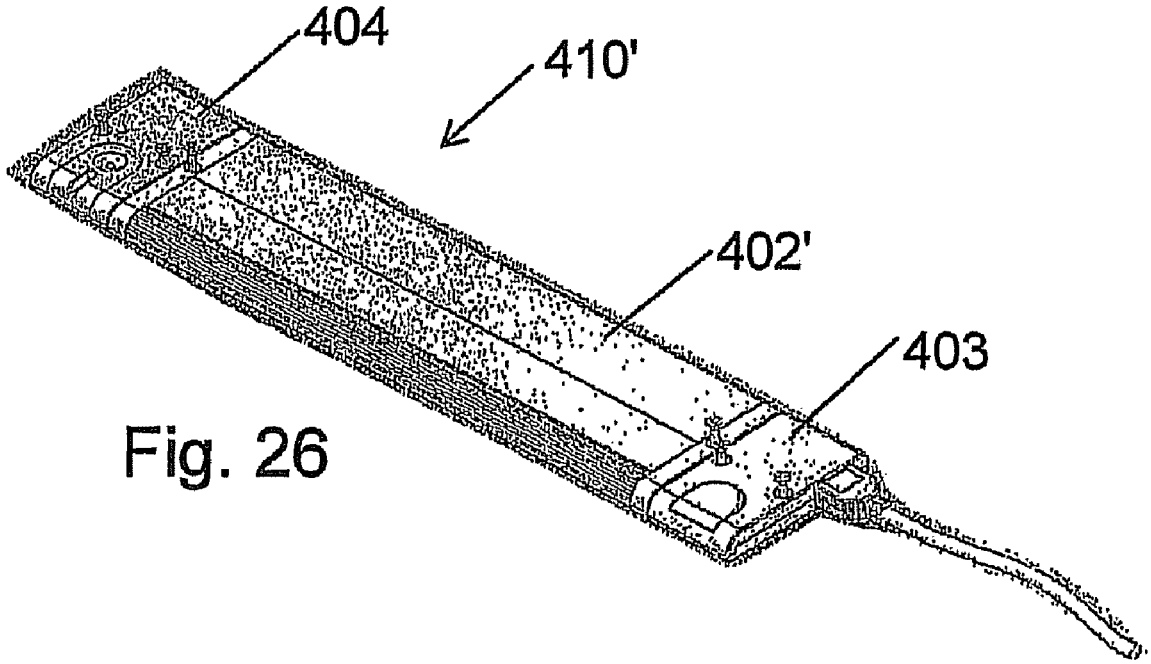
FIG. 26 is a perspective view of an exemplary modular LED lighting system constructed in accordance with an embodiment of the present invention.
Figure 27:
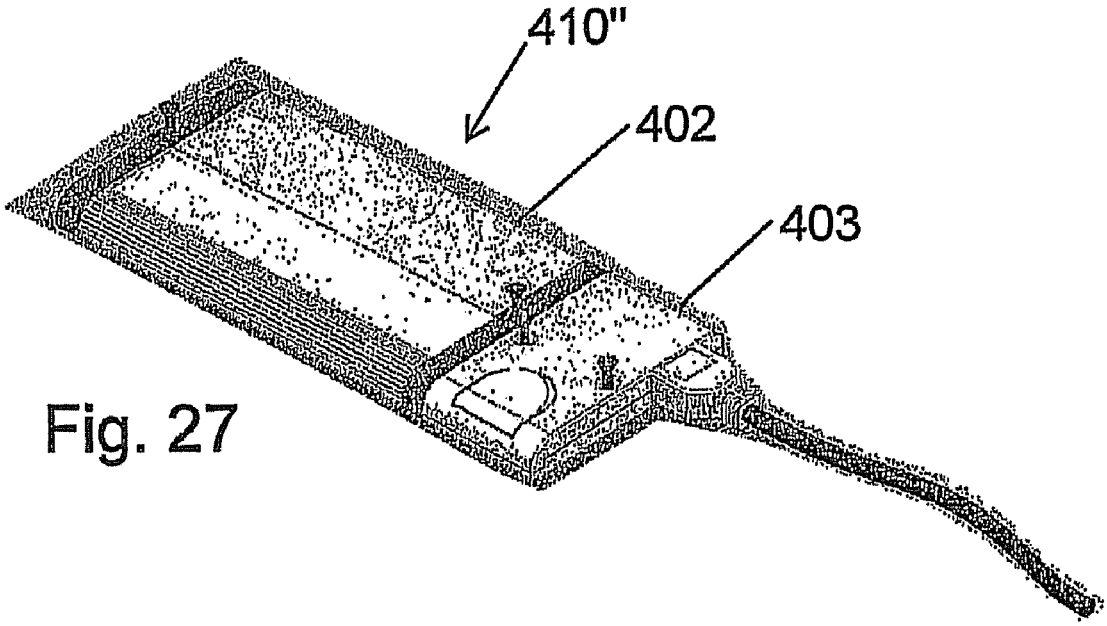
FIG. 27 is a perspective view of an exemplary modular LED lighting system constructed in accordance with an embodiment of the present invention.
Figure 28:
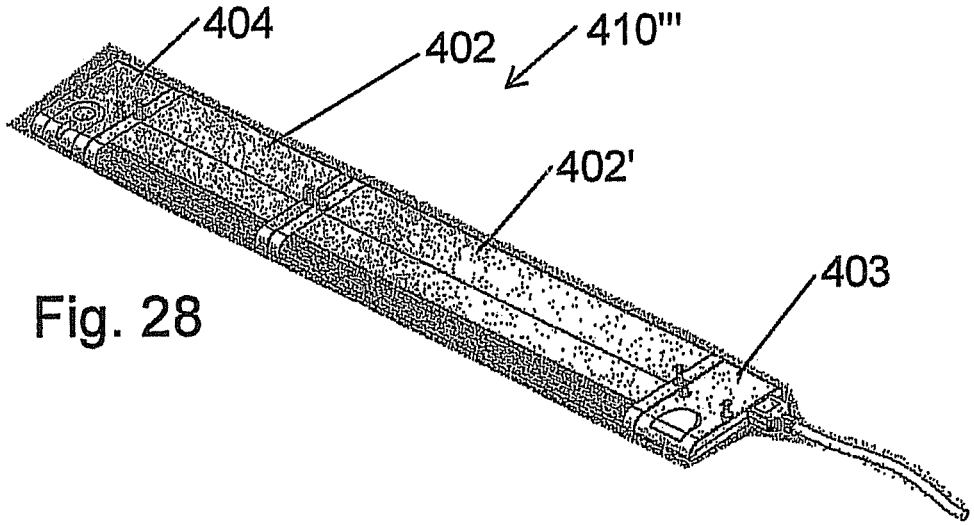
FIG. 28 is a perspective view of an exemplary modular LED lighting system constructed in accordance with an embodiment of the present invention.
Figure 29:
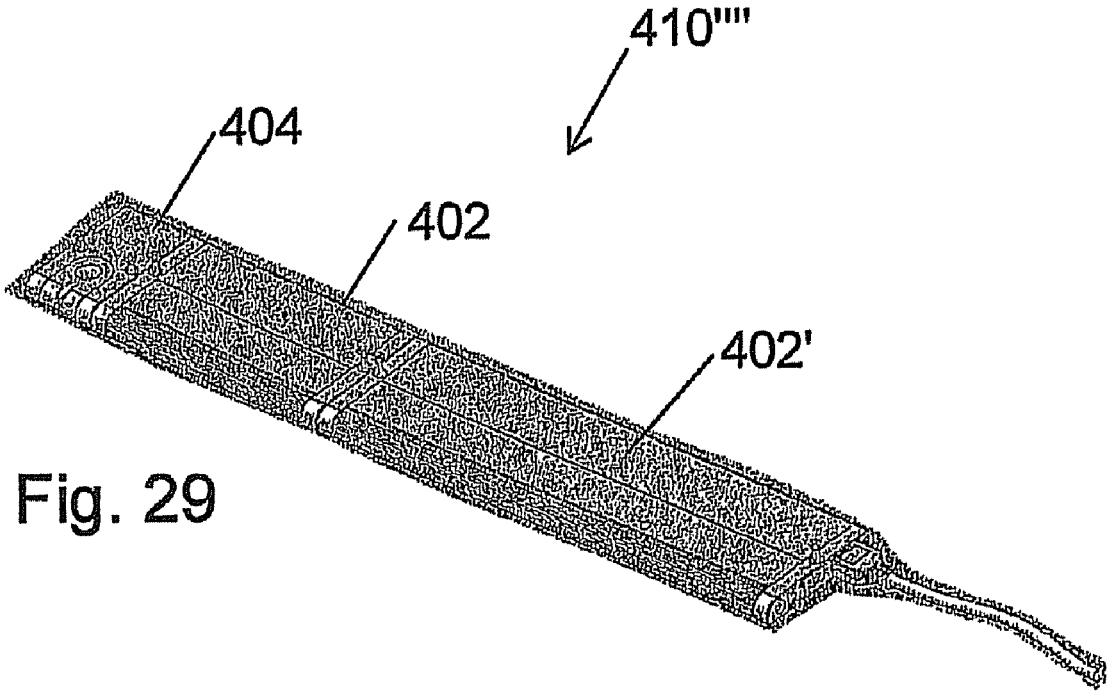
FIG. 29 is a perspective view of an exemplary modular LED lighting system constructed in accordance with an embodiment of the present invention.
Figure 30:
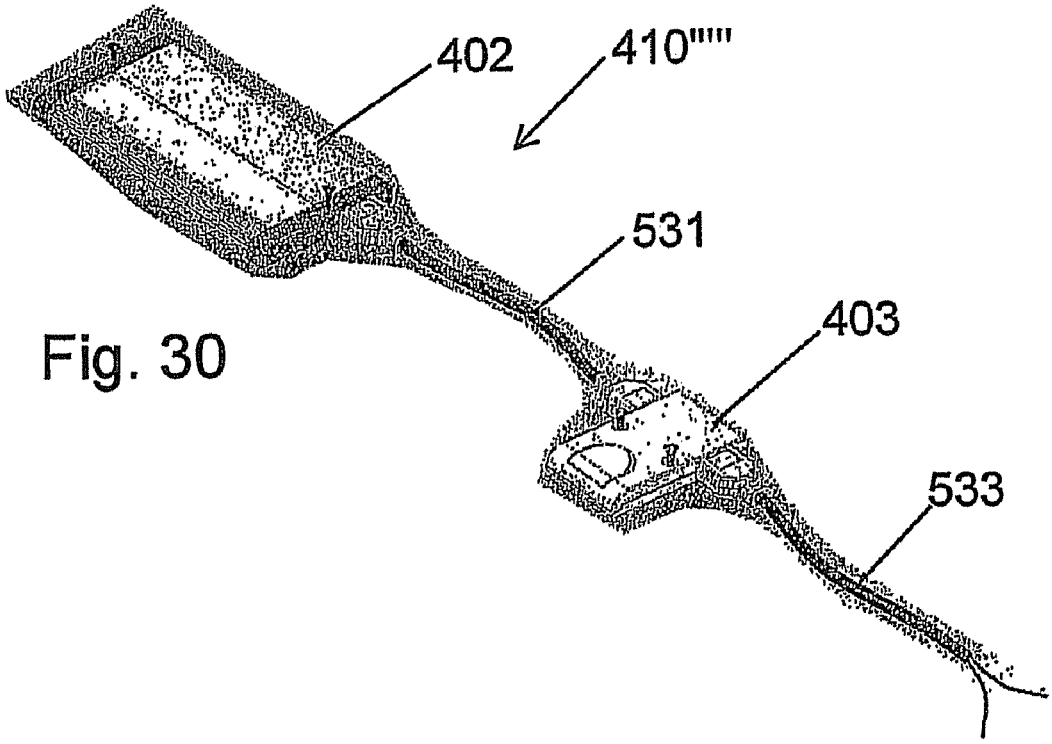
FIG. 30 is a perspective view of an exemplary modular LED lighting system constructed in accordance with an embodiment of the present invention.

FIGS. 25A-25C are side views of the LED module 402, the dimmer module 403, and the nightlight module 404. As can be seen from the side views, the various modules have substantially similar transverse profiles or cross sections and connectors 447*a*, 447*b*. This similarity in cross section and the ability to connect the connectors of various modules directly to one another allows a number of modules to be combined into a modular LED lighting system having a unitary appearance, or at least appear to be a continuous sequence of adjacent pieces with the same or substantially the same cross section. For example, FIG. 26 illustrates a modular LED lighting system 410' that includes a nine LED module 402' (the same as module 402, except longer to accommodate nine (9) LEDs, perhaps with a circuit substantially the same as 521 and 529, except modified for nine (9) LEDs), a dimmer module 403, and a nightlight module 404. FIG. 27 illustrates a modular LED lighting system 410" that includes a three LED module 402 and a dimmer module 403. FIG. 28 illustrates a modular LED lighting system 410''' that includes a nine LED module 402', a three LED module 402, a dimmer module 403, and a nightlight module 404. FIG. 29 illustrates a modular LED lighting system 410'''' that includes a nine LED module 402', a three LED module 402, and a dimmer module 403. FIG. 30 illustrates a modular LED lighting system 410''''' that includes a three LED module 402 and a dimmer module 403 connected by a wiring harness 531. A power cord 533 configured to be connected to a transformer and/or power supply is also shown in FIG. 30. In the exemplary embodiment wires from the power cord are connected to a terminal strip on the transformer (not shown).

Combinations of modules that are connected to one another may be connected to other combinations using cables. It is expected that these and other exemplary systems 410', 410", 410''', 410'''', 410''''' will be connected to a power source via the cable shown, such as switched building power (controlled, e.g., by a wall switch) or un-switched building power. It is expected that those systems with an intensity controller would be connected to either switched or un-switched building power, while those without an intensity controller would be connected to switched building power. These exemplary systems 410', 410", 410''', 410'''', and 410''''' are shown with optional screw type fasteners ready to fasten the modules to a support surface, such as the underside of a cabinet. Of course, other fastening means may be used, such as non-screw-type fasteners, adhesive, etc. All of the modules are shown as connected directly to adjacent modules; in the alternative, any one or any two or more of these connections may be made with optional cables with mating connectors (not shown). The modules shown in exemplary systems 10', 10", 10''', 10'''', and 10''''' may include circuitry like the exemplary circuitry of FIGS. 3*a*, 5, and 7, as appropriate. Although the modules shown in exemplary systems 10', 10", 10''', 10'''', and 10''''' are shown in a specific order, the modules may be configured so that the modules may be attached in virtually any order and still provide the same functionality, like the exemplary circuits of FIGS. 18A, 22, and 24. Virtually any combination and permutation of the components 402, 402', 403, 404, 405, 406, 407 and 409 may be used, either directly connected thereto, or connected via optional cables.

As can be seen from the preceding description a modular LED lighting system that includes any one or more of an LED lighting module, junction box module with connected LED lighting units, power supply module, dimmer and/or nightlight modules is provided. The modular LED lighting system can include, for example, more than one LED module in a daisy chain configuration as well as any number of nightlight modules. The LED lighting module, junction box module, power supply module dimmer, and nightlight modules share a common connector configuration so that they can be interconnected using cables with uniform mating connectors.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. For example, the teachings herein, describing exemplary embodiments of lighting including light emitting diodes (LEDs), may be used with many different types of lighting products (fixtures or portables), such as, for example, incandescent, fluorescent, and halogen lighting products. Unless expressly excluded herein all combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated. Also, the various features of the lighting products discussed above and claimed below and discussed and claimed in the provisional applications incorporated by reference may be considered to be separate lighting product building blocks which may provide utility in and of themselves. Thus, it is contemplated that lighting products may be designed based on the teachings herein using virtually any combination or permutation of any two or more of these separate lighting product features without necessarily some or all of the other features. Accordingly, it is contemplated that lighting products may be claimed using virtually any combination or permutation of any two or more of these lighting product features.

We claim:

1. A lighting assembly comprising at least one lighting unit, each lighting unit comprising:

a housing comprising a base portion and an outer portion, the housing being configured to define an internal cavity and a gap around an outer perimeter of the housing between the base portion and the outer portion;

a circuit board disposed within the housing;

at least one light emitting diode carried by the circuit board; and an electrical wire having a first end for electrical connection to the circuit board, the electrical wire being configured to be wound around a hub disposed radially inward of the gap; and a mounting plate configured to be secured to an external surface, and including a plurality of tabs that snap into engagement with the base portion of the housing to secure the lighting unit to the external surface; and wherein at least a portion of the gap is sized to apply a retaining force to retain a wound portion of the electrical wire within the internal cavity, such that a user applied pulling force on the electrical wire overcomes the retaining force to withdraw the user selected amount of the wound portion of the electrical wire.

2. The lighting assembly of claim 1, wherein the base portion comprises a substrate, the circuit board being thermally coupled to the substrate.

3. The lighting assembly of claim 1, further comprising a voltage converter for electrical connection to a second end of the electrical wire for supplying power to the at least one light emitting diode.

4. The lighting assembly of claim 1, further comprising a second electrical wire having a first end for electrical connection to the circuit board, the second electrical wire extending through an opening in the housing for electrical connection with a second lighting unit.

5. The lighting assembly of claim 1, wherein the gap extends around the entire outer perimeter of the housing.

6. The lighting assembly of claim 1, further comprising an electrical plug electrically connected to a second end of the electrical wire of the lighting unit for supplying power to the at least one light emitting diode.

7. The lighting assembly of claim 1, wherein the at least one lighting unit comprises first and second lighting units, wherein the electrical wire of the second lighting unit is electrically connectable at a second end to the first lighting unit for communicating electricity from the first lighting unit to the at least one light emitting diode of the second lighting unit.

8. The lighting assembly of claim 7, wherein a second end of the electrical wire of the second lighting unit extends into the first lighting unit housing through an opening in the base member of the first lighting unit.

9. The lighting assembly of claim 1, wherein the mounting plate includes a mounting hole for securing the mounting plate to the external surface with a screw-type fastener.

10. The lighting assembly of claim 1, further comprising a junction box including a housing carrying a driver circuit board, a plurality of lighting unit output connectors, a junction box inlet connector for receiving a supply voltage from an associated power supply, and a junction box output connector for transmitting the supply voltage to an associated module of a modular lighting system, wherein a second end of the electrical wire of each lighting unit is configured to be connected to one of the plurality of lighting unit output connectors.

11. The lighting assembly of claim 1, wherein the base portion comprises a substrate thermally coupled to the circuit board, the substrate further comprising at least one thermally conductive projection exposed to an external environment and configured to draw heat away from the at least one light emitting diode; further wherein the outer portion further comprising an end flange extending radially from the hub opposite the substrate, wherein the substrate, hub and end flange form a spool member for retaining the wound portion of the electrical wire; further wherein the electrical wire includes an electrical plug connected to a second end of the electrical wire for supplying power to the at least one light emitting diode; and further wherein the mounting plate includes a mounting hole for securing the mounting plate to the external surface with a screw-type fastener, the mounting hole being aligned with a center of the at least one lighting unit when the at least one lighting unit is assembled with the mounting plate.

12. The lighting assembly of claim 2, wherein the substrate further comprises at least one thermally conductive projection exposed to an external environment and configured to draw heat away from the at least one light emitting diode.

13. The lighting assembly of claim 2, wherein the outer portion further comprising an end flange extending radially from the hub opposite the substrate, wherein the substrate, hub and end flange form a spool member for retaining the wound portion of the electrical wire.

14. A lighting assembly comprising at least one lighting unit, each lighting unit comprising:

a housing configured to define an internal cavity and a gap around an outer perimeter of the housing between a base portion and an outer portion;

a circuit board disposed within the housing;

at least one light emitting diode carried by the circuit board; and an electrical wire having a first end for electrical connection to the circuit board;

wherein the housing comprises a first housing member defining a hub and a second housing member forming a substrate thermally coupled to the circuit board, with the first and second housing members together defining a spool member for retaining a wound portion of the electrical wire around the hub when the wound portion of the electrical wire is wound around the hub; and wherein the gap is configured to permit withdrawal of a user selected amount of the wound portion of the electrical wire from within the internal cavity.

15. The lighting assembly of claim 14, further comprising an electrical plug electrically connected to the second end of the electrical wire for supplying power to the at least one light emitting diode.

16. The lighting assembly of claim 14, wherein the at least one lighting unit comprises first and second lighting units, wherein the electrical wire of the second lighting unit is electrically connectable at a second end to the first lighting unit for communicating electricity from the first lighting unit to the at least one light emitting diode of the second lighting unit.

17. The lighting assembly of claim 14, wherein the gap extends around the entire outer perimeter of the housing.

18. The lighting assembly of claim 14, further comprising a mounting member including a mounting hole for securing the mounting plate to an external surface with a fastener, and a plurality of tabs that snap into engagement with the base portion of the housing to secure the lighting unit to the external surface.

19. A lighting assembly comprising:

first and second lighting units each comprising:

a housing including a base portion and an outer portion, the housing being configured to define an internal cavity, a gap around an outer perimeter of the housing between the base portion and the outer portion, and a hub disposed radially inward of the gap;

a circuit board disposed within the housing; and at least one light emitting diode carried by the circuit board;

a first electrical wire having a first end for electrical connection to the circuit board of the first lighting unit and a second end for electrical connection to an external power source, the first electrical wire being configured to be wound around the hub of the first lighting unit, wherein the gap of the first lighting unit is configured to permit withdrawal of a user selected amount of a wound portion of the first electrical wire from within the internal cavity of the first lighting unit; and a second electrical wire having a first end for electrical connection to the circuit board of the second lighting unit and a second end for electrical connection to the circuit board of the first lighting unit, the first electrical wire being configured to be wound around the hub of the second lighting unit, wherein the gap of the second lighting unit is configured to permit withdrawal of a user selected amount of a wound portion of the second electrical wire from within the internal cavity of the second lighting unit.

20. The lighting assembly of claim 19, wherein each of the first and second lighting units further comprises a substrate disposed within the housing and thermally coupled to the corresponding circuit board.

21. The lighting assembly of claim 19, wherein each lighting unit further comprises a mounting member including a mounting hole for securing the mounting member to an external surface with a fastener, and a plurality of tabs that snap into engagement with the base portion of the housing to secure the lighting unit to the external surface.

22. The lighting assembly of claim 19, wherein each base portion comprises a substrate thermally coupled to the corresponding circuit board, the substrate further comprising at least one thermally conductive projection exposed to an external environment and configured to draw heat away from the corresponding at least one light emitting diode; further wherein each outer portion further comprising an end flange extending radially from the corresponding hub opposite the corresponding substrate, such that the associated substrate, hub and end flange form a spool member for retaining the wound portion of the corresponding electrical wire; further wherein each electrical wire includes an electrical plug connected to a second end of the electrical wire for supplying power to the corresponding least one light emitting diode; and further wherein each lighting unit includes a mounting plate having a mounting hole for securing the mounting plate to an external surface with a screw-type fastener, the mounting hole being aligned with a center of the at least one lighting unit when the at least one lighting unit is assembled with the mounting plate.

* * * * *